US005236185A

United States Patent [19]

Taneda et al.

[11] Patent Number: 5,236,185

[45] Date of Patent: Aug. 17, 1993

[54] SHEET DISTRIBUTING SYSTEM

[75] Inventors: Kengo Taneda; Masaki Ishida; Masaki Osuga; Shigeki Yamazaki, all of Kanagawa, Japan

[73] Assignee: Fuji Xerox Co., Ltd., Tokyo, Japan

[21] Appl. No.: 727,895

[22] Filed: Jul. 10, 1991

[30] Foreign Application Priority Data

| | | | |
|---|---|---|---|
| Jul. 11, 1990 | [JP] | Japan | 2-181616 |
| Jul. 16, 1990 | [JP] | Japan | 2-185316 |
| Jul. 16, 1990 | [JP] | Japan | 2-185317 |
| Jul. 16, 1990 | [JP] | Japan | 2-185318 |
| Jul. 25, 1990 | [JP] | Japan | 2-194780 |

[51] Int. Cl.[5] ..... B42B 2/00; B65H 39/02

[52] U.S. Cl. ..... 270/53; 270/58

[58] Field of Search ..... 270/53, 37, 58, 52

[56] References Cited

U.S. PATENT DOCUMENTS

| | | | |
|---|---|---|---|
| 4,083,550 | 4/1978 | Pal | 270/53 |
| 4,681,310 | 7/1987 | Cooper | 270/53 |
| 4,687,191 | 8/1987 | Stemmle | 270/53 |
| 5,029,831 | 7/1991 | Green | 270/53 |
| 5,044,625 | 9/1991 | Reid | 270/53 |
| 5,060,922 | 10/1991 | Shibusawa | 270/53 |
| 5,088,709 | 2/1992 | Yamamoto | 270/53 |
| 5,106,067 | 4/1992 | Higaki | 270/53 |
| 5,169,134 | 12/1992 | Ishiguro et al. | 270/58 X |

FOREIGN PATENT DOCUMENTS

| | | | |
|---|---|---|---|
| 301596 | 2/1989 | European Pat. Off. | 270/53 |
| 63-41360 | 2/1988 | Japan . | |
| 63-252872 | 10/1988 | Japan . | |
| 64-302 | 1/1989 | Japan . | |
| 64-34855 | 2/1989 | Japan . | |
| 75361 | 3/1989 | Japan | 270/53 |
| 1-271371 | 10/1989 | Japan . | |
| 276694 | 11/1990 | Japan | 270/53 |
| 9005641 | 5/1990 | World Int. Prop. O. | 270/53 |

*Primary Examiner*—Edward K. Look
*Assistant Examiner*—John Ryznic
*Attorney, Agent, or Firm*—Finnegan, Henderson, Farabow, Garrett & Dunner

[57] ABSTRACT

A sheet distributing system including a sheet transfer unit, disposed within a housing, for transferring recorded sheets discharged from a sheet exit of an image recording unit to a sheet distribution stage, and a set of vertically arranged bin trays on one side of the housing and being moved toward the sheet distribution stage at the distributing timings of the recorded sheets, whereby the recorded sheets are distributed into the bin trays. The sheet distributing system further includes a post-processing unit located below or above the sheet transfer unit and disposed in a space, within the housing, which extends in the direction of the width of the sheet transfer unit, and a post-process control unit for causing the post-processing unit to successively apply a predetermined post-process to one side marginal portion of a stack of recorded sheets being contained in each of the bin trays at a post-processing stage different from the sheet distribution stage, when the sheet distributing operation has been completed. The post-processing unit may be a stapler or a puncher.

18 Claims, 56 Drawing Sheets

173
FEED MOT
174
SOL
58
BIN DRIVE MOT
80
TAMPER DRIVE MOT
107
STAPLER DRIVE MOT
115
ADVANCE/RETRACTION DRIVE MOT
155
OUTPUT INTERFACE
152
ROM
151
CPU
160
CPU (BASE MACHINE)
153
RAM
154
INPUT INTERFACE
38
EXIT SNR
65
UPPER LIMIT SNR
66
LOWER LIMIT SNR
130
SHEET PRESENCE/ ABSENCE SNR
135
SHEET PRESENCE/ ABSENCE SNR
78
TAMPER HOME SNR
121
STAPLER POSITION SNR
122
STAPLER POSITION SNR
171
START SW
172
MODE SW 12
605
200a
Po
100

P1(S)

P2(S)

P2(P)

P1(P)

12
605
200a
Po
100

P1(P)

P1(S)

P2(P)

P2(S)

SHEET DISTRIBUTING SYSTEM

BACKGROUND OF THE INVENTION

1. Field of the Invention

The present invention relates to a sheet distributing system for distributing recorded sheets discharged from an image recording apparatus, such as a copying machine or a printer, into sheet receiving trays, and more particularly to a sheet distributing system capable of applying post-processes, such as stapling, punching, and binding, to the stacked recorded sheets contained in the trays.

2. Discussion of the Related Art

In a sheet distributing system called a sorter, a sheet transfer path, disposed within a sorter housing, transfers a recorded sheet or sheets discharged from a sheet exit of an image recording unit to a sheet distribution stage. A set of vertically arranged bin trays are provided adjacent to the side of the housing, and is moved toward the sheet distribution stage at the distributing timings of the recorded sheets. With the construction, the sheets are distributed into the bin trays.

In this type of sorter, it is necessary to hold the stack of recorded sheets contained in each bin tray against the disarrangement of them. To this end, a sheet arranging mechanism is usually provided in the sorter (Japanese Patent Application Unexamined Publication Nos. Sho. 64-34855 and Hei. 1-271371).

Usually, post-processing, such as stapling, is applied to the stacked recorded sheets that are sorted and contained in the trays. To realize this, a post-processing unit, such as a stapler is assembled into the sorter, to automatically staple the stacked recorded sheets. This type of sorter is disclosed in Japanese Patent Application Unexamined Publication Nos. Sho. 63-41360 and Sho. 63-252872, and Japanese Patent Application Examined Publication No. sho. 64-302.

The sorter disclosed in Japanese Patent Application Unexamined Publication No. Sho. 63-41360 is constructed such that the stacked recorded sheets, which are distributed into and contained in the bin trays, are transferred into a post-processing tray, and then the stapling process is applied to the stacked recorded sheets contained in the post-processing tray. Because of such a construction, the post-processing tray must be provided in addition to the bin trays, and a transfer means for transferring the stacked recorded sheets to the post-processing tray must be also provided. The use of the additional components and mechanism makes the sorter construction complicated. The stacked recorded sheets, once arranged in the bin trays, may be disarranged when the sheets are transferred from the bin tray to the post-processing tray, possibly making the post-process by the stapler meaningless.

In the sorter as disclosed in Japanese Patent Application Unexamined Publication No. Sho. 63-252872 or Japanese Patent Application Examined Publication No. Sho. 64-302, a stapler is disposed in a location near the sheet distribution stage where the stapler does not interfere with the sheet transfer member. The post-process by the stapler is applied to the stacked recorded sheets being contained in the bin tray (one corner portion of the stacked recorded sheets contained in the bin tray). Accordingly, this type of sorter is free from the disarranging problem of Japanese Patent Application Unexamined Publication No. Sho. 63-41360, but cannot have the function of the dual stapling which staples one side marginal portion of the stacked recorded sheets at two positions.

SUMMARY OF THE INVENTION

The present invention has been made in view of the above circumstances and has an object to provide a sheet distributing system which is free from the problem of making the system construction complicated and the poor post-process by the post-processing unit, and is capable of applying post-process, for example, stapling, to one side marginal portion of the stacked recorded sheets at a desired number of positions.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as mentioned and broadly described herein, the sheet distributing system of this invention having sheet transfer means, disposed within a housing, for transferring recorded sheets discharged from a sheet exit of an image recording unit to a sheet distribution stage, and a set of vertically arranged bin trays on one side of the housing and being moved toward the sheet distribution stage at the distributing timings of the recorded sheets, whereby the recorded sheets are distributed into the bin trays, the sheet distributing system of the invention comprises a post-processing unit located below or above the sheet transfer means and disposed in a space, within the housing, which extends in the direction of the width of the sheet transfer means, and post-process control means for causing the post-processing unit to successively apply a predetermined post-processes to one side marginal portion of a stack of recorded sheets being contained in each of the bin trays at a post-processing stage different from the sheet distribution stage, when the sheet distributing operation has been completed.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

In the drawings,

FIG. 24(*b*) is a view showing the operation of sheet arranging means incorporated into the sheet distributing system of FIG. 24(*a*);

FIG. 30(*b*) is a view showing the operation of the post-processing unit contained in the sheet distributing system of FIG. 30(*a*);

FIG. 37(*b*) is a flowchart showing a control flow for a corner stapling process;

FIG. 41(*b*) is a side view showing the scheme of a sixth embodiment of the sheet distributing system according to the present invention;

FIG. 41(*c*) is a side view showing the scheme of a seventh embodiment of the sheet distributing system according to the present invention;

DETAILED DESCRIPTION OF THE PREFERRED EMBODIMENTS

1st Embodiment

A first embodiment of a sheet distributing system according to the present invention will be described with reference to FIGS. 1 through 23 (*c*).

Figure 1:
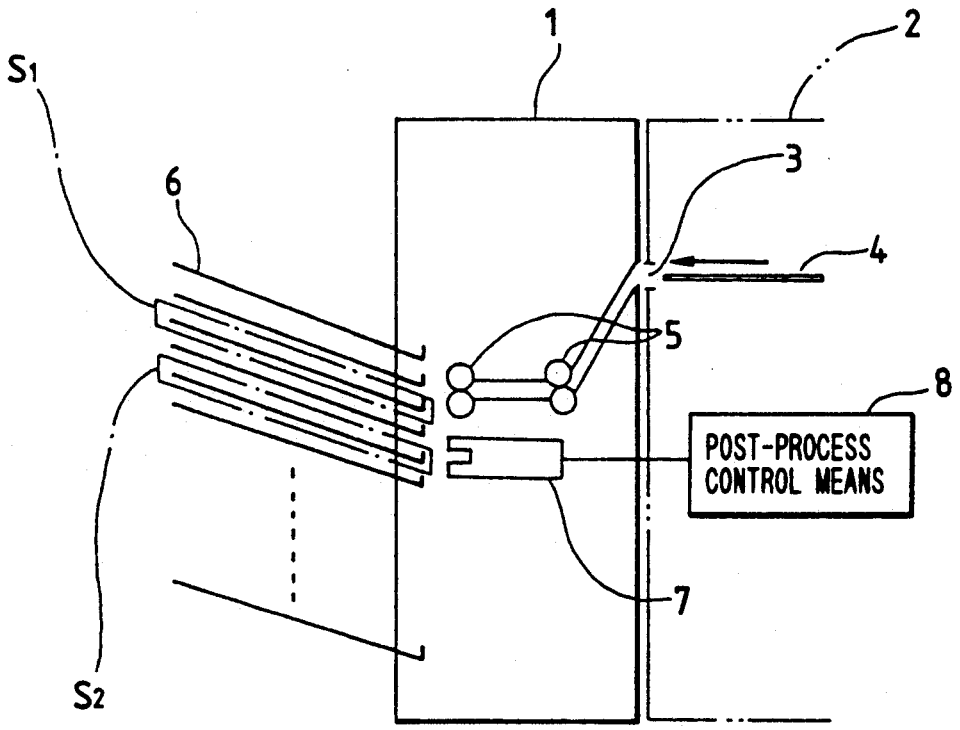
FIG. 1 is a side view showing the scheme of a first embodiment of a sheet distributing system according to the present invention.

The scheme of the first embodiment of the invention is as illustrated in FIG. 1. As shown, the embodiment is based on a sheet distributing system having sheet transfer means 5, disposed within a sorter housing 1, for transferring a recorded sheet or sheets 4 discharged from a sheet exit 3 of an image recording unit 2 to a sheet distribution stage S1, and a set of vertically arranged bin trays 6 on one side of the housing 1 and being moved toward the sheet distribution stage S1 at the distributing timings of the recorded sheets 4, whereby the recorded sheets 4 are distributed into the bin trays 6. The sheet distributing system of the embodiment comprises a post-processing unit 7 located below or above the sheet transfer means 5 and disposed in a space, within the housing 1, which extends in the direction of the width of the sheet transfer means 5, and post-process control means 8 for causing the post-processing unit 7 to successively apply predetermined post-processes to one side marginal portion of a stack of recorded sheets 4 being contained in the bin tray 6 at a post-processing stage S2 different from the sheet distribution stage S1, when the sheet distributing operation has been completed.

In the technical means as just mentioned, the sheet transfer means 5 may be any means if it is able to transfer the recorded sheets 4 up to the sheet distribution stage S1. To make it easy to deal with unnecessary recorded sheets 4 when no sorting is required, another sheet receiving tray for receiving the recorded sheets 4 is preferably provided in addition to the bin trays 6.

The number of bin trays 6 may be selected according to the sorting capability required for a sheet distributing system designed. The bin trays 6 must be constructed so as to receive discharged recorded sheets 4 being positioned in place therein. To this end, the bin trays 6 may be provided with positioning flanges, the vertical wall of the sorter housing 1 may be used for positioning the sheets, or any other suitable technical means may be adopted. In order to arrange the received recorded sheets 4 in a predetermined place within the bin trays 6, sheet arranging means for arranging the recorded sheets 4 in the positioning place at predetermined timings is preferably provided.

Moving means for moving the bin trays 6 may be any means if it is able to successively move the bin trays 6 to the sheet distribution stage S1. To reduce the height of the housing 1, the gap between the adjacent bin trays 6 is as short as possible reasonably, as far as it does not obstruct the sorting process and the post-processes.

The post-processing stage S2 may be disposed at any position if it is different from that of the sheet distribution stage S1. Those stages S1 and S2 are preferably as close as possible in order to remove an excessive motion of the bin trays 6 when the operation mode of the sheet distributing system changes from the sorting process to the post-process.

The post-processing unit 7 may be any type of unit, for example, a stapler, a puncher, or a binder, if the unit can apply the post-process to one side marginal portion of the stacked recorded sheets 4.

The post-processing unit 7 may be installed in various ways. For example, the unit may be installed such that when the post-process is not executed, it retracts to a place where it does not obstruct the vertical motion of the bin trays 6, and when the post-process is executed, it advances to a place where the post-process is executed. Further, the unit 7 may be installed such that the unit 7 is fixed in a place where the vertical motion of the bin trays 6 is not obstructed, and when the post-process is executed, the subject bin tray 6 to be processed which has stayed at the post-processing stage S2, is moved toward the post-processing unit 7 for realizing the post-process.

In the former type of the unit installation, the design must be made so that in the post-process execution mode, the post-processing unit 7 which has reached the post-processing place does not obstruct the subject bin tray 6 staying at the post-processing stage S2. To this end, there are many possible approaches. One of the approaches is to form cut-outs at the portions of the bin trays 6 positionally corresponding to the post-processing place. In the sheet distributing system of the type using the smallest possible bin tray gap, it is required to construct the tray moving means so as to widen the gaps among the subject bin tray 6 and the upper and lower trays 6 located on both sides of the former.

In the latter type of the unit installation, the design must be made so as not to disarrange the arranged recorded sheets 4 contained in the bin trays 6. One of the specific approaches to realize this is that the bin tray 6 is designed so as to have the dual structure, and the upper tray is pulled out by means of pull-out support means provided at the post-processing stage S2 and the post-process is applied to the recorded sheets 4 contained in the upper tray. In another approach, an expandable gripper is attached to the post-processing unit 7, the stack of the recorded sheets 4 are pulled out of the subject bin tray 6 containing them by means of the gripper, and the post-process is applied to the recorded sheet stack 4.

In the case where the post-processing unit 7 is the stapler, there are generally used two types of staplers; one (dual stapler) is for stapling the stacked recorded sheets 4 at two positions in one side marginal portion of the stacked recorded sheets 4 and the other (corner stapler) is for stapling them at one position in one corner portion thereof. When the functions of those types of staplers are required for the post-process, it is preferable to use separately two types of stapler, that is, the dual stapler and the corner stapler. For the dual stapler, use of the two fixed positions suffices for the stapling. To secure the optimum two stapling positions, however, the distance between the two stapling positions is preferably varied according to the size of the recorded sheet.

The post-process by the post-processing unit 7 may be applied for all of the bin trays after they are subjected to the sorting process. However, there is a case that some of the bin trays 6 are empty since the recorded sheets 4 have been pulled out of them. In such a case, if the post-process is applied for all of the bin trays, the post-processes applied to those empty bin trays are meaningless. To remove the meaningless post-process, detecting means to detect whether the sheets are present or absent in the subject bin tray are preferably attached to the post-processing unit 7.

The post-process control means 8 for causing the post-processing unit 7 to execute predetermined post-processes, operates in a manner that it first moves the subject bin tray 6 to the post-processing stage S2, and then controls only the post-processing unit 7 or the combination of the unit and an additional mechanism (in the case of the bin tray movable type, bin tray pull-out means, for example).

The control functions of the post-process control means 8 may be properly selected according to the functions to be realized.

For example, in the case where the image recording apparatus is a copying machine with an ADF (automatic document feeder), when it is operated in an ADF mode, the post-process control means starts the post-process by the post-process control means 8 upon completion of copying the last original document by the ADF. In the apparatus of the type in which the post-processing unit 7 is provided with the sheet detecting means, when the detecting means detects the absence of the recorded sheets 4 in the subject bin tray 6, the post-process control means cancels the post-processing operation, and immediately moves a bin tray 6 to be post-processed next to the post-processing stage S2. In the apparatus of the type in which the post-processing unit 7 is provided with the dual stapler and the corner stapler, one of the staplers selected by select means is used as an object to be controlled.

Figure 2:
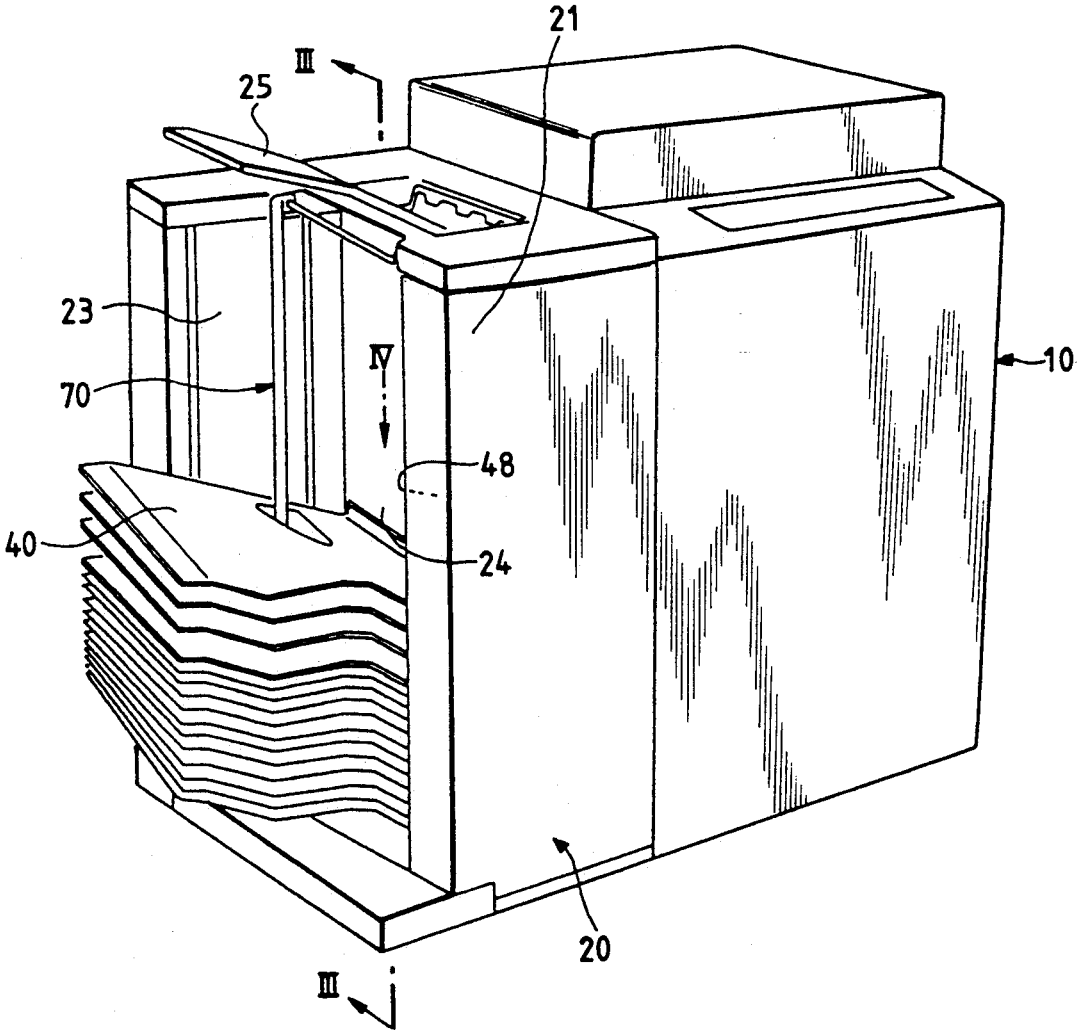
FIG. 2 is a perspective view showing the sheet distributing system of the first embodiment, which is coupled with an image recording unit.
Figure 3:
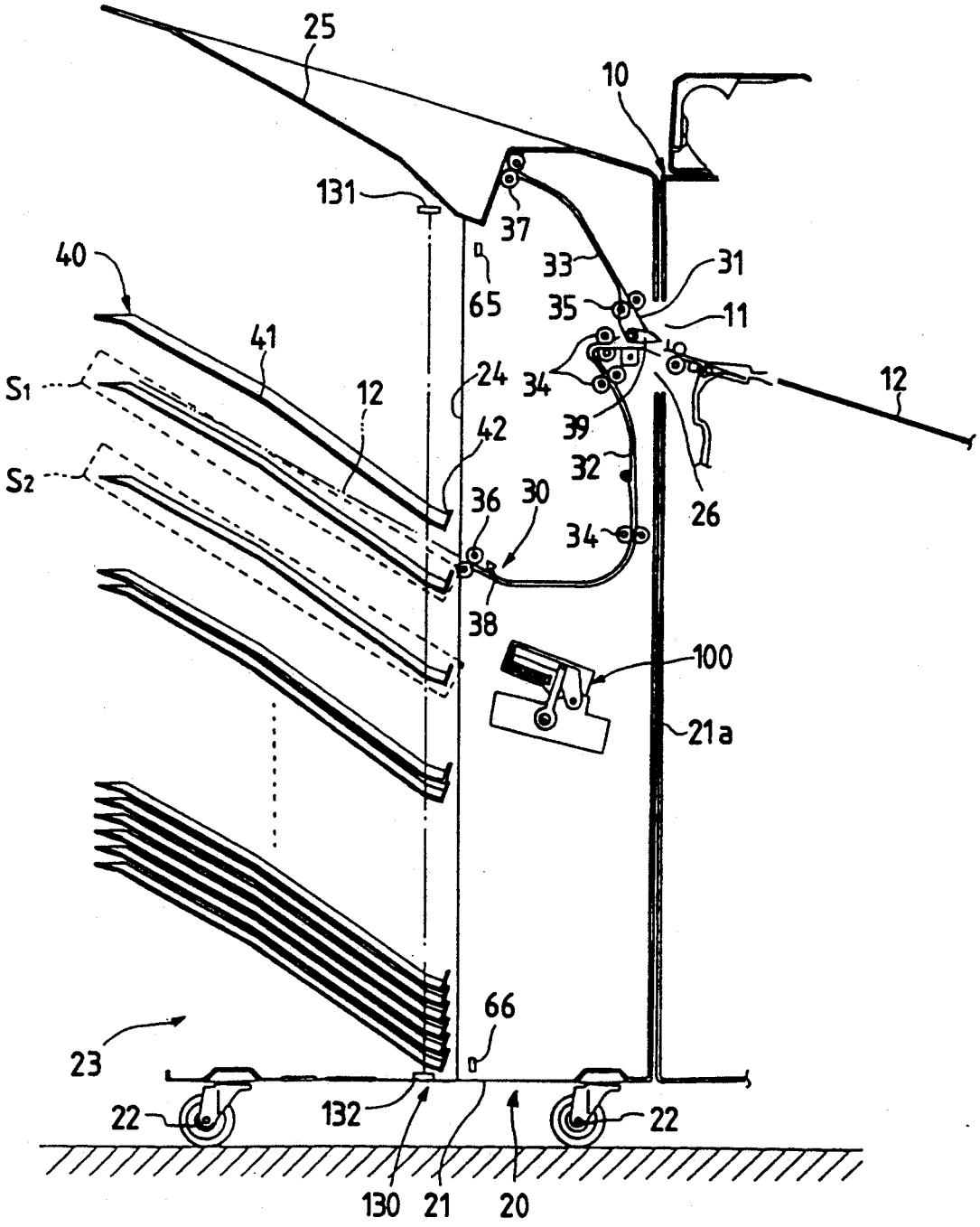
FIG. 3 is a sectional view taken on line III—III in FIG. 2.

FIGS. 2 and 3 show a sheet distributing system (hereinafter referred to as a sorter) 20 as a first embodiment of the invention, which is combined with a main body of a copying machine (base machine) 10 with an ADF (not shown).

In the figures, a housing 21 of the sorter 20 is movable with the aid of casters 22. The housing 21 has a concavity 23 U-shaped in cross section, which is opened opposed to the base machine 10, and vertically extends. The concavity 23 communicates with the inside of the housing 21 through an opening 24 formed in the wall of the housing 21, which faces the base machine 10, and partially defines the concavity 23.

A bin tray unit 40 (consisting of 20 bin trays, in this instance), disposed facing the concavity 23, is vertically movable, with the distal ends of the trays being protruded into the outside of the concavity 23. A nonsort tray 25, which is used when no sorting process is required, is disposed on the top of the housing 21.

A sheet entrance port 26 is opened in a housing plate 21*a* corresponding to a sheet exit port 11 of the base machine 10. A recorded sheet 12 entered through the entrance port 26 is transferred to the bin tray unit 40 or the nonsort tray 25 through a sheet transfer system 30.

A sheet arranging mechanism 70 is disposed in connection with the bin tray unit 40. In a sorting mode, the sheet arranging mechanism 70 orderly arranges the recorded sheets 12 within the bin tray unit 40 at predetermined time intervals. In a stapling mode, the same holds the stacked recorded sheets 12.

A stapler 100 is disposed below the sheet transfer system 30 and in a space within the housing 21, which extends across the sheet transfer system 30. A location opposed to the stapler 100 is used as the post-processing stage S2. The stapler 100 staples one side marginal portion of the stacked recorded sheets 12 in one tray of the bin tray unit 40, which is positioned at the post-processing stage S2 at two positions in the dual stapling mode or at one corner of the sheet stack in the corner stapling mode.

In FIG. 3, the sheet transfer system 30 includes a common sheet transfer path 31 ranging from the entrance port 26 to the inside of the housing 21. The common sheet transfer path 31 is branched into two paths, a first transfer path 32 turned downwardly and a second transfer path 33 turned upwardly. The first transfer path 32 extends up to the sheet distribution stage (where a subject bin tray 40 containing the stacked recorded sheets 12 is to be set) S1. The second transfer path 33 extends up to the nonsort tray 25.

A proper number of transfer rollers 34 are provided at proper spatial intervals between both ends of the first sheet transfer path 32. Similarly, a proper number of transfer rollers 35 are provided at proper spatial intervals between both ends of the second transfer path 33. Exit roller pairs 36 and 37 are provided at the forward ends of the transfer paths 32 and 33, respectively. A sheet exit sensor (abbreviated frequently as EXIT SNR) 38 is disposed just before the exit roller 36 of the first transfer path 32. When the recorded sheet 12 passes the exit sensor 38, the sensor produces a signal of high level, for example.

Reference numeral 39 designates a select gate, disposed in the common sheet transfer path 31, for selecting the first transfer path 32 or the second transfer path 33.

Figure 4:
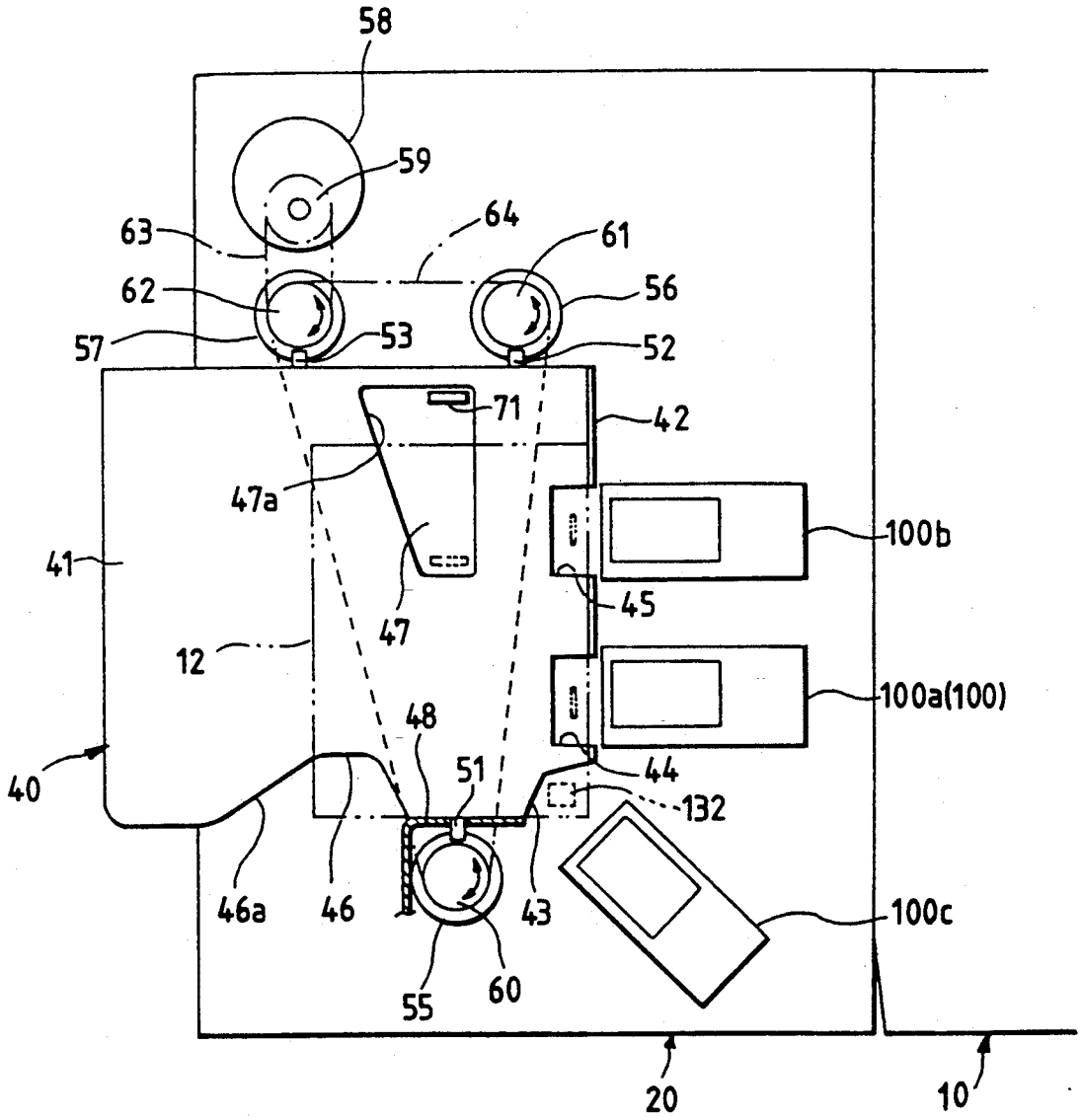
FIG. 4 is a view showing an essential portion of the sheet distributing system as viewed in the direction of an arrow IV in FIG. 2.

In FIGS. 2 through 4, the bin trays 40 are disposed such that they are downwardly inclined at a predetermined angle toward the opening 24 of the concavity 23. Each bin tray 40 includes a planar tray base 41, a positioning flange 42, cut-outs 43, 44 and 45, a grip cut-out 46, and a tamper opening 47. The tray base 41 is slightly inclined toward the foreside as viewed in its width (corresponding to the width of the first transfer path 32). The positioning flange 42 erects at the edge of the tray base 41, which is located closer to the opening 24. The cut-outs 43 to 44 are formed in the side portion of the tray base 41, which is also closer to the opening 24, at three positions (the corner, and two positions on both sides of the center). The grip cut-out 46 for gripping the stack of the recorded sheets 12 is formed in the portion of the tray base 41, located substantially at the center of the foreside of the tray base as viewed in the width direction of the tray base. The opening 47 shaped like a triangle is formed in the tray base 41, while being disposed in the location closer to the rear side of the tray base 41 as viewed in its width direction, and to the positioning flange 42. The bin tray 40 may be reinforced by providing a reinforcing flange along the edge of the rear side of the tray base 41, which is adjacent to the positioning flange 42.

A housing plate defining the foreside of the concavity 23 of the housing 21 serves as a wall 48 for positioning the recorded sheets 12 in the bin tray 40.

Of the side edges of the grip cut-out 46 and the tamper opening 47, at least the edges 46*a* and 47*a* located closer to the distal end of the bin tray 40 are slanted at predetermined angles with respect to the width direction of the bin tray 40. With the slanted edges, when the recorded sheet 12 enters into the bin tray 40 in the sorting mode, the sheet will not be stopped by the edges of the cut-out 46 and the opening 47.

Figure 5:
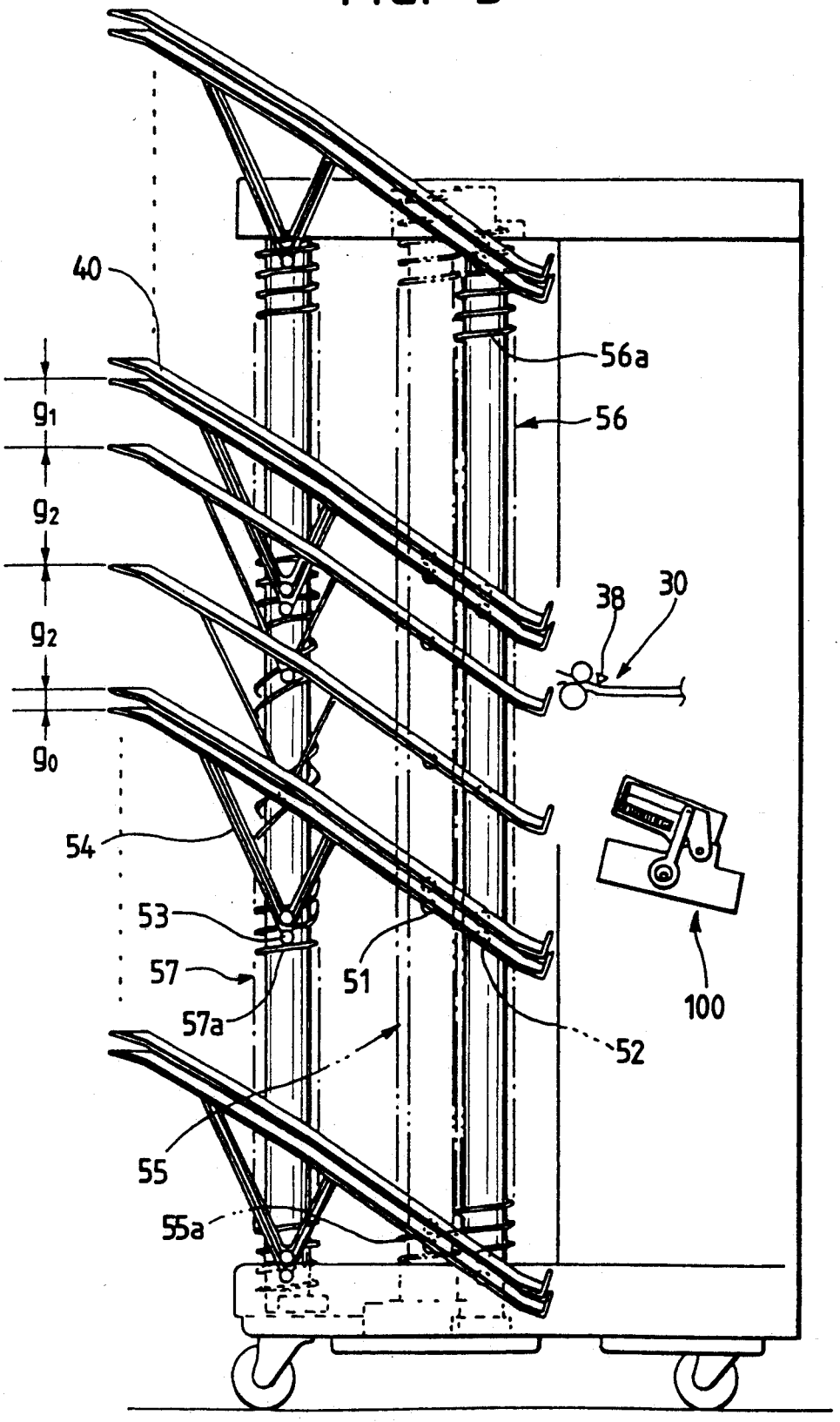
FIG. 5 is a front view showing the construction of a bin tray moving system.
Figure 6:
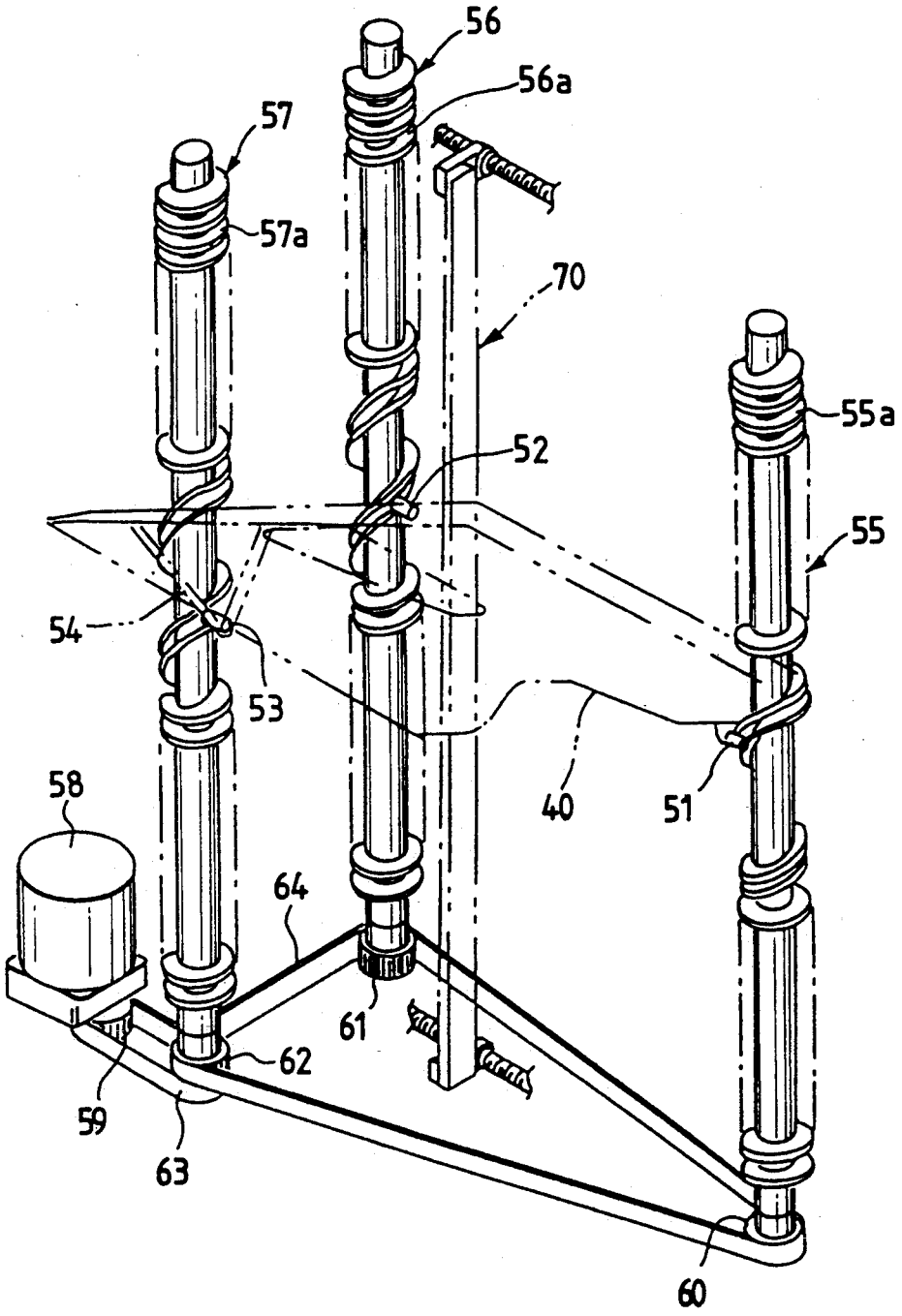
FIG. 6 is a perspective view showing the construction of the bin tray moving system.

In the description to follow, reference is made to FIGS. 4 to 6. As shown, a pair of pins 51 and 52 are protruded outwardly from the opposite sides of the bin tray 40 (as viewed in its width direction) at the locations of the sides closer to the positioning flange 42. A V-shaped support arm 54 is mounted on one side of the bin tray in the location closer to the distal end of the tray. A pin 53 is protruded from the bottom end of the support arm 54.

Cam screws 55 to 57 are rotatably erected on the locations of the housing 21, which are respectively adjoining to the pins 51 to 53 and allocated on both sides of the bin tray as viewed in the width direction of the concavity 23. The pins 51 to 53 engage cam grooves 55*a* to 57*a* of the cam screws 55 to 57, respectively.

In this embodiment, the pitches of each of the cam grooves 55*a* to 57*a* are not uniform, but the pitches of the cam groove portions positionally corresponding to the sheet distribution stage S1 and the post-processing stage S2 are sufficiently larger than those of the remaining portions.

To be more specific, the bin trays 40 positionally corresponding to the sheet distribution stage S1 and the post-processing stage S2 are contiguously disposed. A gap $g_1$ between the bin tray 40 positionally corresponding to the sheet distribution stage S1 and the bin tray 40 located above the former, and gaps $g_2$ between the bin tray 40 positionally corresponding to the post-processing stage S2 and the bin trays 40 above and below the former are sufficiently larger than a gap $g_0$ between the two adjacent bin trays 40 which are other than the above ones. The gaps $g_1$ and $g_2$ are selected to such values as not to obstruct the sorting process. The gap $g_0$ is selected in such a value that the bin trays 40 will not contact with each other.

A drive system for the cam screws 55 to 57 is made up of a reversible motor (a stepping motor in this embodiment) 58 for bin drive, a drive pulley 59 fixed to an output shaft of the bin drive motor 58, follower pulleys 60 to 62 mounted to the bottom ends of the cam screws 55 to 57, a drive belt 63 wound around the drive pulley 59 and the follower pulley 62, and a timing belt 64 wound around the follower pulleys 60 to 62 and for transferring a drive force generated by the drive motor 58 to the cam screws 55 to 57 at the same timings.

In this embodiment, each bin tray 40 ascends or descends by one pitch when the cam screws 55 to 57 are rotated by one turn.

In FIG. 3, reference numeral 65 designates an upper limit sensor for detecting the arrival of the top bin tray 40 of the bin tray unit at the upper limit position, and reference numeral 66 designates a lower limit sensor for detecting the arrival of the bottom bin tray 40 at the lower limit position.

Figure 7:
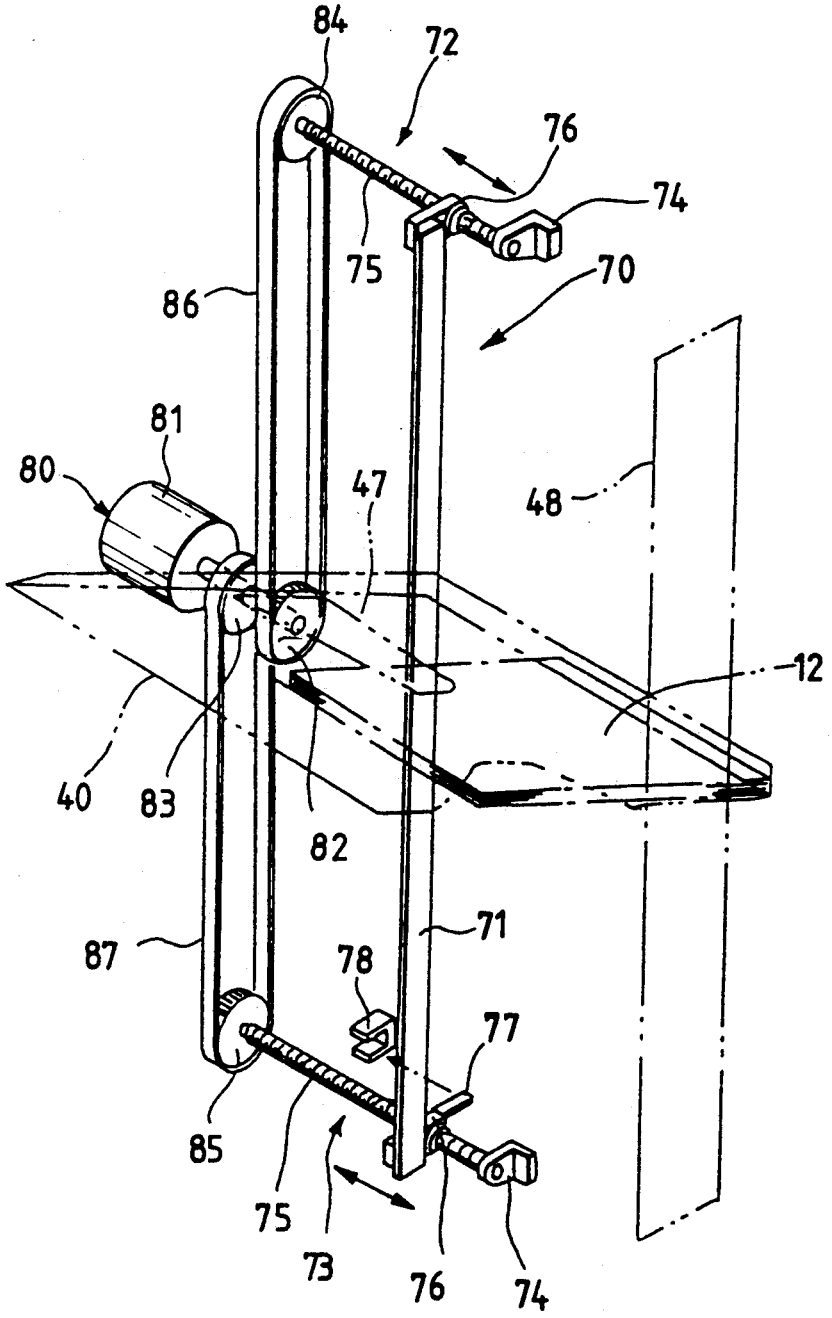
FIG. 7 is a perspective view showing a sheet arranging mechanism used in the sheet distributing system.

In FIG. 7, the sheet arranging mechanism 70 includes a plate-like tamper 71 to be made to pass through tamper opening 47 of each bin tray 40, a pair of movable support mechanisms 72 and 73 which are respectively coupled with the top and bottom ends of the tamper 71, and move the tamper 71 in the width direction of the bin tray 40, and a sheet arranging drive system 80 for driving the support mechanisms 72 and 73.

In this embodiment, the movable support mechanisms 72 and 73 are constructed such that ball screw shafts 75 are rotatably provided between a pair of bearing brackets 74, and are screwed into nuts 76, and the nuts 76 are fixed to the top and bottom ends of the tamper 71.

The drive system 80 includes a tamper drive motor (stepping motor in this embodiment) 81, a couple of drive pulleys 82 and 83 fixed to the output shaft of the tamper drive motor 81, follower pulleys 84 and 85 respectively fixed to the ball screw shafts 75 of the movable support mechanisms 72 and 73, and timing belts 86 and 87 respectively wound around the drive pulleys 82 and 83 and the follower pulleys 84 and 85.

The nut 76 of the lower movable support mechanism 7 is provided with a protruded piece 77 for position detection. When the protruded piece 77 reaches a home position sensor 78 (in this embodiment, an optical sensor of the transmission type in which a light emitting element and a photodetecting element are oppositely disposed) located at the home position, the sensor 78 produces a signal of low level, for example, indicating that the tamper 71 has reached the home position.

In the instant embodiment, the stapler 100 consists of a pair of dual staplers 100*a* and 100*b* and a corner stapler 100*c*. The staplers 100*a* and 100*b* are fixedly disposed in opposition to the cut-outs 44 and 45 of the bin tray unit 40, and staples one side marginal portion of the stacked recorded sheets 12 at two positions. The corner stapler 100*c* is fixed disposed in opposition to the cut-out 43, and staples one corner of the stacked recorded sheets 12. In the instant embodiment, the stapler 100*c* is slanted at 45 degrees with respect to the dual staplers 100*a* and 100*b* in the horizontal plane.

Figure 8A:
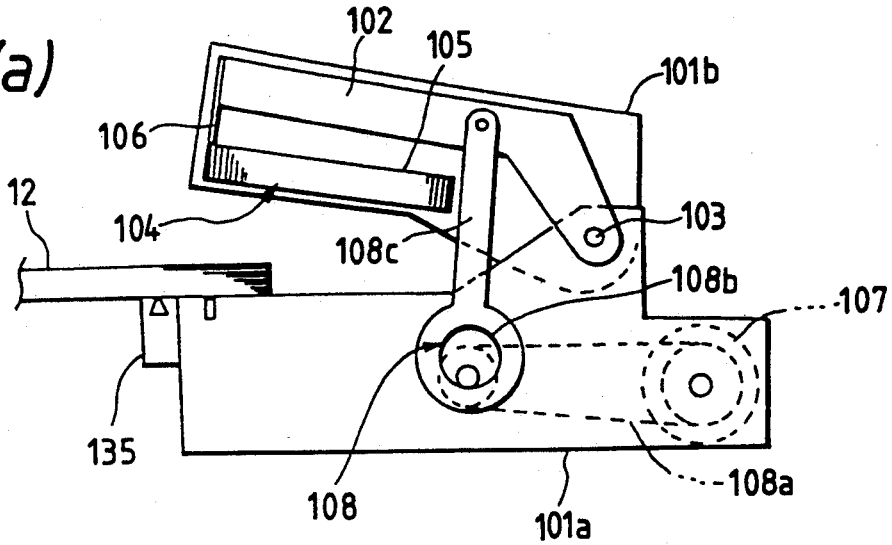
FIGS. 8(*a*) through 8(*c*) are side views showing a basic construction of stapler.
Figure 8B:
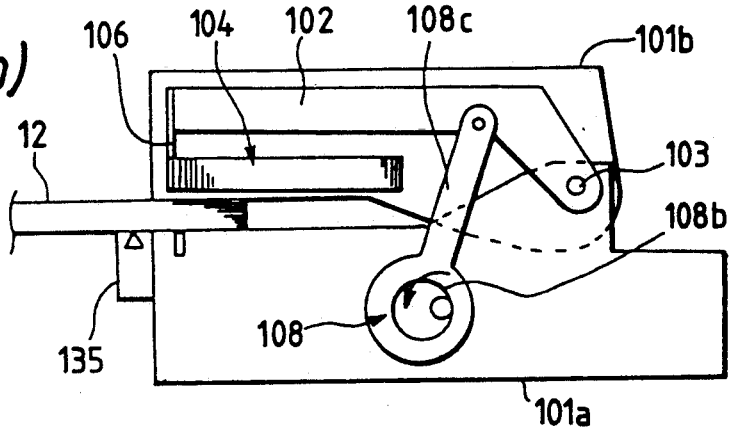
Figure 8C:
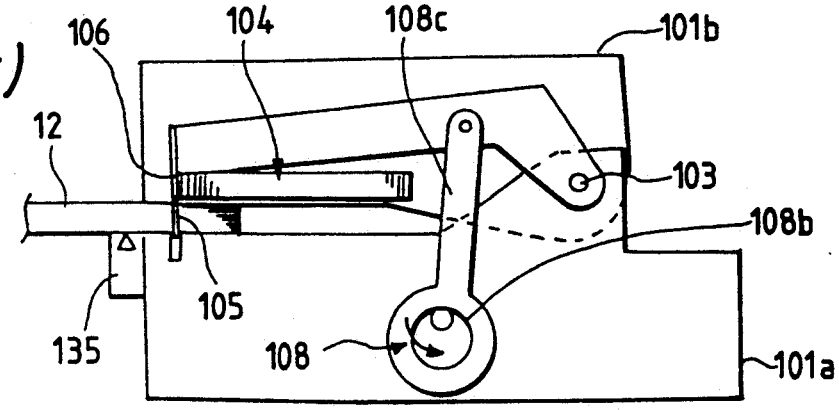

A basic construction of the stapler 100 will be described. As shown in FIG. 8(*a*), the base of a movable arm 102 is pivotally coupled with a lower case 101*a* as a support table by means of a pin 103. The movable arm 102 is provided with an upper case 101*b*, which is coaxial with the arm 102 and is urged toward the movable arm by means of a spring, not shown. A staple containing portion 104 is provided within the upper case 101*b*. A staple drive mechanism 106 for driving a staple 105 through the sheets is provided at the tip of the movable arm 102. A stapler drive motor 107 transfers a drive force to the movable arm 102 through a drive transfer mechanism 108 including a belt 108*a*, a cam 108*b*, and a link arm 108*c*. By the drive force, the movable arm 102 is downwardly swung in a stapling mode. In this case, as shown in FIGS. 8(*b*) and 8(*c*), the stacked recorded sheets 12 are nipped by the lower arm 101*a* and the upper arm 101*b*, and in this state the staple 105 is driven through the stacked recorded sheets 12 by means of the drive mechanism which ascends along with the movable arm 102.

Figure 9:
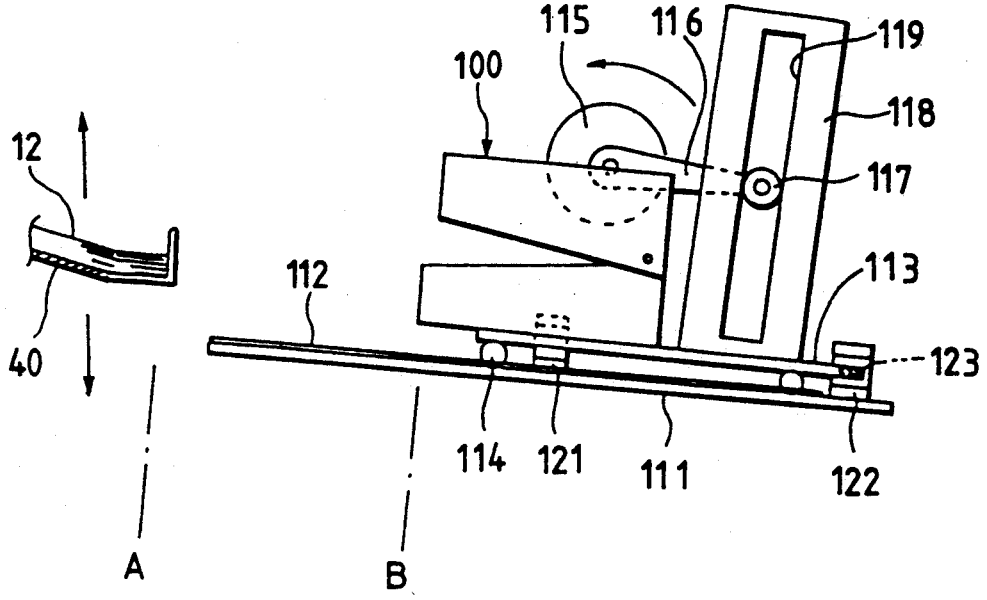
FIGS. 9(*a*) and 9(*b*) are side views showing the construction of a moving mechanism for moving the stapler.
Figure 9:
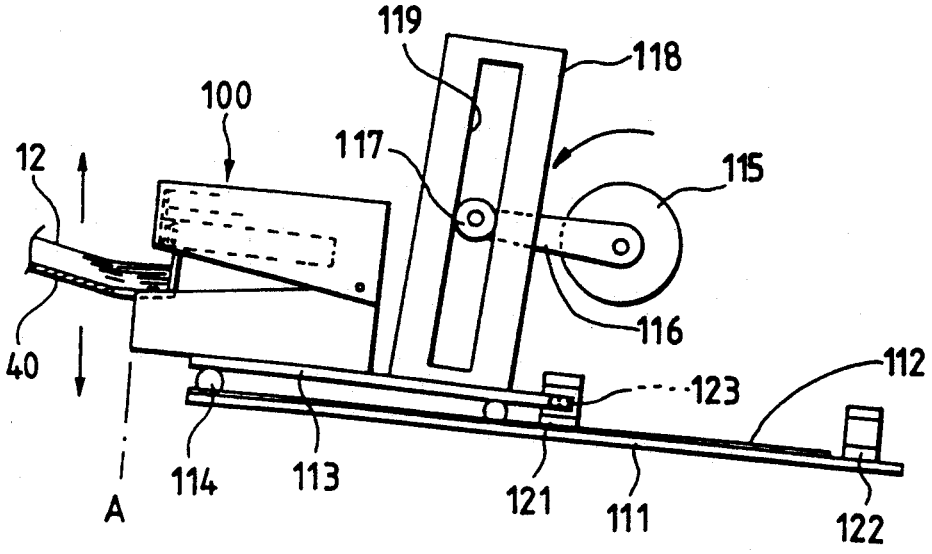

A moving mechanism for retractably moving the stapler 100 will be described. As shown in FIG. 9(*a*), a guide rail 112 extending in the moving direction of the stapler 100 is mounted on a support bracket 111. A plate 113 on which the stapler 100 is installed is movable along the guide rail 112 with the aid of guide rollers 114. A drive motor 115 is disposed on the support bracket. A cam arm 116, extending in the radial direction of the output shaft of the drive motor 115, is fastened to the output shaft. A pin 117 is planted in the rotating free end of the cam arm 116. A plate 118 having a slit 119 which vertically extends is fixed to the plate 113. The pin 117 is inserted into and slidably movable along the slit 119 of the plate 118.

In this embodiment, as shown in FIG. 9(*a*), the stapler 100 is normally located at a waiting position B where it does not obstruct the vertical motion of the bin tray unit 40. When the drive motor 115 rotates by half turn, as shown in FIG. 9(*b*), the pin 117 of the cam arm 116 slides along the slit 119 to push the plate 118 toward the bin tray 40, so that the plate 113 advances to a predetermined position and the stapler 100 is set at a stapling position A.

When the motor 115 rotates by additional half turn, the stapler 100 that has stayed at the stapling position returns to the waiting position B, as shown in FIG. 9(*a*). Subsequently, every time the motor 115 rotates by half turn, the stapler 100 alternately repeats to advance to and retract from the position A.

Position detect sensors 121 and 122, provided on the support bracket 111, detect that the stapler 100 stays at the stapling position A or the waiting position B. Each of the sensors 121 and 122 is an optical sensor of the transmission type in which a light emitting element and a photodetecting element are oppositely disposed. Further, each of the sensors 121 and 122 operates for position detection when a protruded piece 123 of the plate 113 runs across the optical path of the sensor.

In this embodiment, two sheet presence/absence detectors 130 and 135 are used for deciding whether or not the stapling process is required.

The sheet presence/absence detector 130 is constructed such that a light emitting element 131 and a photodetecting element 132 are provided at the top and bottom portions of the concavity 23, which are located above and below the corner cut-out 43 of the bin tray unit 40. If the recorded sheet 12 is present in any of the bin trays 40, the sheet intercepts a light beam of the optical path between the elements 131 and 132. In response to the interception by the sheet, the detector 130 detects the presence of the recorded sheet or sheets 12.

The other detector 135, as shown in FIG. 8, is a sensor of the reflecting type (in which a light emitting element and a photodetecting element are arranged side by side) buried in the leading end of the support table 101. When the recorded sheet 12 is placed on the support table 101, the light beam emitted from the light emitting element is received by the photodetecting element which in turn produces a signal of high level, for example, indicative of the presence of the sheet.

Figure 10:
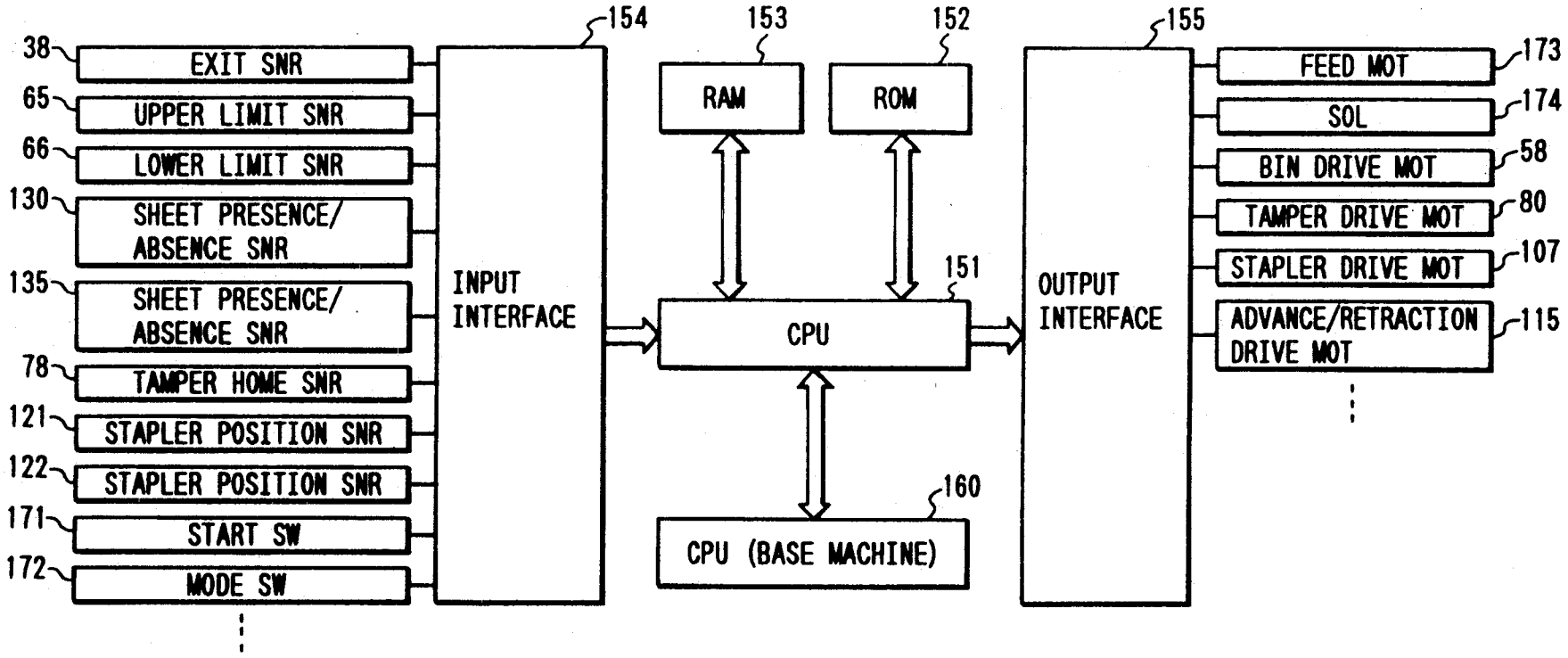
FIG. 10 is a block diagram showing a control system for the sheet distributing system.

A control system of the instant embodiment is constructed with a microcomputer system as shown in FIG. 10.

In the figure, the computer system is made up of a CPU 151, a ROM 152, and a RAM 153. The ROM 152 stores a sorting process program (see FIGS. 11 and 12), a stapling process program (see FIGS. 16 and 17), and the like. The CPU 151 executes those programs, processes input data while transferring data to and from the RAM 153, and prepares necessary control signals.

In the computer system, the signals outputted from various types of sensors, as input data, are inputted through an input interface 154 to the CPU 151. Those sensors are, for example, the sheet exit sensor 38, upper limit sensor 65, lower limit sensor 66, sheet presence/absence detect sensors 130 and 135, tamper home position sensor 78, stapler position detect sensors 121 and 122, start switch 171 for the stapling process, mode select switch 172 for selecting a stapling mode, and the like. The CPU 151 processes the input data and produces control signals through an output interface 155 to various types of control devices, such as a feed motor 173 for driving the respective rollers in the sheet transfer system 30, a solenoid 174 for driving a select gate 39, the bin drive motor 58, the tamper drive motor 80, the stapler drive motor 107, and the stapler advance/retraction drive motor 115. By the control signals, those control devices are properly controlled.

In the instant embodiment, data communication is performed between the CPU 151 and a CPU 160 contained in the base machine 10. Through the data communication, the CPU 151 fetches various types of data, such as document size and the number of copies.

The sorting process by the control system thus configured will be described.

It is assumed now that an instruction is directed to the base machine 10 so that it copies an original document by using the ADF and produces a predetermined number of copies of the original, and those copies are sorted.

Upon receipt of the instruction, the CPU 160 of the base machine transfers a sorting select signal to the CPU 151 which in turn executes the sorting process program. The solenoid 174 is first energized to drive the select gate 39 which then selects the first transfer path 32. The feed motor 173 is also operated to drive the transfer rollers 34 and 35, and the exit rollers 36 and 37. Under this condition, the recorded sheets 12 leaving the exit port 11 are successively transferred to the sheet distribution stage S1 by the route of the common sheet transfer path 31 and the first transfer path 32, and are distributed into the bin trays 40 which successively reach the stage S1.

Next, the control of the movement of the bin trays 40 by the control system will be described.

Figure 11:
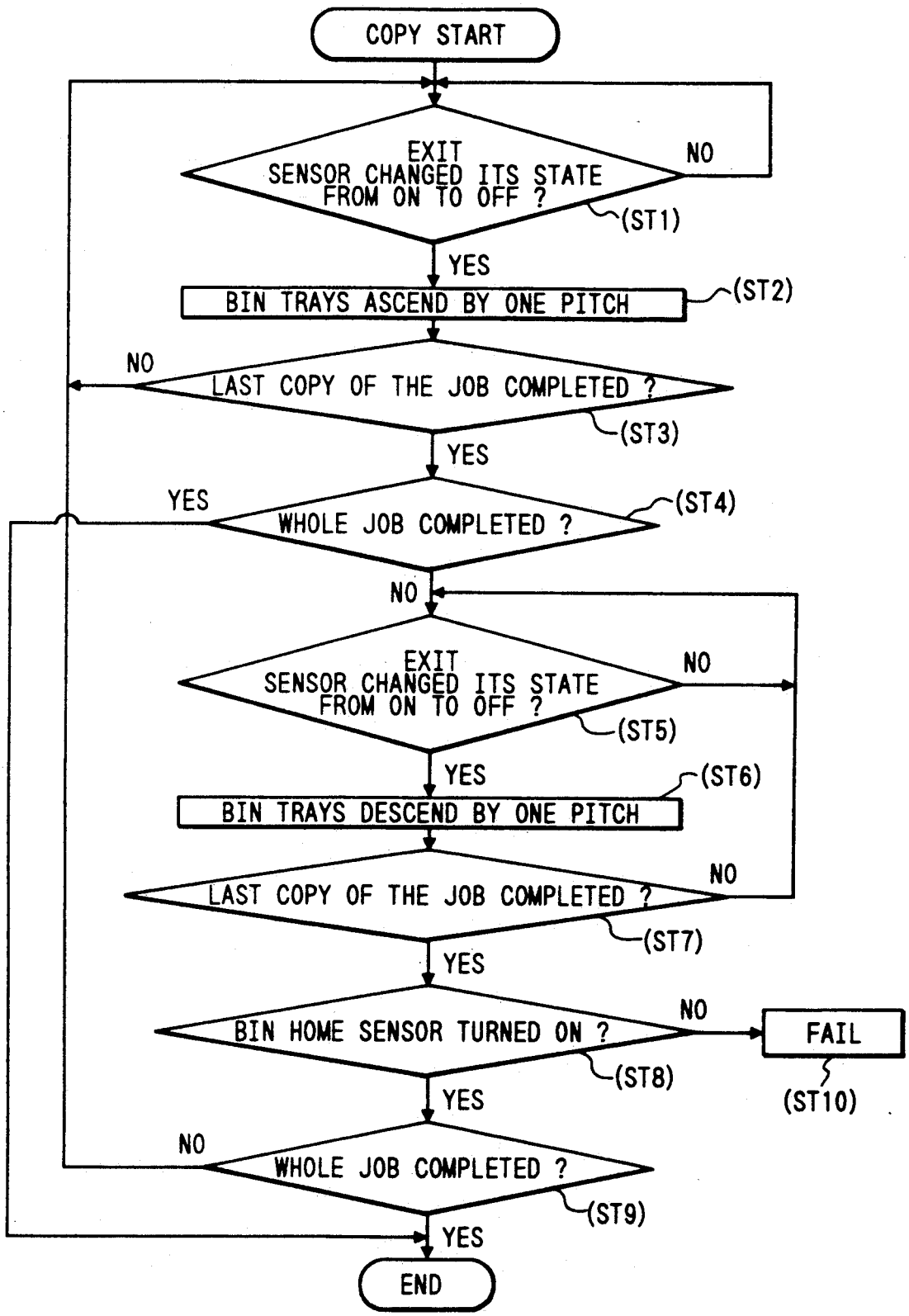
FIG. 11 is a flowchart showing a control flow of the bin tray unit in a sorting mode.

A control flow of the movement of the bin tray 40 in the sorting mode is shown in FIG. 11.

Following the copy start in the base machine 10, the CPU 151 increments the bin drive motor 58 by one step when a state of the exit sensor 38 changes from an ON state to an OFF state. The bin trays 40 ascend by one pitch (ST1 and ST2). Then, the CPU checks whether or not the last copy of the job, viz., a copy job of each page of the original, is completed in execution (ST3).

If the last copy of the job is not yet completed, a sequence of the processing steps ST1 to ST3 is repeated. When the last copy is completed, the CPU checks whether or not the whole job, or the copy jobs of all of the documents is completed (ST4).

If the whole job is not yet completed, the CPU increments the bin drive motor 58 by one step when a state of the exit sensor 38 changes from an ON state to an OFF state. The bin trays 40 descend by one pitch (ST5 and ST6). Then, the CPU checks whether or not the last copy of the job is completed (ST7). If the last copy of the job is not yet completed, a sequence of the processing steps ST5 to ST7 is repeated. When the last copy is completed, the CPU checks whether or not a bin home sensor (corresponding to the lower limit detect sensor 66) is turned on or not (ST8), and checks whether or not the whole job is completed (ST9). In step ST9, if the CPU judges that the whole job is not yet completed, the CPU returns to step ST1 and executes a sequence of the subsequent processing steps.

In the process of executing the processing steps, when the CPU decides in step ST4 or ST9 that the execution of the whole job is completed, it terminates the sequence of sorting processes.

In step ST8, if the CPU decides that the lower limit detect sensor 66 is not turned on, it presents a display of FAIL (ST10).

Next, the tamper movement control by the control system will be described.

Figure 12:
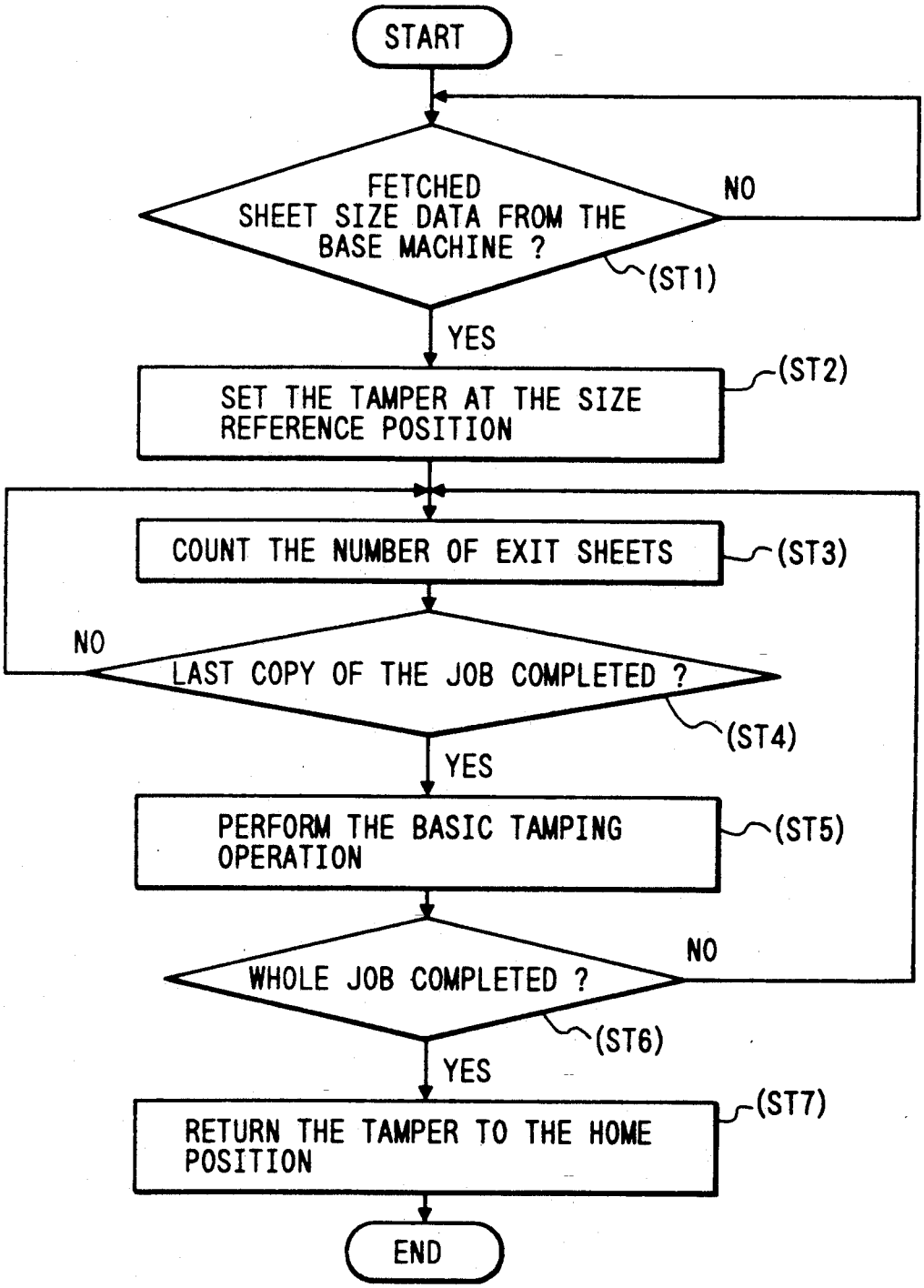
FIG. 12 is a flowchart showing a control flow of the sheet arranging mechanism in a sorting mode.

A control flow of the movement of the tamper 71 is shown in FIG. 12.

Figure 14:
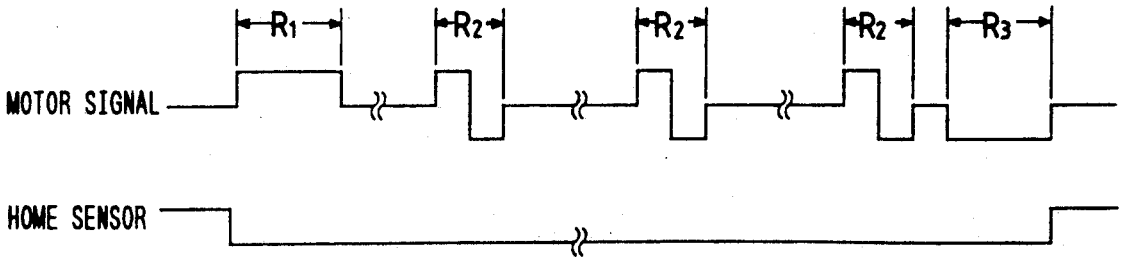
FIG. 14 is a timing chart showing the operation of the sheet arranging mechanism in terms of electrical signals.

The CPU 151 fetches the size data of the recorded sheet 12 from the CPU 160 of the base machine 10 (ST1), and forwardly drives the tamper drive motor 80 according to a motor signal (R1 region) shown in FIG. 14, thereby to move the tamper 71 that has stayed at the home position as indicated by a solid line to a size reference position (slightly wider than the recorded sheet 12) as indicated by a one-dot chain line (ST2).

Afterwards, the number of the exit sheets is counted by counting the on-signals of the sheet exit sensor 38 (ST3). Then, the CPU checks whether or not the last copy of the job, viz., a copy job of each page of the original, is completed (ST4). If the last copy of the job is not yet completed, a sequence of the processing steps ST3 to ST4 is repeated.

In step ST4, if the CPU decides that the last copy of the job has been completed, the same forwardly or backwardly rotates the tamper drive motor 80 according to the motor signal (R2 region) shown in FIG. 14. Then, the tamper 71 that has stayed at the size reference position as indicated by a solid line is moved to the edge position (as indicated by a dotted line) of the recorded sheet 12, to push the recorded sheets 12 against the positioning wall 48 to arrange them. Following this, the tamper 71 is returned to the size reference position (ST5).

Thereafter, the CPU checks whether or not the whole job is completed (ST6). If the whole job is not yet completed, the CPU repeats the sequence of steps ST3 to ST6.

Figure 13A:
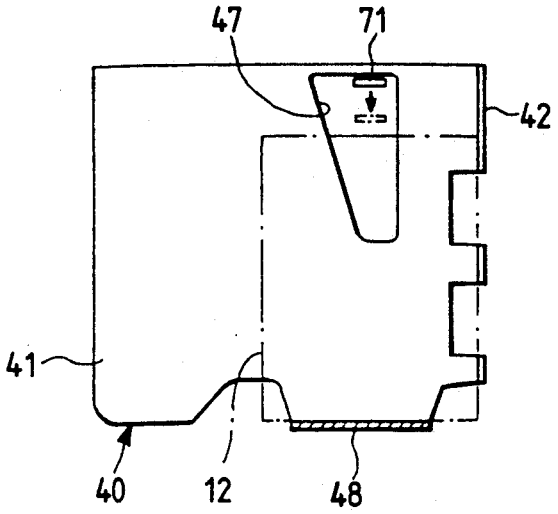
FIGS. 13(*a*) and 13(*b*) are plan views showing the operation of the sheet arranging mechanism.
Figure 13B:
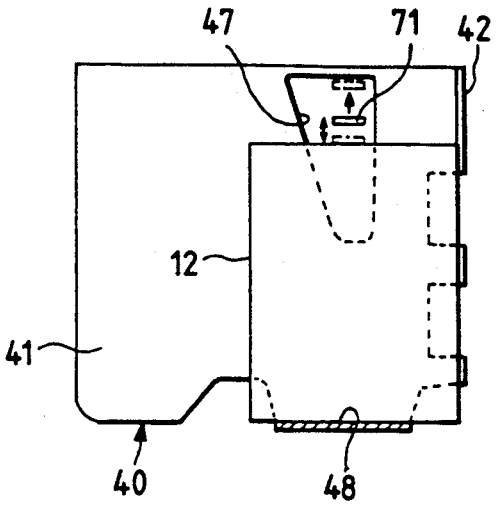

In step ST6, if the CPU decides that the whole copy job has been completed, the tamper drive motor 80 is reversely rotated according to the motor signal (R3 region) shown in FIG. 14, so that the tamper 71, as shown in FIG. 13(*b*), is moved to the home position as indicated by a dot chain line (ST7), and the tamper operation in the sorting mode is completed. The decision whether or not the tamper is returned to the home position is made on the basis of the low-to-high level change of the output signal of the tamper home sensor 78.

Next, the sorting process will be described using a specific example.

It is assumed that the base machine copies the k number of original documents using the ADF, and produces n number of copies for each original, and those copies are sorted.

Figure 15:
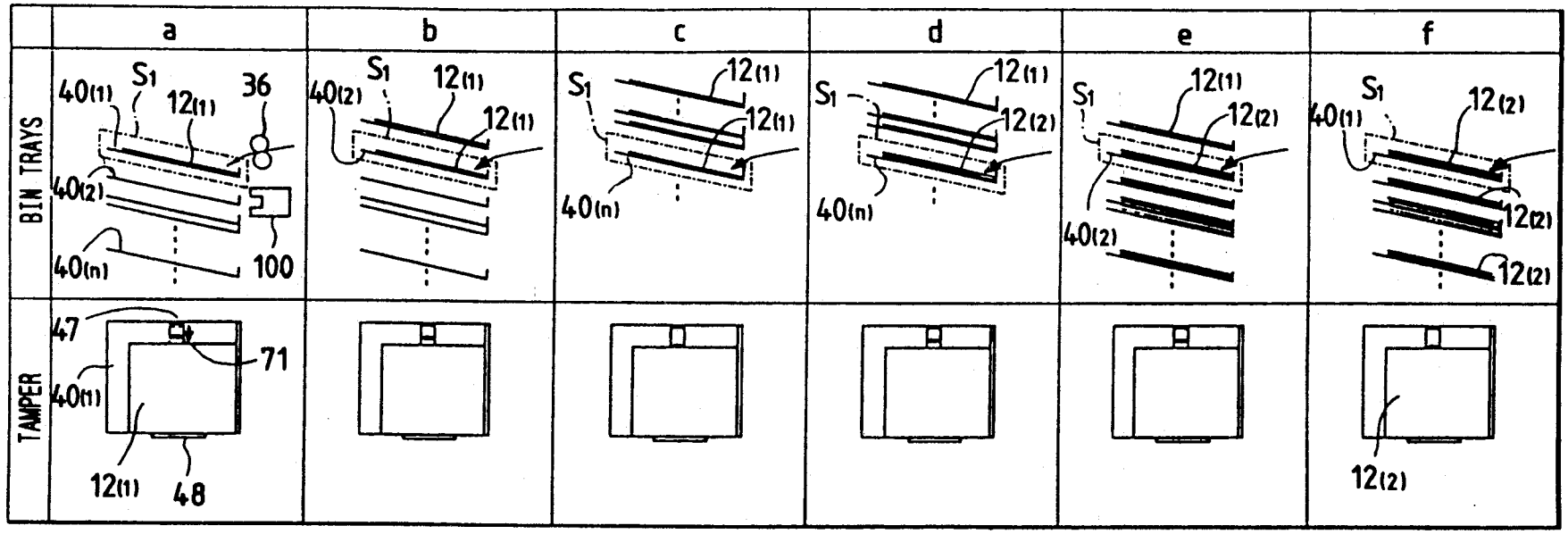
FIG. 15 shows a set of views useful in explaining the operations of the bin tray unit and the sheet arranging mechanism in a sorting mode.

As shown in FIG. 15(*a*), a recorded sheet 12(1) of the first original copy is first put into the top or first bin tray 40(1) positioned at the sheet distribution stage S1. Then, as shown in FIGS. 15(*b*) and 15(*c*), the second bin tray 40(2) is set at the sheet distribution stage S1, and another recorded sheet 12(1) is put into the bin tray 40(2). Subsequently, other recorded sheets 12(1) are distributed into the third to n-th bin trays 40(3) to 40(*n*) in similar ways.

Next, the copying operation of the second original document starts, and recorded sheets 12(2) of the second original copy are successively fed to the sheet distribution stage S1. As shown in FIG. 15(*d*), the recorded sheet 12(2) is first put into the n-th bin tray 40(*n*) positioned at the sheet distribution stage S1. Then, as shown in FIGS. 15(*e*) and 15(f), The n−1th bin tray 40(n−1) is set at the sheet distribution stage S1 and another recorded sheet 12(2) is delivered into the bin tray 40(2). Subsequently, other recorded sheets 12(2) are distributed into the n−2th to first bin trays 40(n−2) to 40(1) in similar ways.

The above sequence of operations is repeated till the k-th original will be copied.

In the series of copy jobs as mentioned above, as shown in FIGS. 15(*a*) to 15(*f*), the tamper 71 is set at the size reference position at the copy start. Every time the execution of the original copy job is completed, in order from the first sheet, the tamper 71 is moved up to the edge position of the recorded sheets 12 to arrange them. Next, a basic stapling control by the control system will be described.

Figure 16:
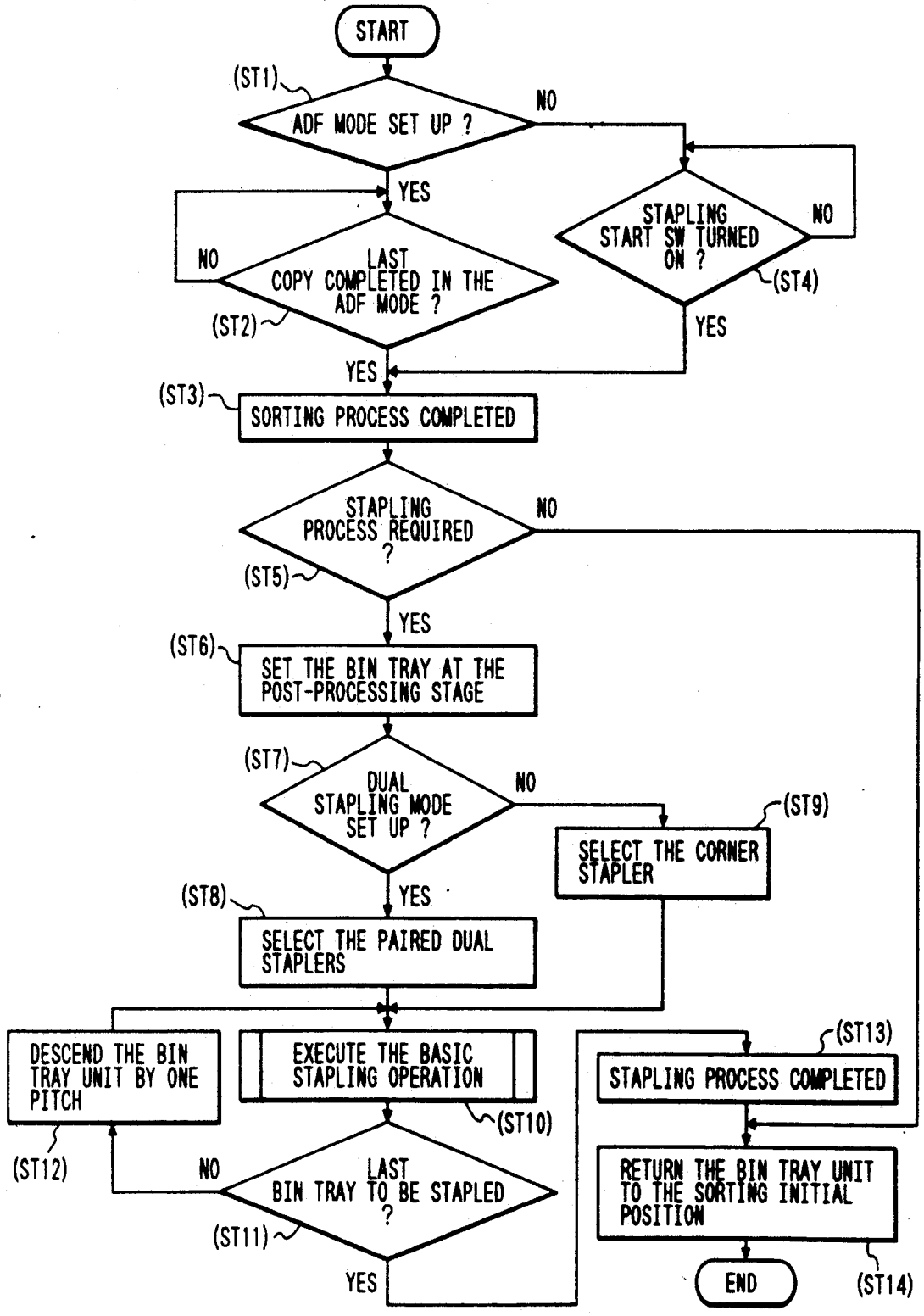
FIG. 16 is a flowchart showing a control flow for the bin trays and the stapler in a stapling mode.

A basic control flow for the bin trays 40 and the stapler 100 in the stapling mode is shown in FIG. 16.

In the control, the CPU 151 first checks whether or not the ADF mode is set up, on the basis of the data that is transferred from the CPU 160 of the base machine (ST1). If the ADF mode is set up in the base machine, the CPU checks if the last document copy by the ADF is completed (ST2). At the completion of the last document copy by the ADF, the CPU decides that the sorting processing is perfectly completed (ST3). When the base machine 10 is not in the ADF mode, the CPU checks whether or not the manual start switch 171 has been turned on at the start of the stapling process (ST4). If the start switch 171 is turned on, the CPU judges that the sorting process is perfectly completed (ST3).

Thereafter, the CPU checks whether or not the stapling process is required according to the output signal of the first sheet presence/absence detector 130 (ST5). If it is required, the bin tray unit 40 is made to descend by one pitch, thereby to set the bin tray unit 40 at the stapling initial position so that the top or first bin tray 40 or the bin tray 40 ordered corresponding to the number of sorting operations is positioned at the post-processing stage S2 (ST6).

Afterwards, the CPU checks if the stapling mode is the dual mode (ST7) on the basis of information from the mode select switch 172 set to the stapling mode. If the dual mode is set up, the paired dual staplers 100*a* and 100*b* are selected (ST8). If the dual mode is not set up, the CPU judges that the corner mode is set up, and selects the corner stapler 100*c* (ST9). And it executes the basic stapling operation (ST10).

After this, the CPU checks if the present stapling processed object is the last bin tray (ST11). If it is not the last bin tray, the CPU makes the bin tray unit 40 ascend or descend by one pitch and sets the bin tray to be stapling-processed next at the post-processing stage S2 (ST12). Subsequently, the sequence of steps ST10 to ST12 is repeated until the stapling-processed object is the last bin tray.

When the stapling process for the last bin tray is completed, the CPU judges that the stapling process has been completed (ST13).

If, in step ST5, the stapling process is not required (the output signal of the photodetecting element 132 of the sheet presence/absence detector 130 is in low level), or if in step ST13, the stapling process has been completed, the CPU returns the bin tray unit 40 to the sorting initial position so that the top bin tray 40 is set at the sheet distribution stage S1 in preparation for the next sorting process (ST14), and ends a series of the processes.

Figure 17A:
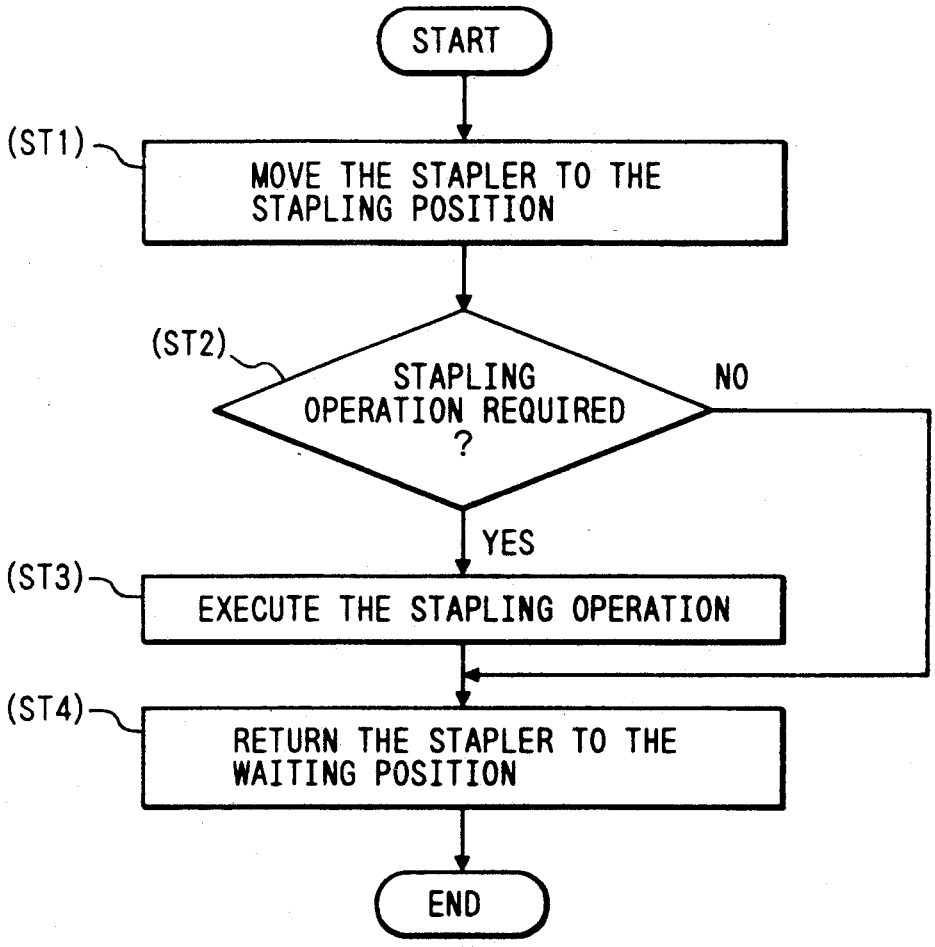
FIGS. 17(*a*) and 17(*b*) are flowcharts showing control flows of the stapler and the tamper in a stapling mode.
Figure 17B:
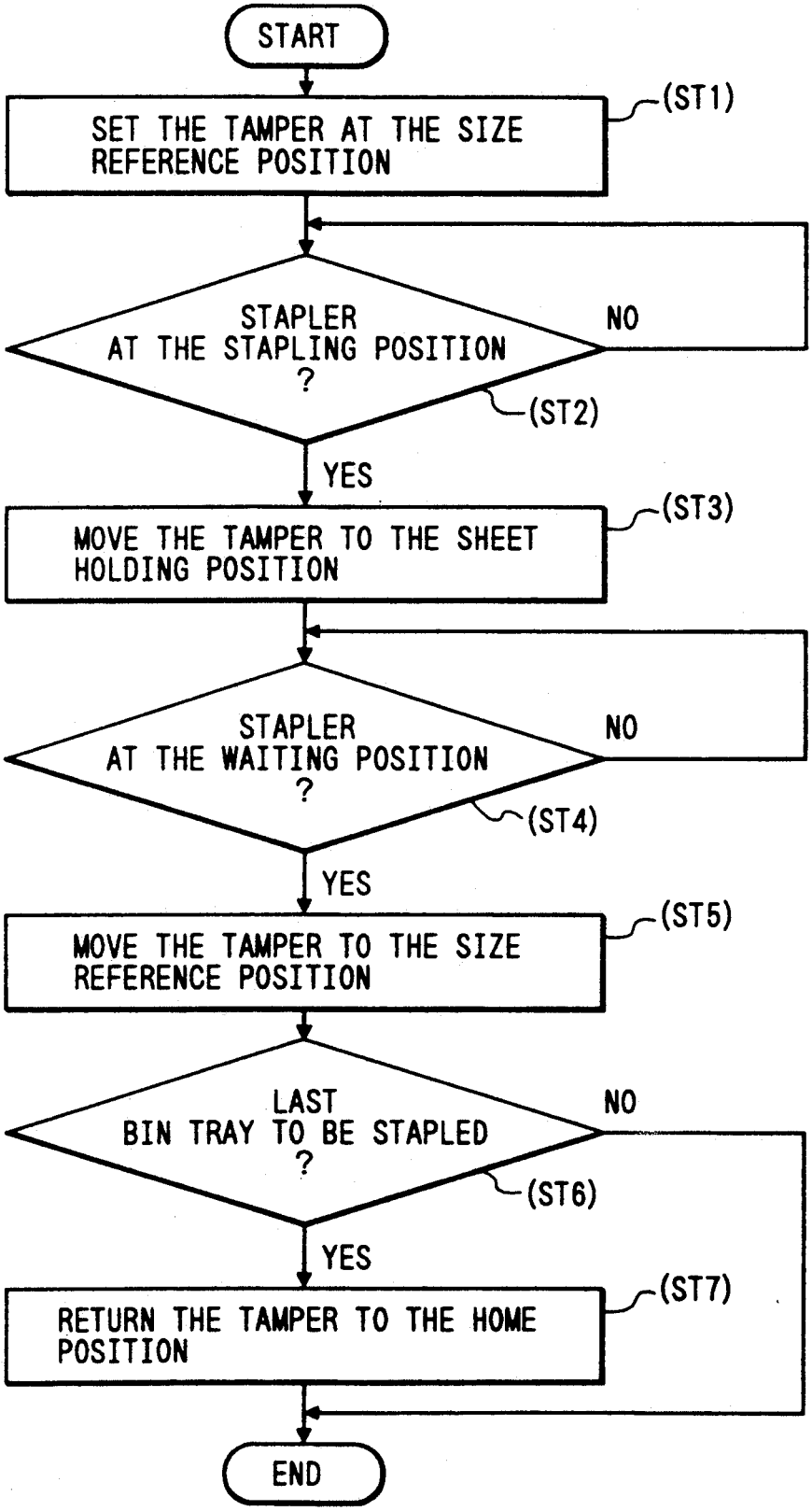

Basic stapling operation flows in such process are shown in FIGS. 17(*a*) and 17(*b*).

FIG. 17(*a*) shows an operation flow of the stapler 100.

The CPU 151 moves the stapler 100 to the stapling position A (see FIG. 9(*b*)), more exactly one of the dual staplers 100*a* and 100*b* and the corner stapler 100*c* as selected by a mode select switch (ST1), and checks whether or not the stapling operation is required or not, on the basis of the data from the sheet presence/absence detector 130 (ST2).

When the stapling operation is required, the CPU executes the stapling operation (ST3) and returns the stapler 100 to the waiting position B (see FIG. 9(*a*)) (ST4) When it is not required, it immediately returns the stapler 100 to the waiting position B (ST4), and ends the basic operation of the stapler 100.

FIG. 17(*b*) shows an operation flow of the tamper 71.

The CPU 151 first moves the tamper 71 to the size reference position (see FIG. 13(*a*)) (ST1), and checks if the stapler 100 is at the stapling position A, on the basis of the data from the position detect sensor 121 (ST2). If the answer is YES, the CPU moves the tamper 71 to the sheet holding position, as shown in FIG. 13(*b*) (ST3).

Then, the CPU checks if the stapler 100 is at the waiting position B (ST4), on the basis of the data from the waiting position B. If the answer is YES, the CPU moves the tamper 71, which has stayed at the sheet holding position, to the size reference position (ST5)

Before the last bin tray 40 is stapling processed, the CPU ends the basic stapling operation while the tamper 71 is set at the size reference position. When judging that the last bin tray 40 is stapling processed (ST6), the CPU returns the tamper 71 to the home position (ST7), and ends the basic stapling operation.

Next, a specific example of the stapling process will be described.

It is assumed that base machine copies the k number of original documents using the ADF, and produces n number of copies for each original, and those copies are stapled.

Figure 18:
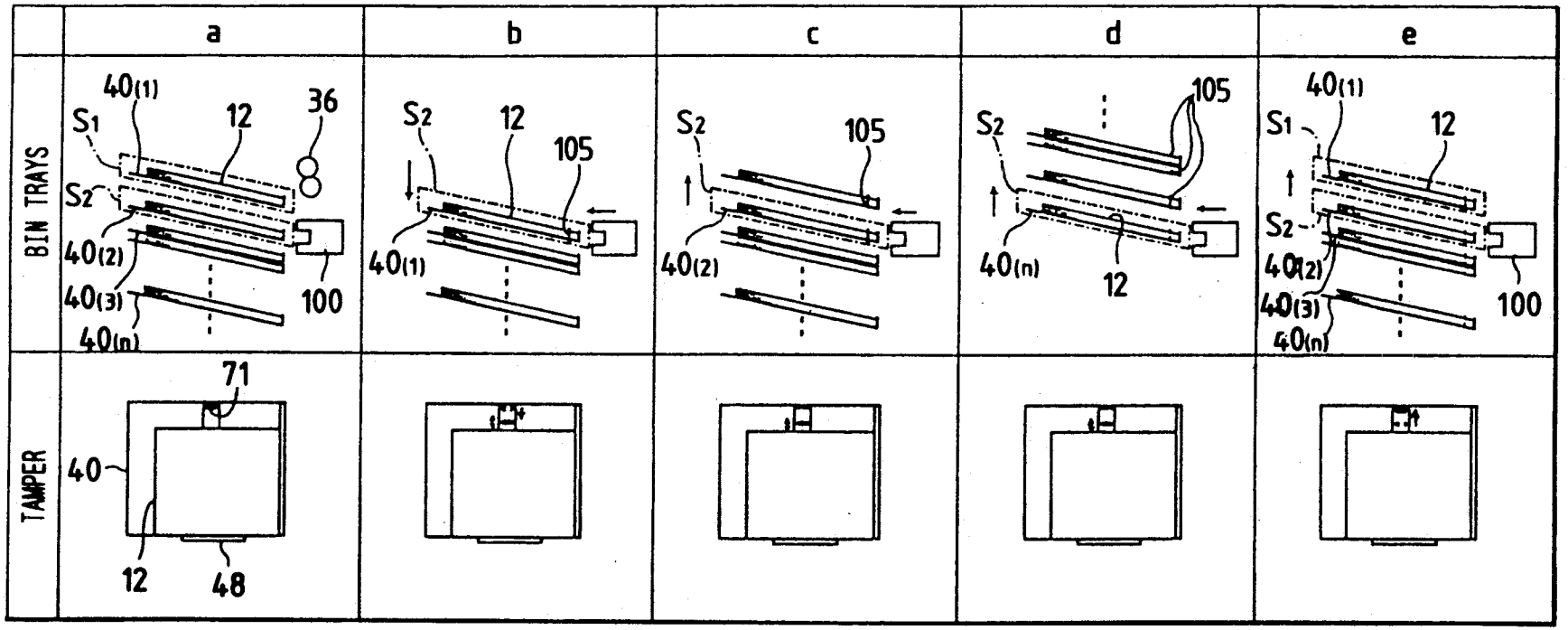
FIG. 18 shows a set of views useful in explaining the operations of the bin tray unit and the stapler in a stapling mode.

If the k number of the original documents is an even number, the bin tray unit 40 is disposed at the sorting initial position where the top bin tray 40(1) is set at the sheet distribution stage S1, as shown in FIG. 18(*a*), at the end of the sorting process.

Under this condition, as shown in FIG. 18(*b*), the bin trays 40 descend by one pitch, so that the top bin tray 40(1) is set at the post-processing stage S2 and the tamper 71 of the sheet arranging mechanism 70 is moved from the home position as indicated by a dotted line to the sheet size reference position. At the reference position, the dual staplers 100*a* and 100*b* that are selected by the mode select switch 172 drive staples 105 through one side marginal portion of the stack of the recorded sheets 12 stored in the top or first bin tray 40(1) at two different positions. During this stapling operation, the tamper 71 firmly holds the stacked recorded sheets 12 so as not to disarrange the arranged recorded sheets 12.

Subsequently, as shown in FIGS. 18(*c*) and 18(*d*), the respective bin trays 40 ascend by one pitch, the second bin tray 40 and the subsequent ones 40(2) to 40(*n*) are successively set at the post-processing stage S2. The dual staplers 100*a* and 100*b* successively drives staples 105 through the one side marginal portions of the stacked recorded sheets 12 stored in the bin trays 40(2) to 40(*n*). When a stack of recorded sheets stored in the last bin tray 40 is stapled, a series of stapling process operations ends. As shown in FIG. 18(*e*), the bin tray unit 40 returns to the sorting initial position and the tamper 71 also returns to the home position.

In a case where the k number of the original documents is an odd number, the n-th bin tray 40(*n*) is positioned at the sheet distribution stage S1 upon completion of the sorting process. In this case, the stapling process is performed in the following. The bin tray unit 40 is first made to descend by one pitch to set the n-th bin tray 40 at the post-processing stage S2. A stack of recorded sheets contained in the bin tray 40 is stapled. Subsequently, the bin tray unit 40 is made to descend by one pitch to successively set the bin trays 40(n−1) to 40(1) at the post-processing stage S2, and stacks of the recorded sheets contained in those bin trays are successively stapled.

Next, some modifications of the sorter according to the present invention will be described.

Figure 19:
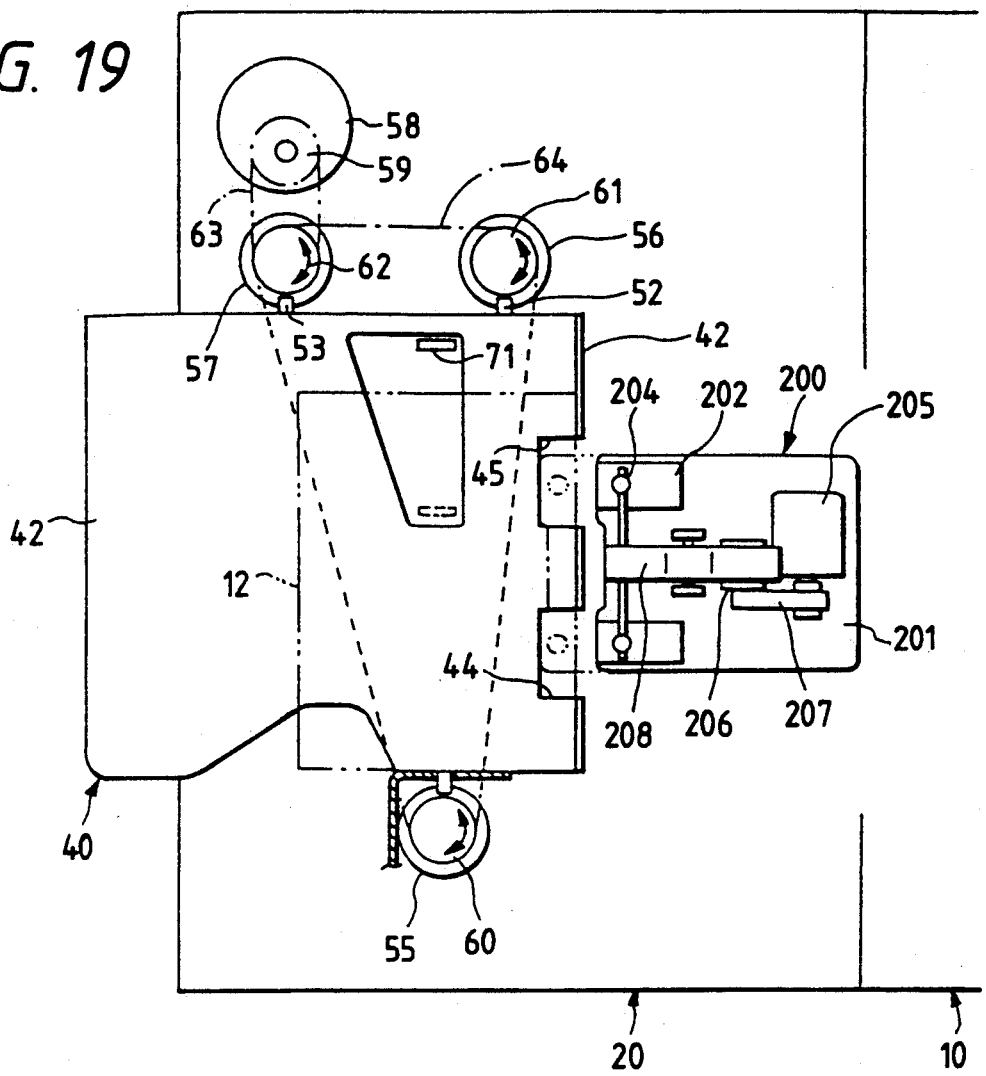
FIG. 19 is a view showing an essential portion of the sheet distributing system as viewed in the direction of the arrow IV in FIG. 2, in which a bin tray and a dual puncher as a post-processing unit are clearly illustrated.
Figure 20:
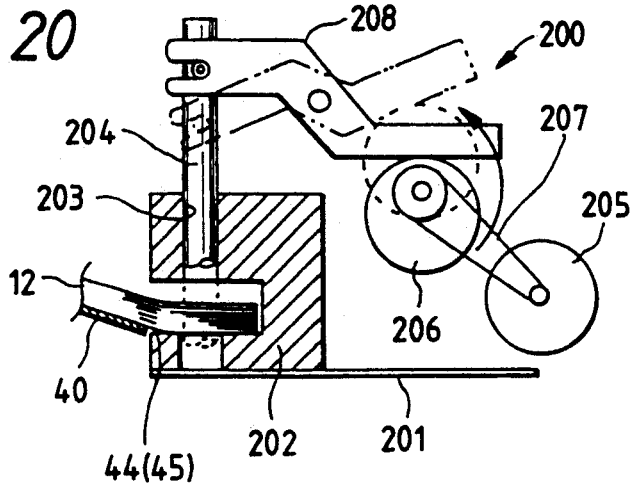
FIG. 20 is a side view showing the structure of the dual puncher.

FIGS. 19 and 20 show the structure of a dual puncher to punch an object, e.g., the stacked recorded sheets, at two positions.

In the figures, a puncher 200 is mounted on a movable plate 201, which advances to and retracts from a support bracket, not shown. In a non-punching mode, the puncher 200 is located at a waiting position as indicated by a solid line in FIG. 19, and in a punching mode, it advances to a punching position as indicated by a two-dot chain line and punches one side marginal portion of the stacked recorded sheets 12.

The puncher 200 includes a pair of sheet tables 202, U shaped in cross section, having through-holes 203 vertically passing therethrough. A pair of punching rods 204 are vertically movably disposed in the through-holes 203.

A drive system of the punching rods 204 is assembled on the movable plate 201. The drive system is made up of a puncher drive motor 205, an eccentric cam 206, a drive force transmission mechanism 207 including a belt for transferring a drive force from the puncher drive motor 205 to the eccentric cam 206, pulleys, and the like, and a swing arm 208, coupled at one end with the punching rods 204, for moving up and down the punching rods 204 according to an engaging state of it with the cam 206.

In the modification of the sorter, cut-outs 44 and 45 are formed in one side portion of the bin tray 40 at the locations corresponding to the paired punching rods 204. The formation of the cut-outs 44 and 45 allows the puncher 200 to smoothly operate for punching.

Figure 21:
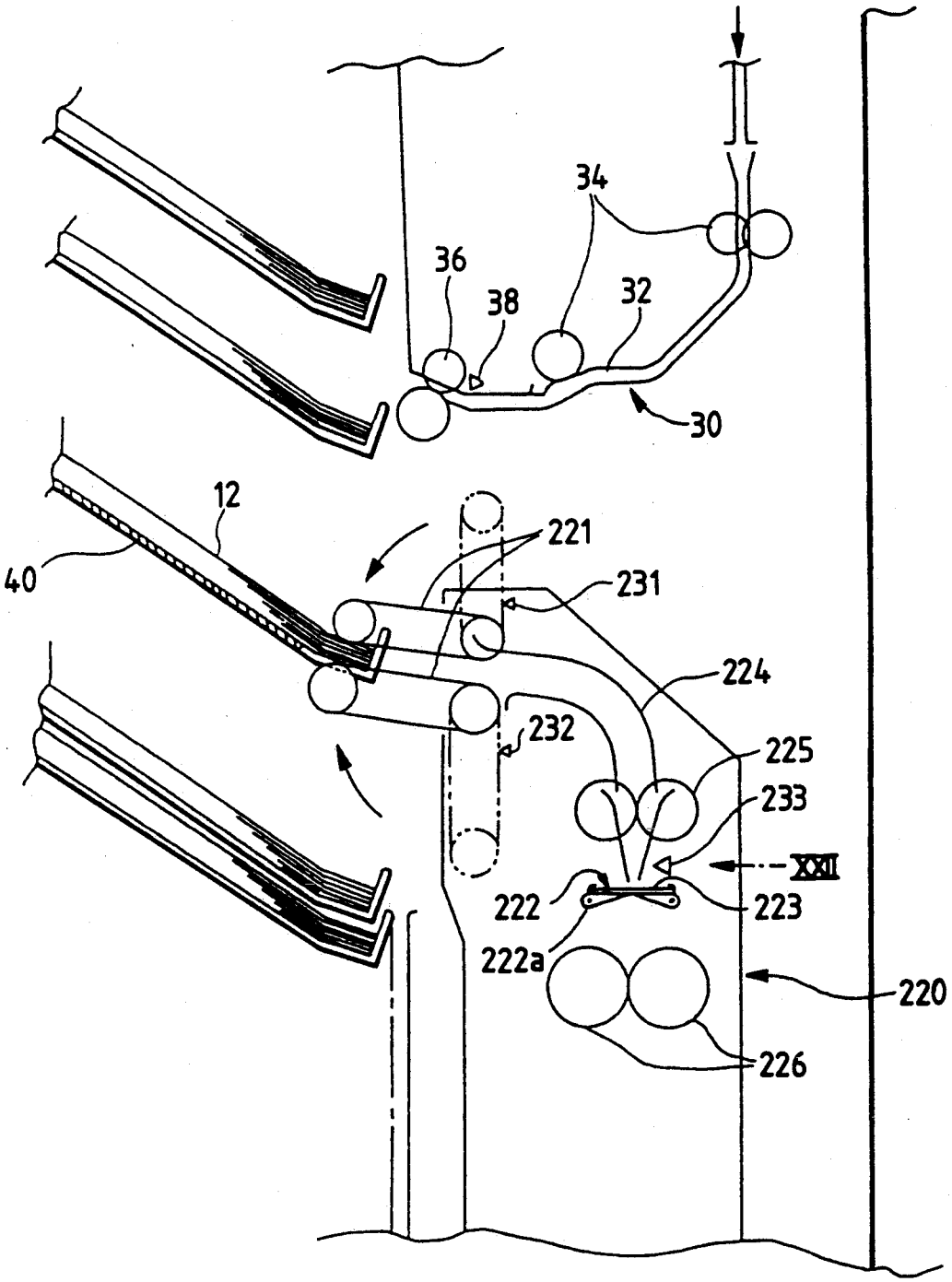
FIG. 21 is a side view showing a partial structure of the sheet distributing system when the post-processing unit is a binder.
Figure 22:
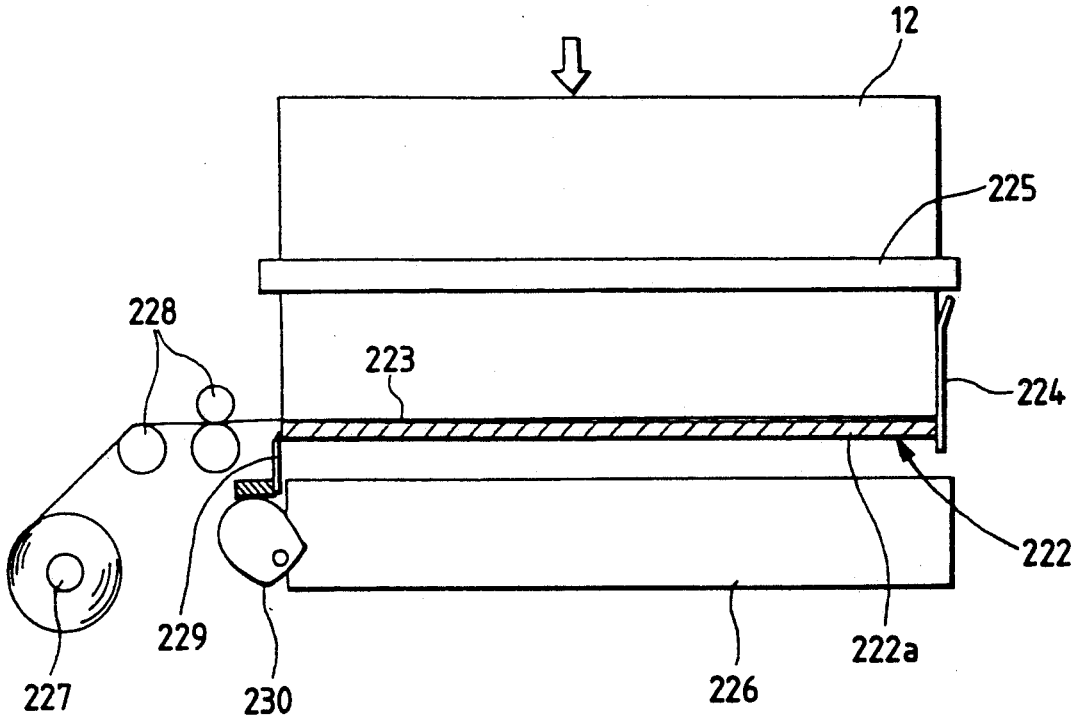
FIG. 22 is a side view of the structure as viewed in the direction of an arrow XXII in FIG. 21.

FIGS. 21 and 22 show the structure of a binder for binding one side marginal portion of the stacked recorded sheets with tape. As shown, the binder 220 is made up of a pair of belt grippers 221, a tape table 222, a guide plate 224, a pair of feed rollers 225, a pair of sticking rollers 226, a tape supply roll 227, tape feed rollers 228, a cutter 229, and a cutter drive mechanism 230. The belt grippers 221 are erect in a normal state. In a binding mode, it is laid down, nips one side marginal portion of the stacked recorded sheets 12 at two positions, pulls the sheet stack out of the bin tray, and transfers it to a necessary position. The tape table 222 is provided with a gate 222*a* to open and close. Normally, it is closed to set a tape 223. The guide plate 224 defines a sheet transfer path between the belt grippers 221 and the guide plate 224. The feed rollers 225 are disposed midway along the sheet transfer path. The sticking roller pair 226, disposed below the tape table 222, sticks on one side marginal portion of the stacked recorded sheets 12 the tape 223 set when the gate 222*a* is opened. The tape supply roll 227 continuously supplies the tape 223. The tape feed rollers 228 feed the tape 223 that is supplied from the tape supply roll 227, to the tape table 222. The cutter 229 cuts the supplied tape 223 into a tape of a predetermined size. The cutter drive mechanism 230 includes an eccentric cam for adjusting the cutting timing by the cutter 229, and the like.

Reference numerals 231 and 232 designate gripper sensors for detecting a state, upstanding or laid down, of the belt grippers 221. Numeral 233 represents a gate drive sensor for detecting that the leading edge of the stacked recorded sheets 12 reaches the tape table 222.

Cut-outs 43 and 44, like those in the embodiment, are formed in the side portion of the positioning flange 42 of the bin tray 40 at the locations corresponding to the belt grippers 221. With provision of the cut-outs 43 and 44, it will not be obstructed by the belt grippers 221 when they are laid down.

A binding process of the binder as a modification of the embodiment will be given below.

Figure 23A:
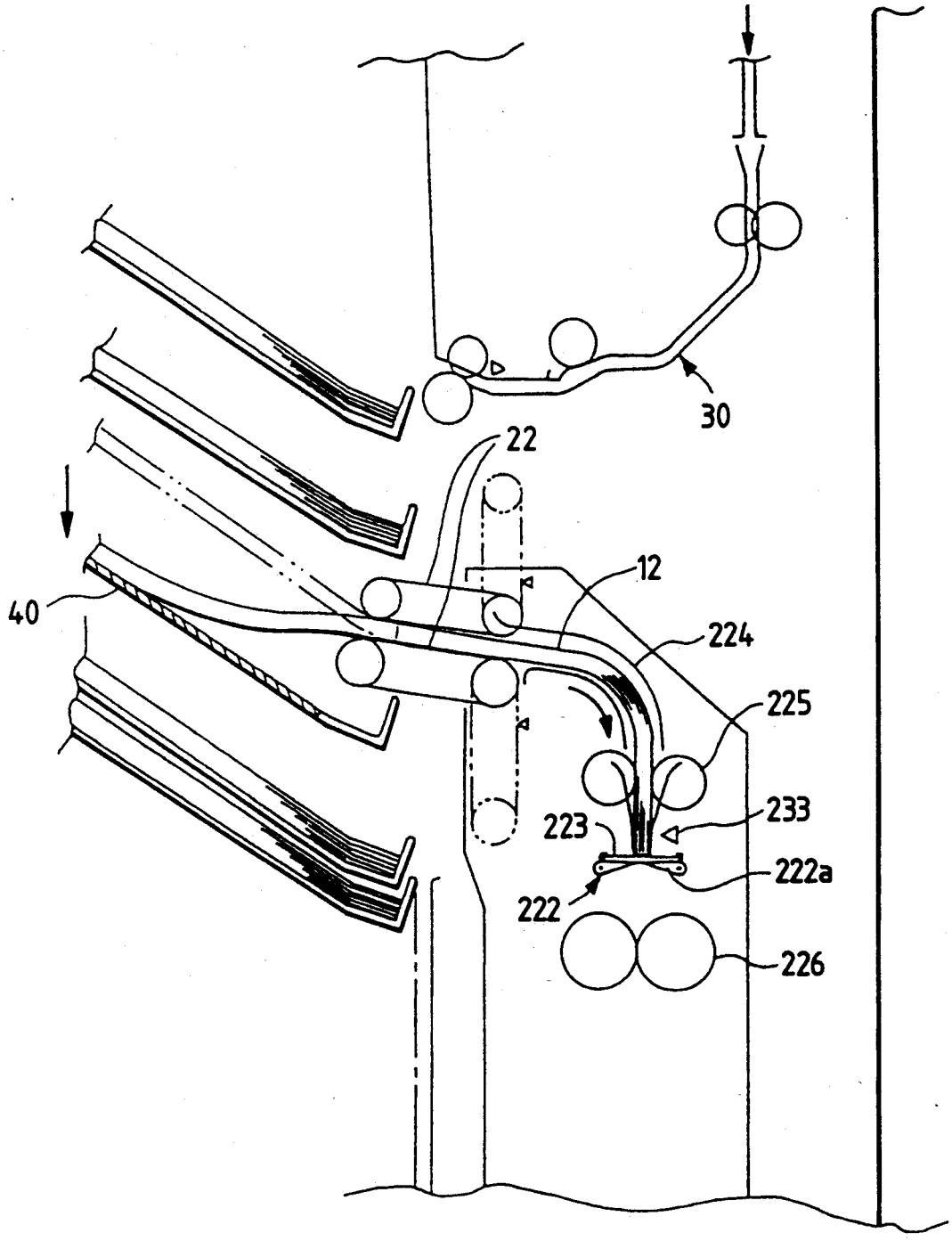
FIGS. 23(*a*) through 23(*c*) are a set of views useful in explaining the operation of the binder.
Figure 23B:
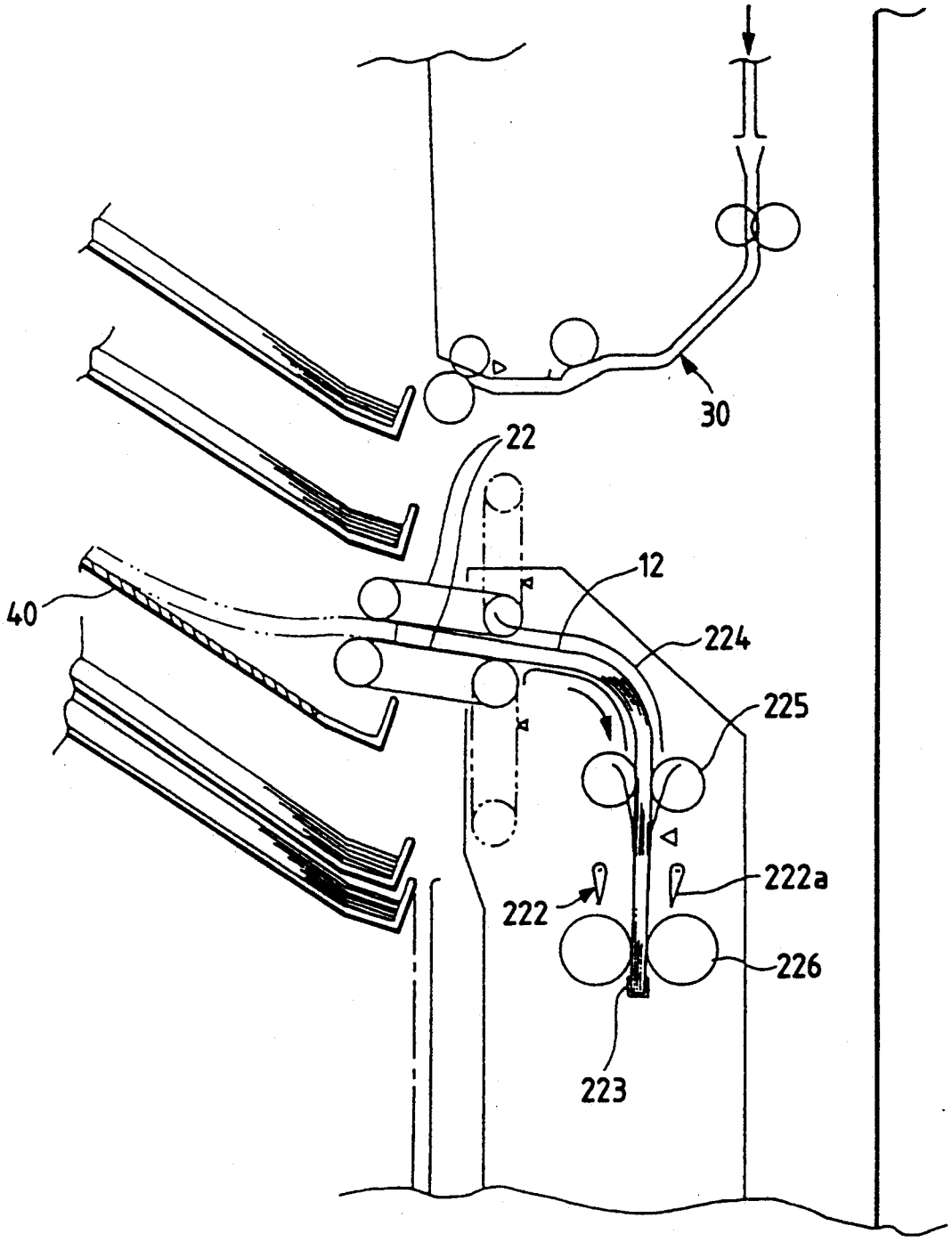
Figure 23C:
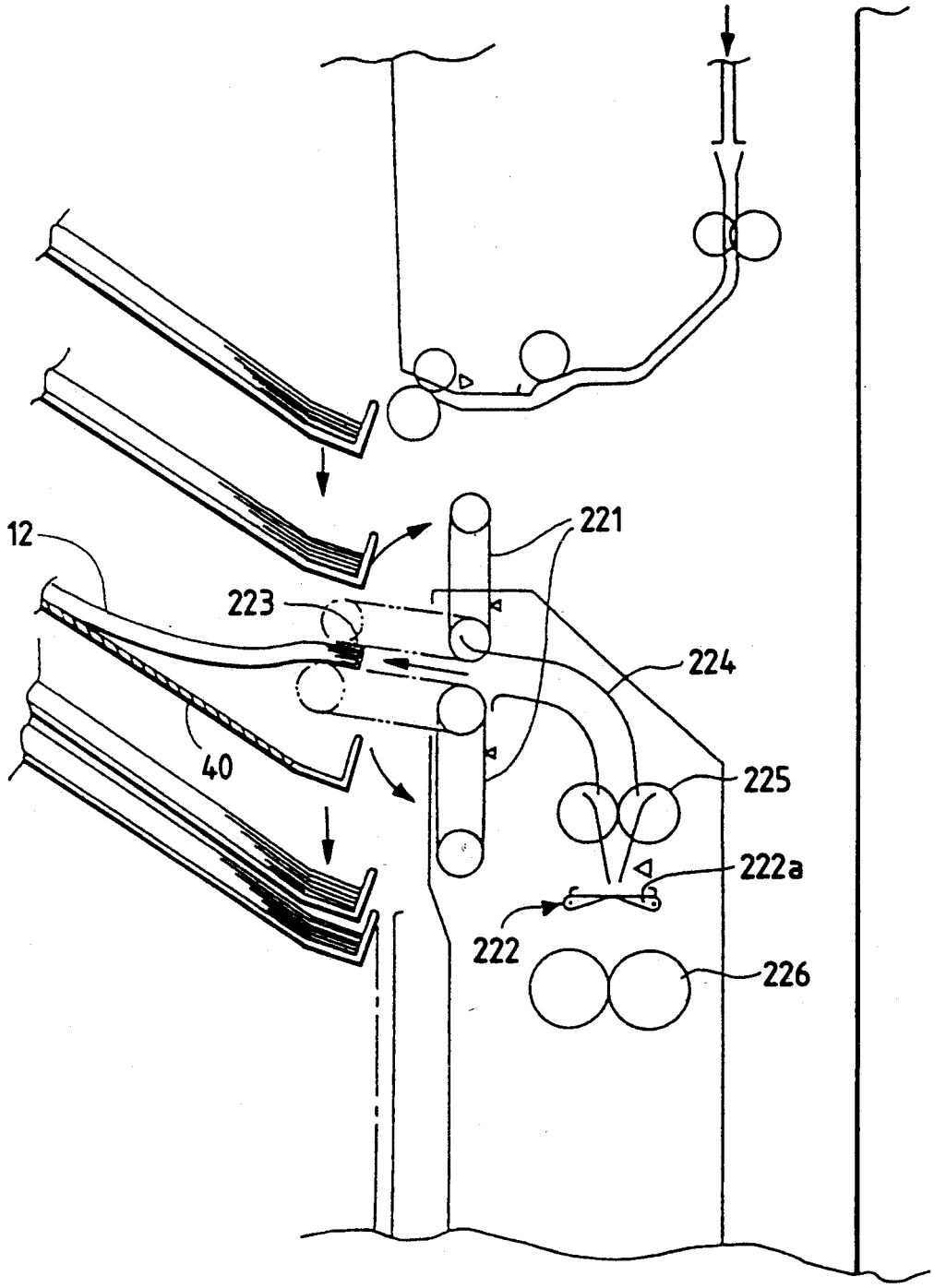

As shown in FIG. 23(*a*), the CPU 151 first lays down the upstanding belt grippers 221, and causes the belt grippers 221 to nip the portions of the stacked recorded sheets 12, where positionally correspond to the cut-outs 43 and 44 of the bin tray 40. At this time, the CPU makes the bin tray unit 40 descend by ½ pitch, and pulls the stacked recorded sheets 12 out of the bin tray 40 by means of the belt grippers 221, and presses the stacked recorded sheets 12 against the tape table 222 by means of the feed rollers 225.

At this time, a tape 223 that had been cut to have a predetermined size, has been set on the tape table 222, and the end face of the stacked recorded sheets 12 has been pressed against the surface of the tape 223 on the tape table 222.

Under this condition, as shown in FIG. 23(*b*), the gate 222*a* of the tape table 222 is opened in response to information delivered from the gate drive sensor 233. The recorded sheets 12 of which the end face has the tape 223 stack thereto is moved to the sticking roller pair 226. When it passes between the paired sticking rollers 226, the tape 223 sticks to around the end portion of the stacked recorded sheets 12.

Thereafter, as shown in FIG. 23(*c*), the feed rollers 225 and the belt holder 221 are reversely rotated to return the stacked recorded sheets 12 being bound with the tape to the original bin tray 40 to be tape binding processed. The bin tray 40 is made to descend by ½ pitch, to complete the binding operation.

Subsequently, the bin trays 40 are successively moved to the post-processing stage S2, and similar binding operations are successively applied to the stacked recorded sheets 12 contained in the bin trays 40, thereby to complete a series of binding operations for the binding process.

As described above, according to the present invention, the post-processing unit, such as a stapler, puncher, or binder, is disposed in the location of the sheet distributing system, which is in opposition to one side marginal portion of the stack of recorded sheets 12 after it is sorted. With provision of such a post-processing unit, a desired post-process, such as stapling, punching, binding, or the like, may be applied to one side marginal portion of the stacked recorded sheets 12. In this respect, the post-processing capability of the sheet distributing system of the invention is remarkably improved over the conventional one. Of which the post-process is only for the corner portion of the sheet stack.

It is further noted that the post-process is performed while the sorted recorded sheets 12 sorting processed are contained in the bin tray. The feature eliminates the necessity of using an additional tray exclusively used for the post-process and any transfer means for transferring the recorded sheets to the post-processing tray, and hence prevents the sheet distributing system from being made complicated in construction. As a matter of course, the distributing system is free from the disarranging of the arranged stacked recorded sheets, which inevitably occurs when the stacked recorded sheets are transferred to the post-processing tray. In other words, the deterioration of quality of the post-processed sheet stack by the post-processing unit can be effectively removed.

2nd Embodiment

A second embodiment of the sheet distributing system according the present invention will be described with reference to FIGS. 24(*a*) through 26.

Figure 24A:
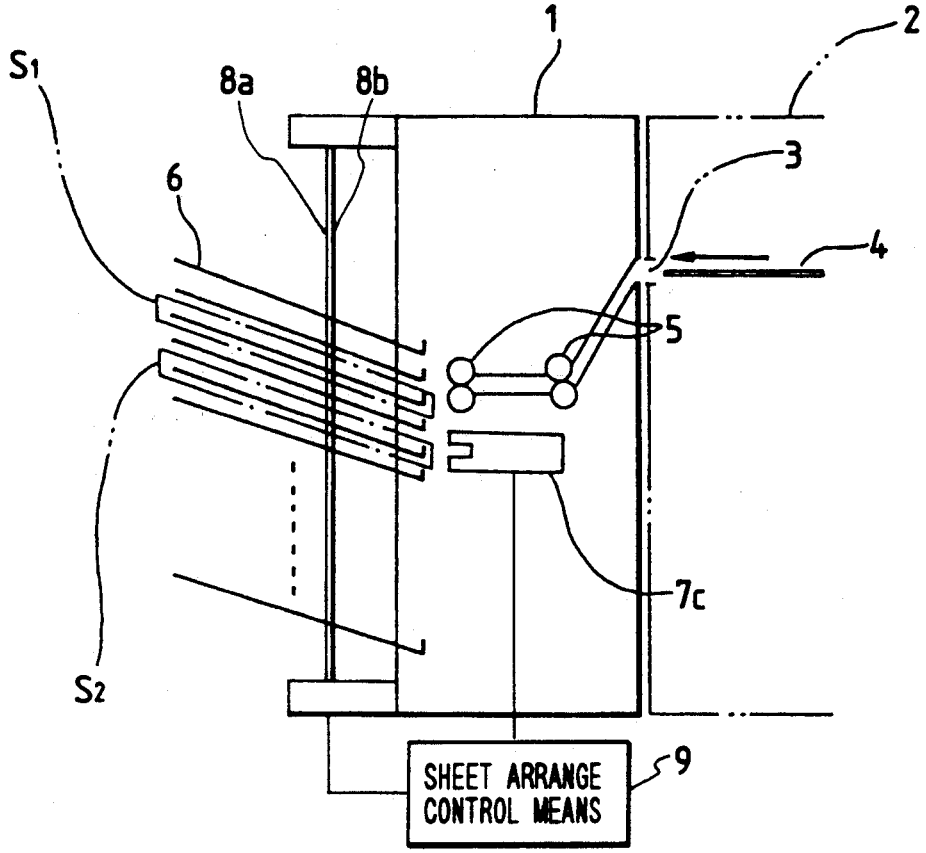
FIG. 24(*a*) is a side view showing the scheme of a second embodiment of the sheet distributing system according to the present invention.
Figure 24B:
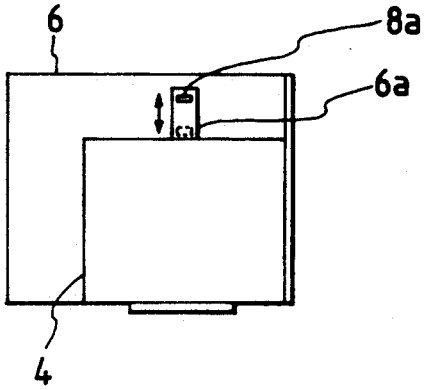

The concept of the second embodiment of the invention is as illustrated in FIGS. 24(*a*) and 24(*b*). As shown, the sheet distributing system according to the second embodiment comprises: sheet transfer means 5, disposed within a sorter housing 1, for transferring a recorded sheet or sheets 4 discharged from a sheet exit 3 of an image recording unit 2 to a sheet distribution stage S1; a set of vertically arranged bin trays 6 on one side of the housing 1 and being moved toward the sheet distribution stage S1 at the distributing timings of the recorded sheets 4; post-processing means 7*c*, located within the housing 1, for moving each of the bin trays 6 to a post-processing stage S2 in turn when the sheet distributing operation has been completed, and for applying a predetermined post-process to the stacked recorded sheets 4 being contained in each of the bin trays 6; sheet arranging means 8*b* having a rod-like tamper 8*a* disposed passing through and movable along openings 6*a* formed in the respective bin trays 6, in which the tamper 8*a* advances and contacts with one end of a stack of recorded sheets 4 distributed to and contained in the bin trays 6, thereby to arrange the stacked recorded sheets therein; and sheet arrange control means 9 for driving the sheet arranging means 8*b* to arrange the recorded sheets, every time the number of recorded sheets 4 corresponding to the number of distributions are distributed into the bin trays 6 in the Sorting move, and every time the post-process is applied to each bin tray 6 in the post-processing mode.

The set of bin trays 6 may be designed such that it is moved up or down pitch by pitch, and when the last bin tray 6 into which the recorded sheets are to be distributed is reached, the bin tray set is returned to the initial position, and the pitch-by-pitch movement of the tray set starts again. When taking it into consideration to improve the efficiency of the sorting process, it is preferable to design the set of bin trays 6 so as to move in both the up- and down-directions on the pitch-by-pitch basis.

The post-processing means 7*c* must include a given post-processing unit, and post-process control means for driving the post-processing unit to apply a predetermined post-process to the stacked recorded sheets 4 within each bin tray 6.

The post-processing unit may be of any type if it is able to apply the post-process to the stacked recorded sheets 4. A stapler, puncher, binder or the like may be enumerated for the unit. The post-processing stage S2 where the post-process is performed by the post-processing unit may be provided separately from the sheet distribution stage S1 or be used also as the sheet distribution stage S1. In the case where the sheet distribution stage S1 and the post-processing stage S2 are separately provided, the stages S1 and S2 are preferably as close as possible in order to remove an excessive motion of the bin trays 6 when the operation mode of the sheet distributing system changes from the sorting process to the post-process.

The post-processing unit may be set at a predetermined fixed position or it may be moved to the post process executing position. A plurality of post-processing units may be used in place of a single post-processing unit. In this case, those post-processing units may be of the same type. Further, different types of post-processing units may be installed at different post-processing stage S2 in one-to-one correspondence or such that those can be successively set at a single post-processing stage S2.

The post-process control means for causing the post-processing unit to execute predetermined post-processes, operates in a manner that it first moves the post-processed bin trays 6 to the post-processing stage S2, and then controls only the post-processing unit or the combination of the unit and an additional mechanism (in the case of the bin tray movable type, bin tray pull-out means, for example).

The control functions of the post-process control means may be properly selected according to the functions to be realized.

For example, in the case where the image recording apparatus is a copying machine with an ADF (automatic document feeder), when it is operated in an ADF mode, the post-process control means uses a control function to start the post-process by the post-process control means upon completion of copying the last original document by the ADF. In the apparatus of the type in which the post-processing unit is provided with the sheet detect means, when the detect means fails to detect the recorded sheets 4 in a post-processed bin tray 6, the post-process control means uses the function to cancel the post-process, which is applied to the stacked recorded sheets 4 in that bin tray 6 and immediately moves a bin tray 6 to next be post-processed to the post-processing stage S2. In the apparatus of the type having a plurality of post-processing functions by the post-processing units (e.g., a corner stapler for driving a staple through one corner portion of the stacked recorded sheets 4 and dual staplers for driving staples through one side marginal portion of the stacked recorded sheets 4 at two positions), a desired post-processing function may be selected by a select means.

The sheet arranging means 8*b* may be any means if it is able to arrange recorded sheets 4 by means of the tamper 8*a* passing through the opening 6*a* of each bin tray 6.

The opening 6*a* may have any size so far as it does not obstruct the sheet arranging operation by the tamper 8*a*. For example, it may be a cut-out opened to one side of the bin tray 6 or a slit in a closed space. The opening 6*a* is preferably formed such that it does not obstruct the motion of the recorded sheets 4 discharged into the bin tray 6. For example, the side of the opening 6*a* closer to the distal end of the bin tray 6 is slanted with respect to one edge of the recorded sheet 4. One side of the opening 6*a* is lowered than the surface of the bin tray 6.

The tamper 8*a* may arrange the stacked recorded sheets 4 not only unidirectionally but also bidirectionally. The shape and the number of the tamper 8*a* and the drive support mechanism for the taper, and a locus of the moving tamper may be properly designed. The tamper 8*a* may be rectangular or circular in cross section, for example. A single or a plurality of tampers 8*a* may be used. The drive support mechanism, or a shift actuator of the linear drive type, for example. The locus of the moving tamper 8*a* may be linear or curved.

The sheet arrange control means 9 may be any means, e.g., a microcomputer, if it can drive and control the tamper 8*a* according to an algorithm corresponding to that in the sorting process mode and the post-processing mode.

A simple reciprocal movement of the tamper 8*a* suffices for arranging the recorded sheets 4. However, to secure a quick sheet arranging operation, the tamper 8*a* is preferably moved such that it is first moved to a location near one edge of the stacked recorded sheets 4 at the start of the sorting process or the post-process, and then it is driven for the sheet arrangement. During the post-process, it is only needed that the tamper 8*a* holds the stacked recorded sheets 4 as far as the stack of recorded sheets 4 is not disarranged, not over the entire post-processing operation.

The operation of the technical means as mentioned above will be described.

Figure 25:
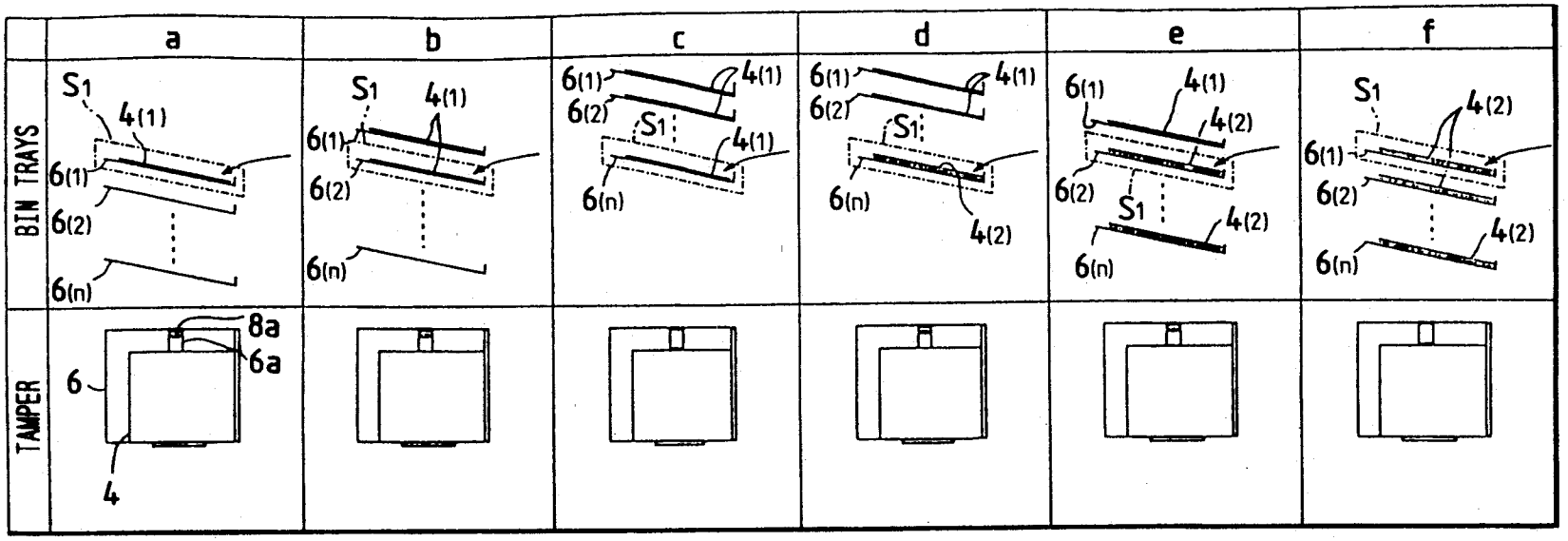
FIG. 25 shows a set of views useful in explaining the operation of the sheet distributing system in a sorting mode.

In the description, it is assumed that the set of bin trays 6 is moved in both the up- and down-directions on the pitch-by-pitch basis (a state shown in FIG. 25(*a*) is assumed to be the initial position), and recorded sheets 4 relating to a predetermined number of original documents are prepared and n number of recorded sheets are distributed into each of bin trays 6 (6(1) to 6(*n*)).

Firstly, as shown in FIGS. 25(*a*) to 25(*c*), recorded sheets 4(1) relating to the first original are successively supplied to the sheet distribution stage S1 by the sheet transfer means 5, and are distributed into the bin trays 6 ascending pitch by pitch, one sheet for one tray.

The tamper 8*a* of the sheet arranging means 8*b* is positioned apart from the recorded sheets 4(1) until the last recorded sheet 4(1) is put into the n-th or last bin tray 6(*n*) (see FIGS. 25(*a*) and 25(*b*)). When the last sheet 4(1) is put into the last tray 6(*n*), that is, the sorting job for the first original is completed, the tamper 8*a* comes in contact with one edge of the recorded sheet 4(1) in each bin tray 6 to arrange the recorded sheet 4(1) in place.

Then, as shown in FIGS. 25(*d*) to 25(*f*), recorded sheets 4(2) relating to the second original are successively supplied to the sheet distribution stage S1 by the sheet transfer means 5, and are distributed into the bin trays 6 descending pitch by pitch, one sheet for one tray.

The tamper 8*a* of the sheet arranging means 8*b* is positioned apart from the recorded sheets 4(1) until the last recorded sheet 4(2) relating to the second original is put into the first bin tray 6(1) (see FIGS. 25(*d*) and 25(*e*)). When the last sheet 4(2) is put into the first tray 6(1), that is, the sorting job for the second original is completed, the tamper 8*a* comes in contact with one edge of the recorded sheet 4(2) in each bin tray 6 to arrange the recorded sheet 4(2) in place.

Subsequently, every time the sorting job of the recorded sheets 4 relating to each of the 3rd original and the subsequent ones is completed through the steps of FIGS. 25(*a*) through 25(*f*), the sheet arranging operation by the tamper 8*b* is repeated.

Figure 26:
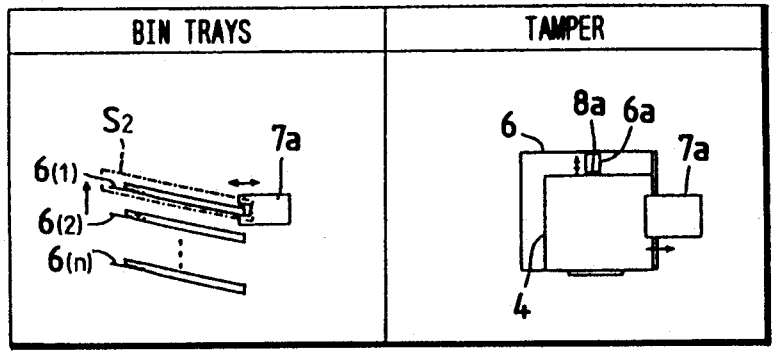
FIG. 26 shows views useful in explaining the operation of the post-processing means of the sheet distributing system of FIG. 24(*a*)

When the sorting processes for the recorded sheets 4 are completed, the post-processing means 7*c*, as shown in FIG. 26, successively sets the subject bin tray 6 (6(1) to 6(*n*)) at the post-processing stage S2, and applies a given post-process to the stacked recorded sheets 4 being contained in the subject bin tray 6.

In this case, the sheet arranging means 8b holds the stacked recorded sheets 4 every time the post-process is applied to each bin tray 6.

The detailed construction of the sheet distributing system of the second embodiment is substantially the same as that of the first embodiment, and hence no further description of the second embodiment will be given here.

3rd Embodiment

A third embodiment of the sheet distributing system according to the present invention will be described with reference to FIGS. 27 through 29.

Figure 27:
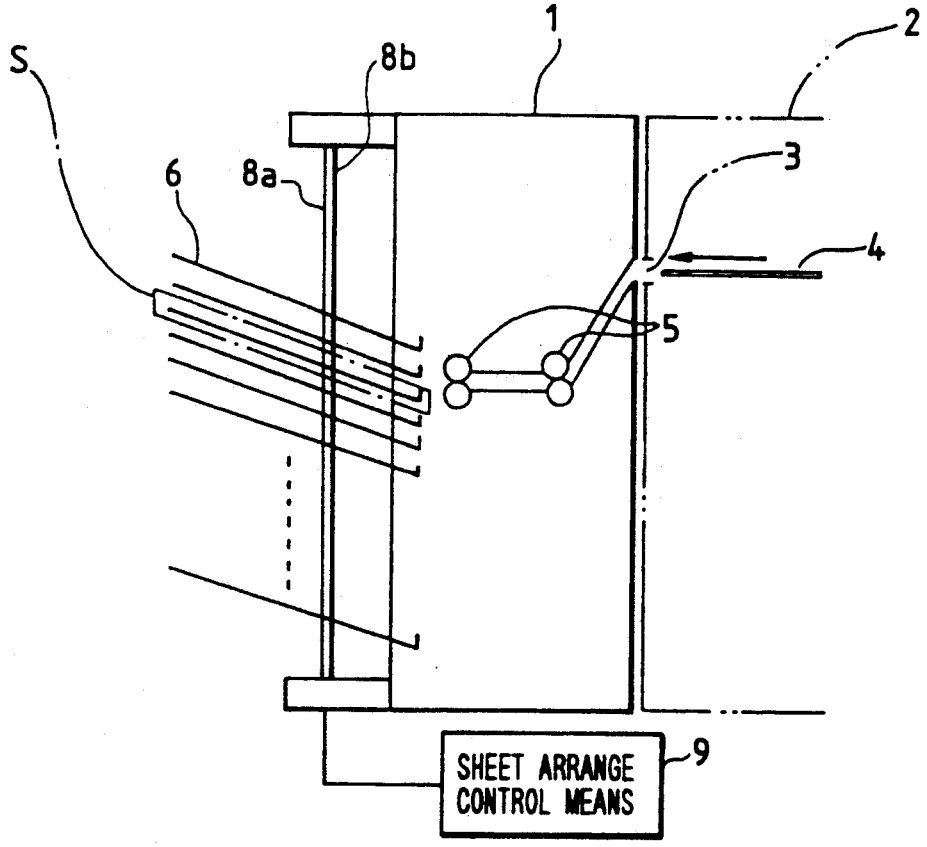
FIG. 27 is a side view showing the scheme of a third embodiment of the sheet distributing system according to the present invention.

The sheet distributing system of the third embodiment, as shown in FIG. 27, comprises: sheet transfer means 5, disposed within a sorter housing 1, for transferring a recorded sheet or sheets 4 discharged from a sheet exit 3 of an image recording unit 2 to a sheet distribution stage S; a set of vertically arranged bin trays 6 on one side of the housing 1 and being moved toward the sheet distribution stage S at the distributing timings of the recorded sheets 4; sheet arranging means 8b having a rod-like tamper 8a disposed passing through and movable along openings 6a formed in the respective bin trays 6, in which the tamper 8a advances and contacts with one end of a stack of recorded sheets 4 distributed to and contained in the bin trays 6, thereby to arrange the stacked recorded sheets therein; and sheet arrange control means 9 for driving the sheet arranging means 8b to arrange the recorded sheets, every time the number of recorded sheets 4 corresponding to the number of distributions are distributed into the bin trays 6 in the sorting mode.

Figure 28:
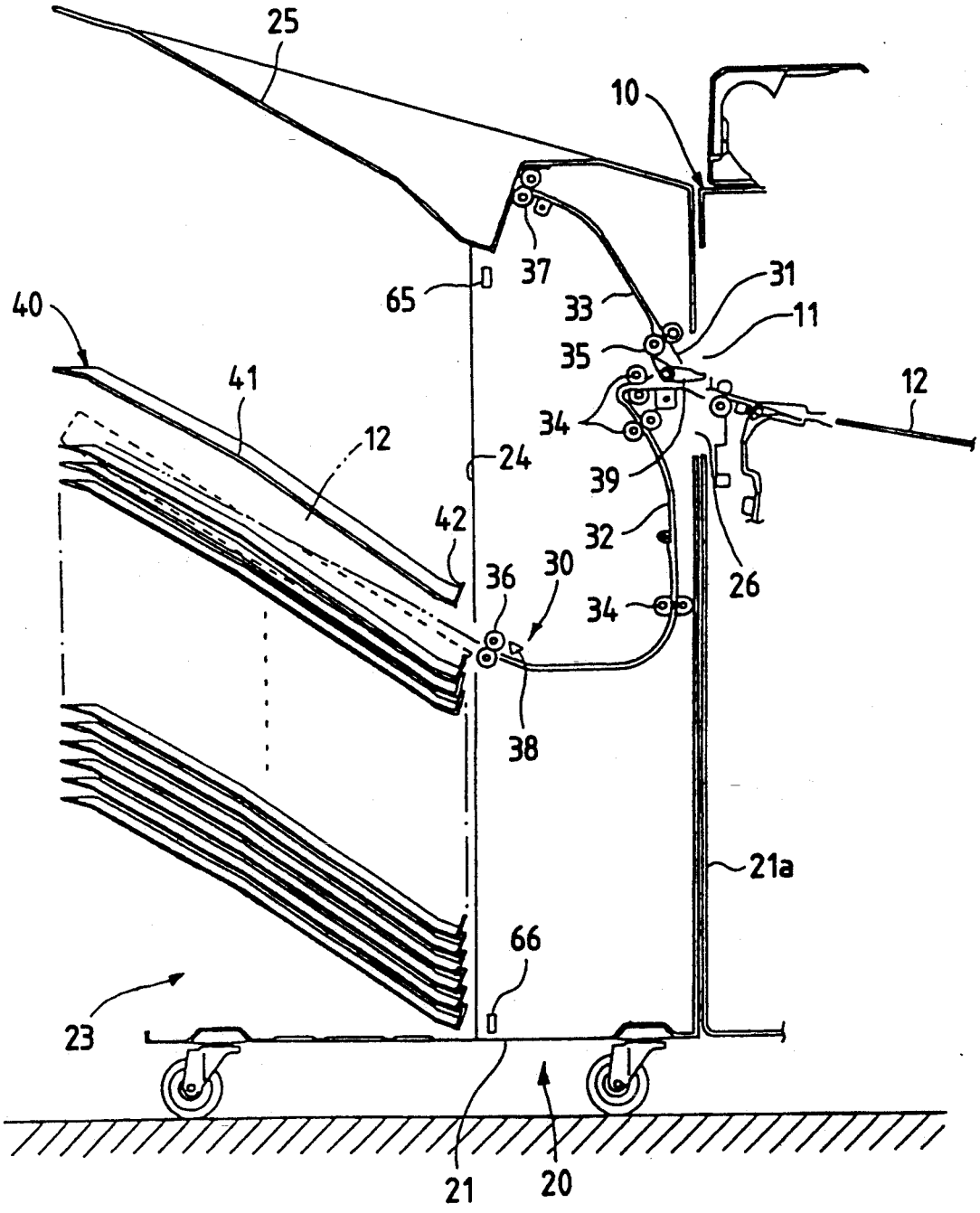
FIG. 28 is a sectional view showing the structure of the sheet distributing system of FIG. 27.

FIG. 28 is a longitudinal sectional view showing the structure of the sheet distributing system 20 as the third embodiment of the invention, which is combined with the main body of the copying machine (base machine) 10 with an ADF (not shown). The construction of the third embodiment system is substantially the same as that of the first embodiment system shown in FIG. 3 except that the stapler 100 is omitted.

Figure 29:
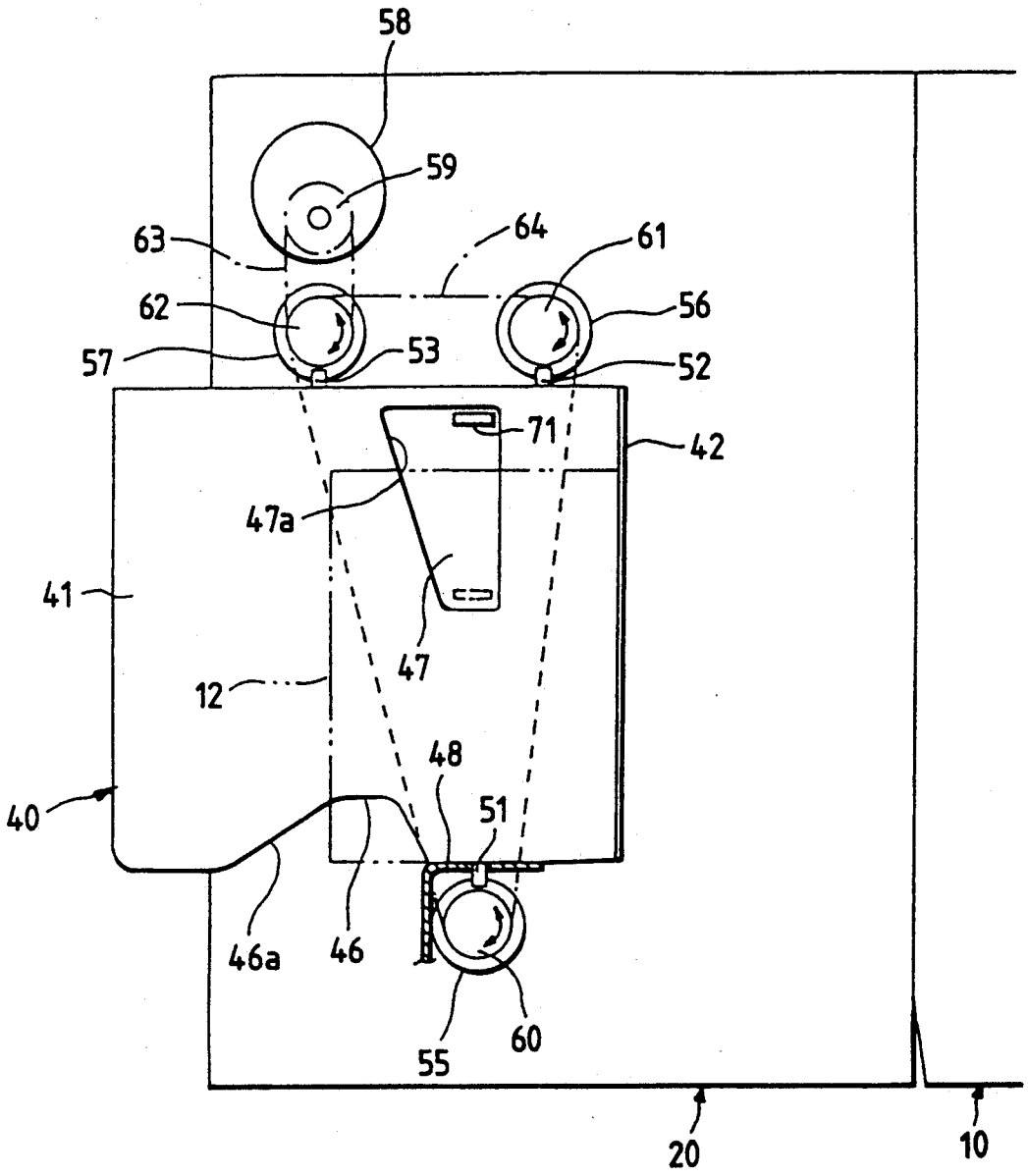
FIG. 29 is a view showing an essential portion of the sheet distributing system, in which a bin tray and a sheet arranging means are clearly illustrated.

Reference is made to FIGS. 28 and 29. The bin trays 40 are disposed such that they are downwardly inclined at a predetermined angle toward the opening 24 of the concavity 23. Each bin tray 40 includes a planar tray base 41, a positioning flange 42, a grip cut-out 46, and a tamper opening 47. The tray base 41 is slightly inclined toward the foreside as viewed in its width (corresponding to the width of the first transfer path 32). The positioning flange 42 erects at the edge of the tray base 41, which is located closer to the opening 24. The grip cut-out 46 for gripping the stack of the recorded sheets 12 is formed in the portion of the tray base 41, located substantially at the center of the foreside of the tray base as viewed in the width direction of the tray base. The opening 47 shaped like a triangle is formed in the tray base 41, while being disposed in the location closer to the rear side of the tray base 41 as viewed in its width direction, and to the positioning flange 42.

4th Embodiment

A fourth embodiment of the sheet distributing system according the present invention will be described with reference to FIGS. 30(*a*) through 40.

Figure 30A:
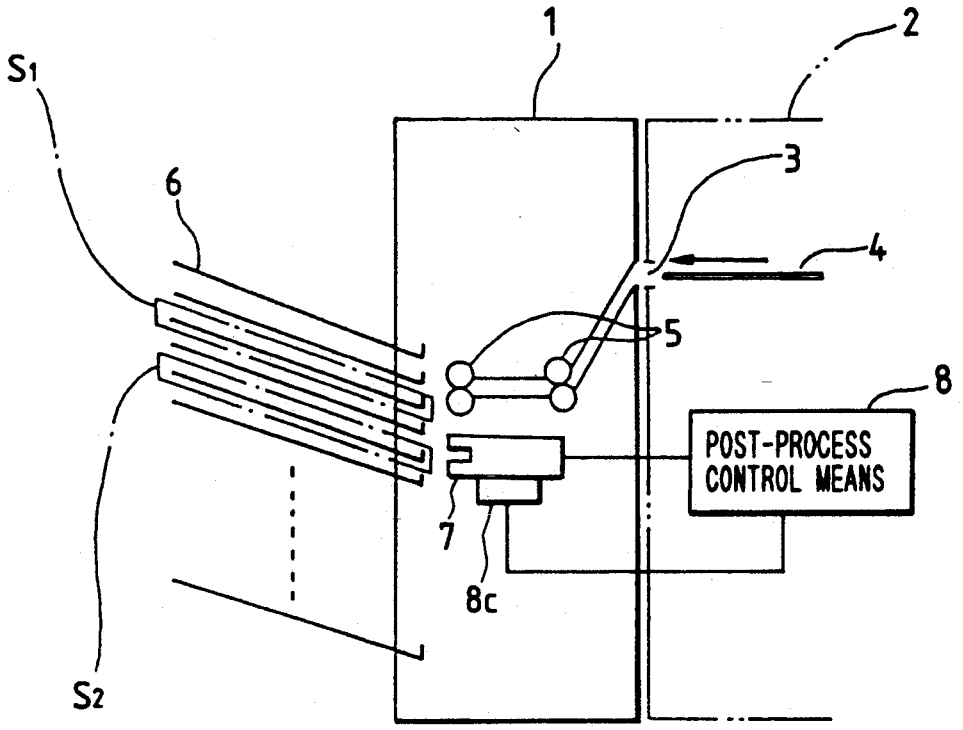
FIG. 30(*a*) is a side view showing the scheme of a fourth embodiment of the sheet distributing system according to the present invention.
Figure 30B:
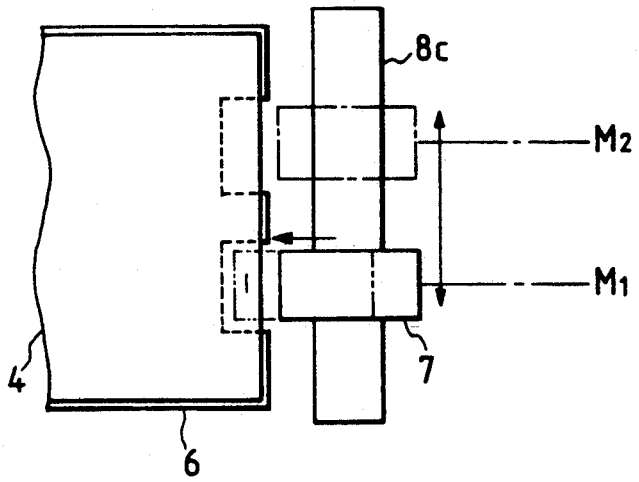

The fourth embodiment of the invention, as illustrated in FIGS. 30(*a*) and 30(*b*), is based on a sheet distributing system having sheet transfer means 5, disposed within a sorter housing 1, for transferring a recorded sheet or sheets 4 discharged from a sheet exit 3 of an image recording unit 2 to a sheet distribution stage S1, and a set of vertically arranged bin trays 6 on one side of the housing 1 and being moved toward the sheet distribution stage S1 at the distributing timings of the recorded sheets 4, whereby the recorded sheets 4 are distributed into the bin trays 6. The sheet distributing system of the embodiment comprises a post-processing unit 7 located below or above the sheet transfer means 5 and disposed in a space, within the housing 1, which extends in the direction of the width of the sheet transfer means 5, moving means 8c for moving the post-processing unit 7 in the direction of the width of the sheet transfer means 5, and post-process control means 8 which moves the post-processing unit 7 to a predetermined position for post-process, and causes the post-processing unit 7 to successively apply predetermined post-processes to one side marginal portion of a stack of recorded sheets 4 being contained in the bin tray 6 at a post-processing stage S2 different from the sheet distribution stage S1, when the sheet distributing operation has been completed. The moving means 8c may be any means if it is able to move the post-processing unit 7 along a predetermined path, and to exactly stop the post-processing unit 7 at a predetermined position for post-process.

Normally, the moving path of the post-processing unit 7 may be linear along one side edge of the stack of recorded sheets 4. Particularly, in the case where the post-processing unit 7 is a stapler, the stapling location for the corner of the stack of recorded sheets 4 is preferably inclined at a predetermined angle with respect to one side edge of the sheet stack 4 in order to last the stacked recorded sheets 4 one corner of which is stapled long by a corner stapler for stapling the corner of the stacked recorded sheets 4. In this case, the moving means 8c is preferably provided with a linear guide extending along one side edge of the stacked recorded sheets 4 and a curved guide curved toward the corner of the stacked recorded sheets 4.

The post-process control means 8 for causing the post-processing unit 7 to execute predetermined post-processes, operates in a manner that it first moves post-processing unit 7 to a predetermined position for post-process, sets the post-processed bin trays 6 at the post-processing stage S2, and then controls only the post-processing unit 7 or the combination of the unit and an additional mechanism (in the case of the bin tray movable type, bin tray pull-out means, for example).

The control functions of the post-process control means 8 may be properly selected according to the functions to be realized.

With regards to the position control of the post-process, for example, the post-process control means may stop the post-processing unit 7 at a predetermined position for post-processing according to information from a position detect sensor. The post-process control means may calculate a quantity of movement of the post-processing unit 7 from the reference position according to the size of the recorded sheets 4 to be sorted, and moves the post-processing unit 7 by the calculated quantity of movement.

For example, in the case where the image recording apparatus is a copying machine with an ADF, when it is operated in an ADF mode, the post-process Control means uses a control function to start the post-process by the post-process control means 8 upon completion of copying the last original document by the ADF. In the apparatus of the type in which the post-processing unit 7 is provided with the sheet detect means, when the detect means fails to detect the recorded sheets 4 in a post-processed bin tray 6, the post-process control means uses the function to cancel the post-process, which is applied to the stacked recorded sheets 4 in that bin tray 6 and immediately moves a bin tray 6 to next be post-processed to the post-processing stage S2. In the apparatus of the type in which the post-processing unit 7 is moved to a plurality of positions for post-process and the post-process are executed at the plurality of post-processing positions, the post-processing unit 7 may be moved to the post-processing position every bin tray 6 and execute the post-process. To make the operation more efficient, the post-process is moved to one of those post-processing positions, and at this position, a predetermined post-process is successively applied to the stacked recorded sheets 4 of the respective bin trays 6.

With the technical means as mentioned above, as shown in FIGS. 30(*a*) and 30(*b*), the recorded sheets 4 discharged from the image recording unit 2 are successively transferred to the sheet distribution stage S1 and distributed into the respective bin trays 6.

When the sorting process of the recorded sheets 4 is completed, the post-process control means 8 successively sets the bin trays 6 at the post-processing stage S2, while at the same time moves the post-processing unit 7 to a predetermined post-processing position (M1 or M2 in FIG. 30(*b*)). Then, the control means 8 causes the post-processing unit 7 to successively apply a post-process to one side marginal portion of the stacked recorded sheets 4 being contained in each bin tray 6.

Figure 31:
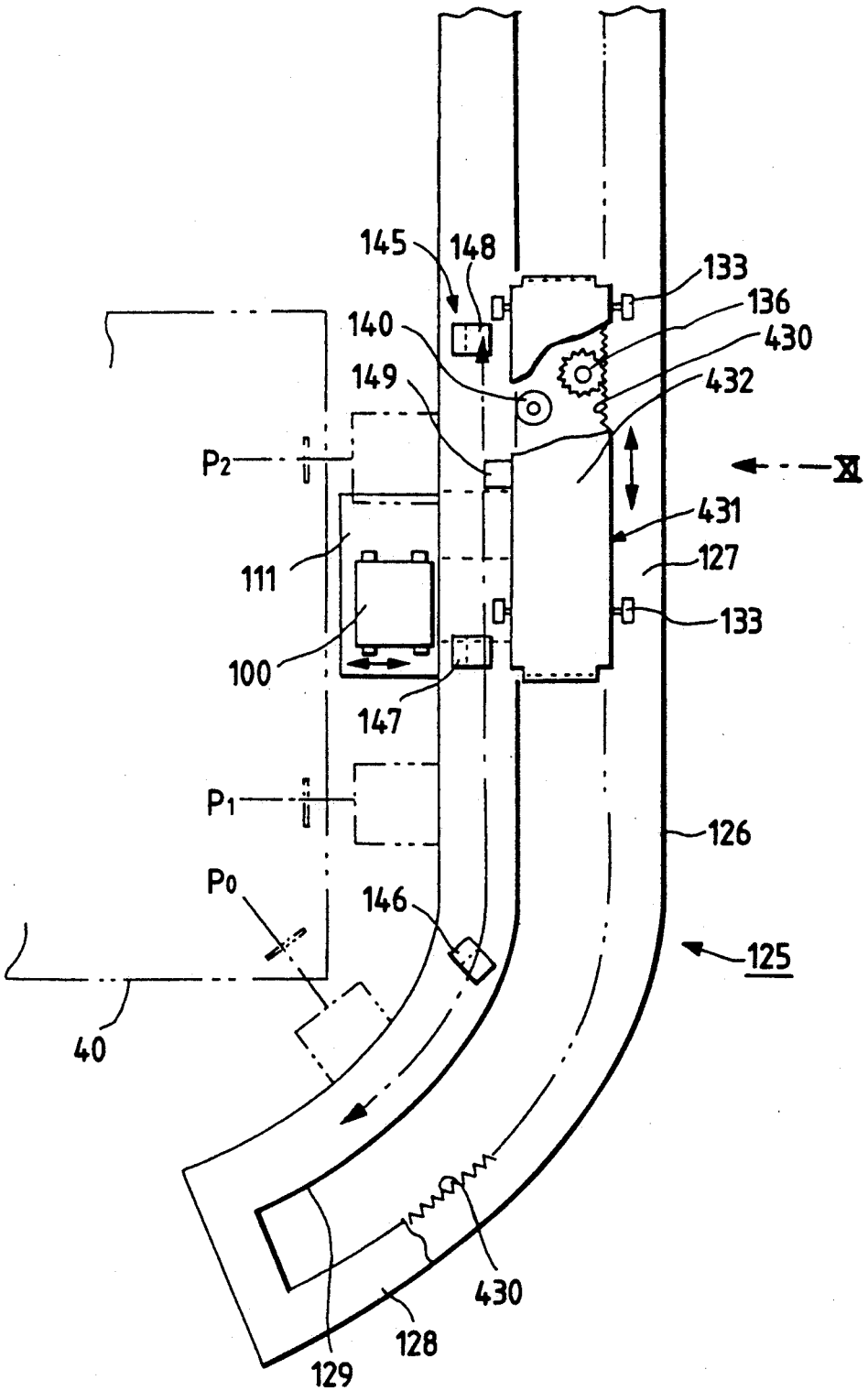
FIG. 31 is a plan view showing the construction of a moving system for the processing position of the stapler contained in the sheet distributing system of FIG. 30(*a*)
Figure 32:
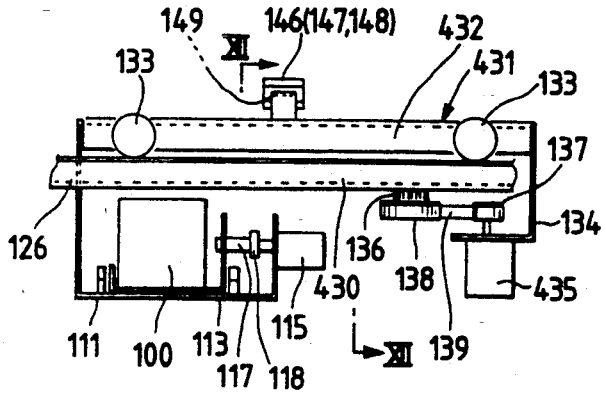
FIG. 32 is a side view of the structure as viewed in the direction of an arrow XI in FIG. 31.
Figure 33:
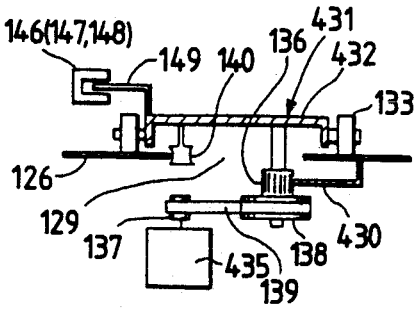
FIG. 33 is a side view taken on line XII—XII in FIG. 32.

A moving system 125 for the processing position of the stapler 100, as shown in FIGS. 31 through 33, includes a guide rail 126 defining moving path of the stapler 100, a carriage 431 for carrying the stapler 100 along the guide rail 126, and a stop position detector 145 for detecting a stop position of the carriage 431. The guide rail 126 includes a linear guide 127 extending along the positioning upstanding flange 42 of the bin tray 40 (FIG. 4) and a curved guide 128 curved toward the corner corresponding in position to the cut-out 43 of the bin tray 40 (FIG. 4). A groove 129, formed in the guide rail 126, extends in the longitudinal direction of the rail. A rack 430 is formed on one longitudinal side of the groove 129.

The carriage 431 consists of a rectangular plate 432 with paired guide rollers 133 provided on both sides the plate, and is movably disposed on the top of the guide rail 126.

At one end of the plate 432, a support bracket 111 of the stapler 100 is bent downwardly through the groove 129 to be shaped like L. The stapler 100 is placed on the horizontal part of the L-shaped bracket 111, with a stapler retractable moving system intervening therebetween. At the other end of the plate 432, another support bracket 134 is bent downwardly through the groove 129 to be shaped like an inverted L. A drive motor 435 for processing position movement (stepping motor in this embodiment) is mounted on the horizontal part of the drive motor 435. A pinion 136 in mesh with the rack 430 is rotatably supported by the drive motor 435. A transfer belt 139 is wound around a drive pulley 137 fixedly mounted to the output shaft of the drive motor 435 and a follower pulley 138 fixed coaxial with the pinion 136. A guide pulley 140, rotatably supported by the plate 432, engages with the side edge of the groove 129, which is opposed to the rack 430.

In this embodiment, the stop position detector 145 includes a position detect sensor 146 used for setting the stapler 100 at a corner stapling position P0, position detect sensors 147 and 148 used for setting the stapler 100 at dual stapling positions P1 and P2, and a protruded piece 149 outwardly protruded from one side edge of the plate 432. Each of the sensors 146 to 148 consists of a pair of a light emitting element and a photodetecting element, which are oppositely mounted on the top and bottom of a U-shaped case. When the protruded piece 149 reaches the location of any of the sensors 146 to 148, it interrupts a sensor path between the light emitting element and the photodetecting element, so that a logic level of the output signal of the sensor changes from high level to low level.

Figure 34:
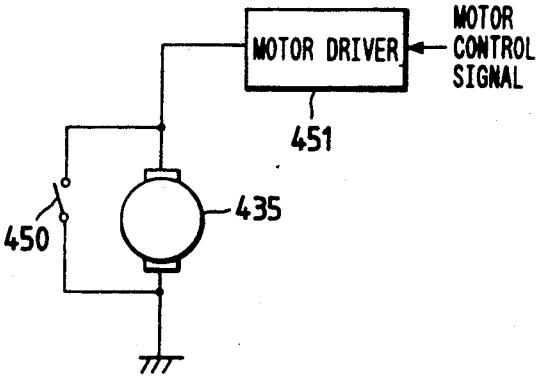
FIG. 34 is a circuit diagram showing the principle to stop a drive motor for the processing position moving system.

In FIG. 34, reference numeral 450 designates a short-circuit switch for short-circuiting the drive motor 435. When the output signal of any of the sensors 146 to 148 changes its logic state from high level to low level, the switch short-circuits the drive motor 435, to immediately stop the drive motor 435. Reference numeral 451 represents a motor driver for sending a drive signal to the motor 435.

Figure 35:
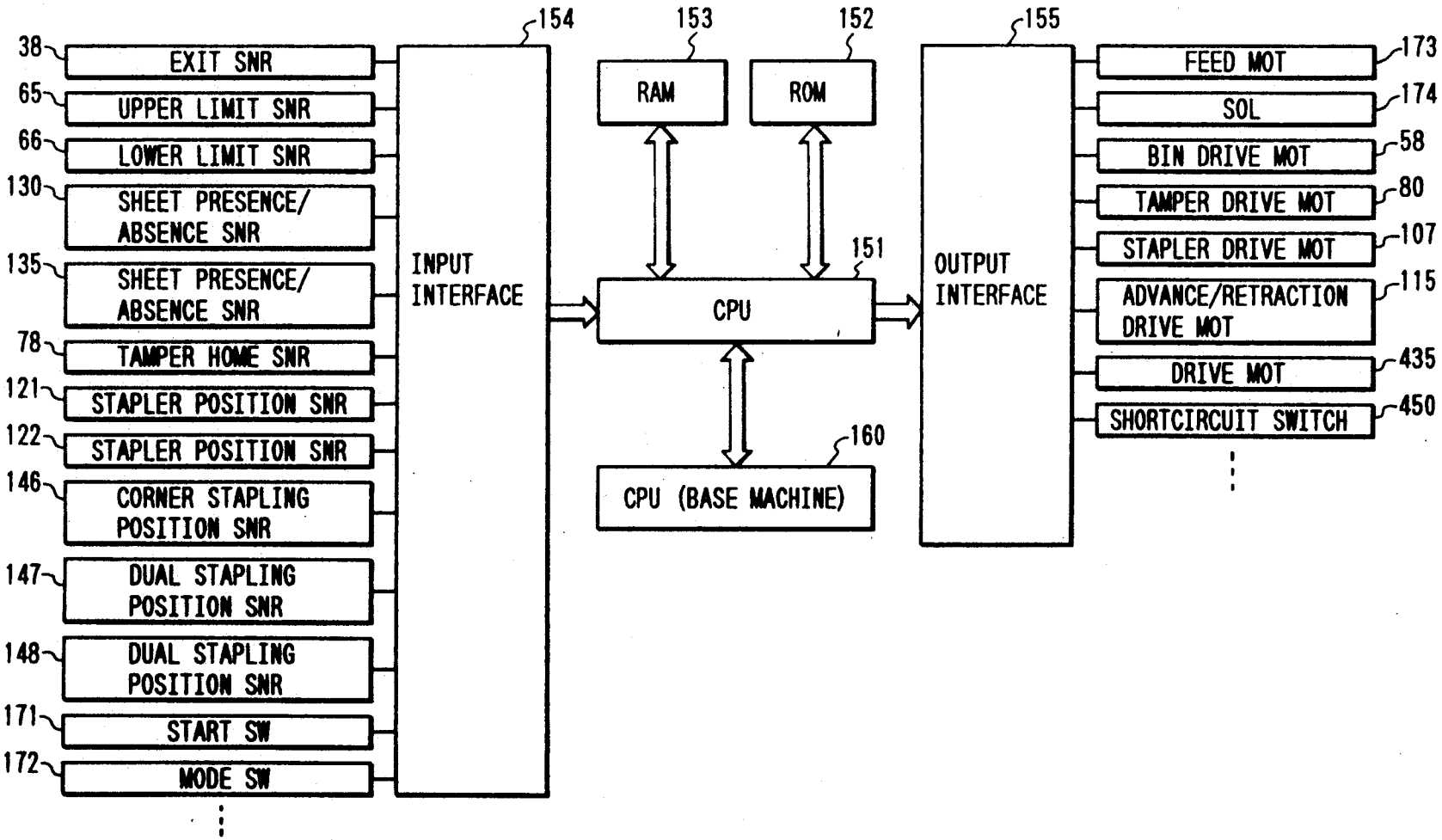
FIG. 35 is a block diagram showing a control system for the sheet distributing system of FIG. 30(*a*)

A control system of the instant embodiment is constructed with a microcomputer system as shown in FIG. 35.

In the figure, the computer system is made up of a CPU 151, a ROM 152, and a RAM 153. The ROM 152 stores a sorting process program, a stapling process program, and the like. The CPU 151 executes those programs, processes input data while transferring data to and from the RAM 153, and prepares necessary control signals.

In the computer system, the following components are additionally connected to the computer system of the first embodiment shown in FIG. 10; the corner stapling position sensor 146, and the dual stapling position sensors 147 and 148, which are coupled with the input interface 154, and the drive motor 435 and the shortcircuit switch 450, which are coupled with the output interface 155.

In the instant embodiment, data communication is performed between the CPU 151 and CPU 160 contained in the base machine 10. Through the data communication, the CPU 151 fetches various types of data, such as document size and the number of copies.

Figure 36:
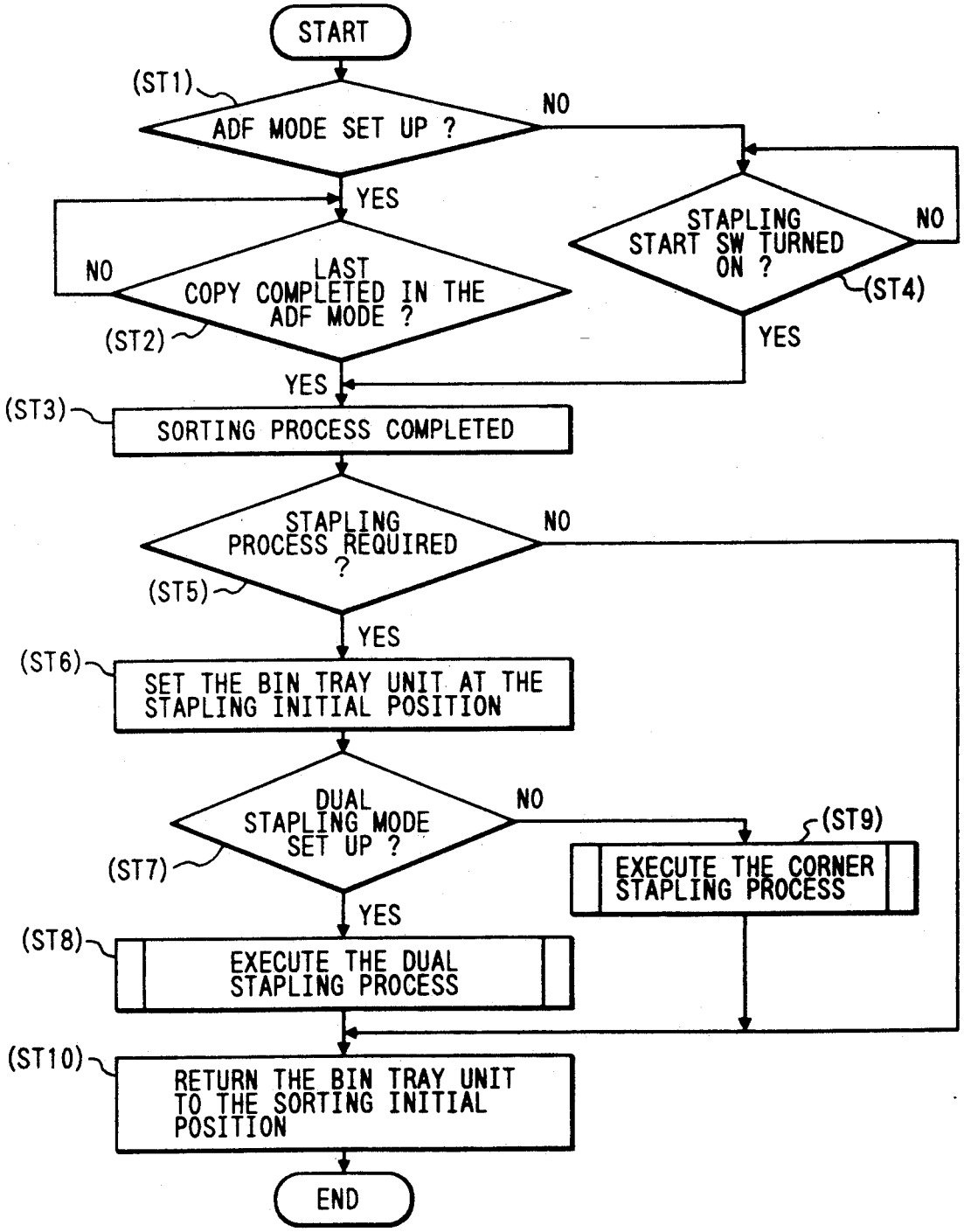
FIG. 36 is a flowchart showing a control flow for a stapling process.

A basic control flow for the bin trays 40 and the stapler 100 in the stapling mode is shown in FIG. 36.

In the control, the CPU 151 first checks whether or not the ADF mode is set up, on the basis of the data that is transferred from the CPU 160 of the base machine (ST1). If the ADF mode is set up in the base machine, the CPU checks if the last document copy by the ADF is completed (ST2). At the completion of the last document copy by the ADF, the CPU decides that the sorting process is perfectly completed (ST3). When the base machine 10 is not in the ADF mode, the CPU checks whether or not the manual start switch 171 has been turned on at the start of the stapling process (ST4). If the start switch 171 is turned on, the CPU judges that the sorting process is perfectly completed.

Thereafter, the CPU checks whether or not the stapling process is required according to the output signal of the first sheet presence/absence detector 130 (ST5). If it is required, the bin tray unit 40 is made to descend by one pitch, thereby to set the bin tray unit 40 at the stapling initial position so that the top or first bin tray 40 or the bin tray 40 ordered corresponding to the number of sorting operations is positioned at the post-processing stage S2 (ST6).

Afterwards, the CPU checks if the stapling mode is the dual mode (ST7), on the basis of information from the mode select switch 172 set to the stapling mode. If the dual mode is set up, the dual stapling process is executed (ST8). If the dual mode is not set up, the CPU judges that the corner mode is set up, and executes the corner stapling process (ST9).

When the execution of a series of stapling operations are completed or when in step ST5, no stapling process is required (the output signal of the photodetecting element 132 of the sheet presence/absence detector 130 is high in logic level), the CPU returns the bin tray unit 40 to the sorting initial position so that the top bin tray 40 is set at the sheet distribution stage S1 in preparation for the next sorting process (ST10), and ends a series of the processes.

Figure 37A:
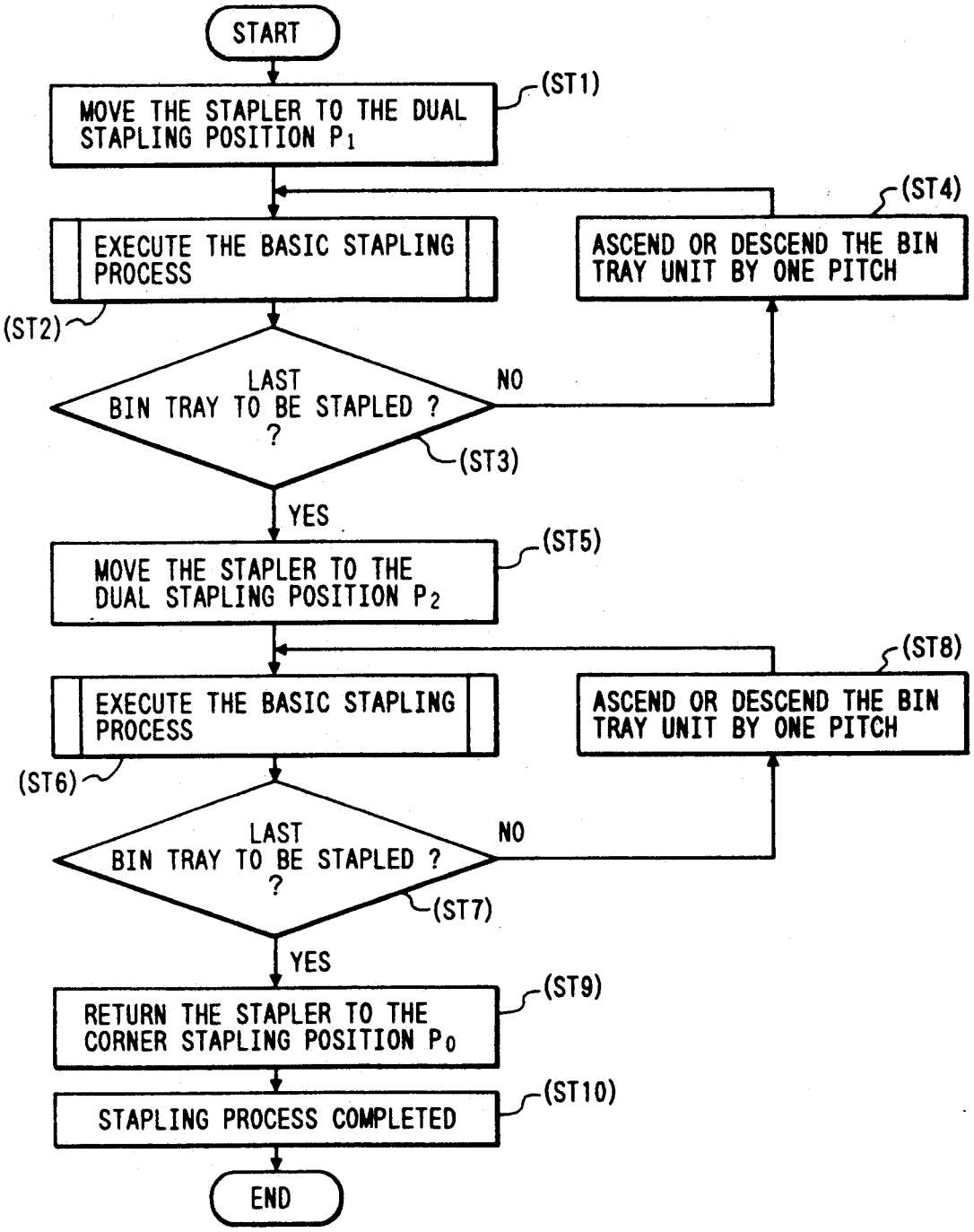
FIG. 37(*a*) is a flowchart showing a control flow for a dual stapling process.
Figure 37B:
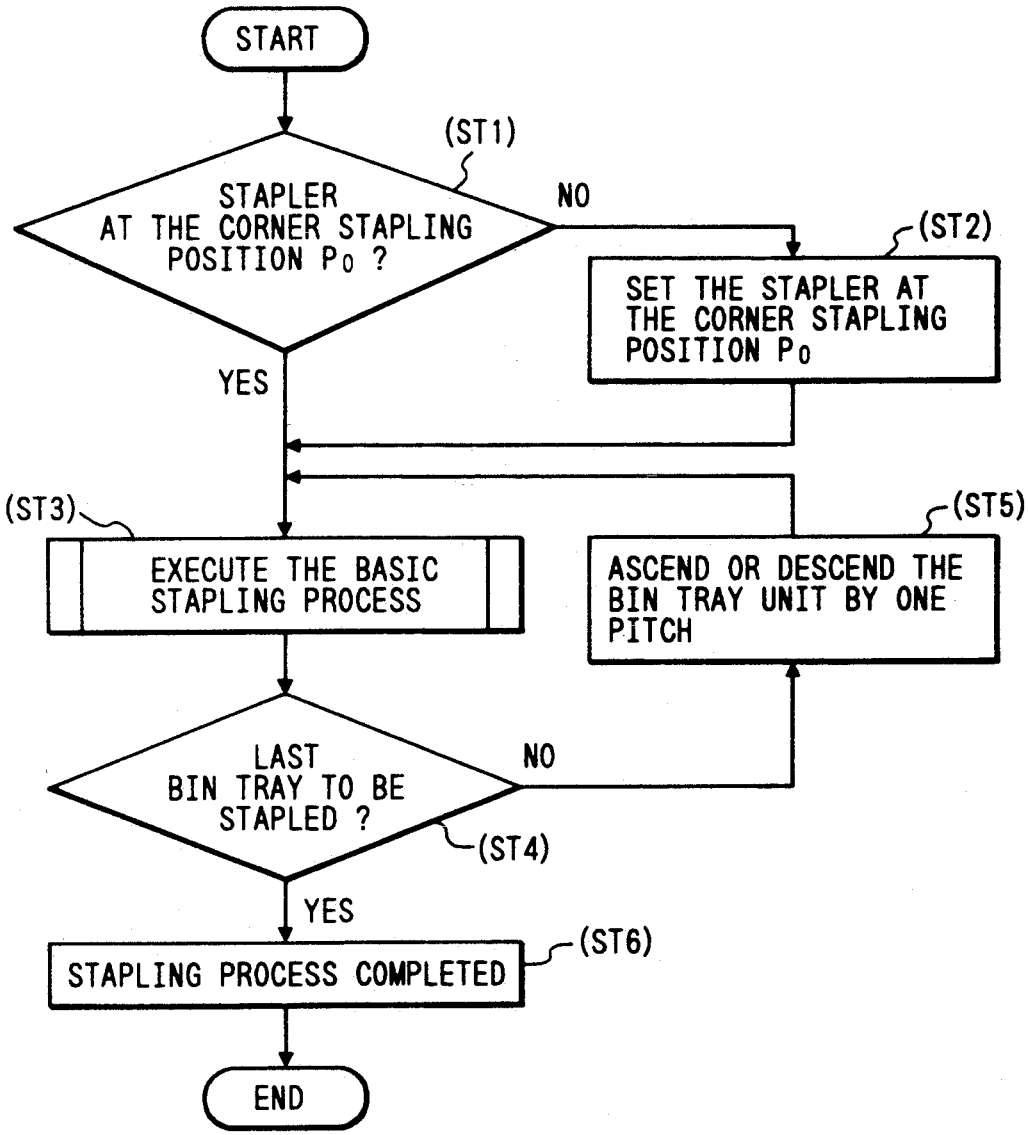

A specific example of the process of step ST8 in FIG. 36 is shown in FIG. 37(*a*).

The CPU 151 first drives the drive motor 435 to move the carriage 431, stops the drive motor 435 on the basis of information from the position detect sensor 147, and sets the stapler 100 at the dual stapling position P1 (ST1).

At this stage, the CPU executes the basic stapling process (ST2), and checks if the stapling-processed object is the last bin tray (ST3). If it is not the last bin tray, the CPU makes the bin tray unit 40 ascend or descend by one pitch and sets the bin tray 40 to be processed next at the post-processing stage S2 (ST4). Subsequently, the sequence of steps ST2 to ST4 is repeated until the stapling-processed object is the last bin tray.

When the stapling process for the last bin tray is completed, the CPU drives again the drive motor 435 to move the carriage 431, stops the drive motor 435 on the basis of information from the position detect sensor 148, and sets the stapler 100 at the dual stapling position P2 (ST5).

At this stage, the CPU executes the basic stapling process (ST6), and checks if the stapling-processed object is the last bin tray (ST7). If it is not the last bin tray, the CPU makes the bin tray unit 40 ascend or descend by one pitch and sets the bin tray to be processed next at the post-processing stage S2 (ST8). Subsequently, the sequence of steps ST6 to ST8 is repeated until the stapling-processed object is the last bin tray.

In step ST7, if the CPU judges that the stapling-processed object is the last bin tray, it reversely rotates the drive motor 435 to move the carriage 431, stops the drive motor 435 in response to information from the position detect sensor 146, returns the stapler 100 to the corner stapling position P0 (initial position, in this embodiment) (ST9), and judges that the stapling process is completed (ST10).

An example of the process of step ST9 shown in FIG. 36 is shown in FIG. 37(*b*).

In the figure, the CPU 151 first checks if the stapler 100 is at the corner stapling position (initial position) P0 (ST1). If the answer is NO, the CPU drives the drive motor 435 to move the carriage 431, and stops the drive motor 435 according to information from the position detect sensor 146, and sets the stapler 100 at the corner stapling position P0 (ST2).

After it is confirmed that the stapler 100 is at the corner stapling position P0, the CPU executes the basic stapling process (ST3). Then, the CPU checks if the stapling-processed object is the last bin tray (ST4). If it is not the last bin tray, the CPU makes the bin tray unit 40 ascend or descend by one pitch and sets the bin tray to be processed next at the post-processing stage S2 (ST5). Subsequently, the sequence of steps ST3 to ST5 is repeated until the stapling-processed object is the last bin tray.

At the stage that the stapling process is applied to the last bin tray, the CPU judges that the stapling process has been completed (ST6).

Next, a specific example of the stapling process will be described.

It is assumed that the base machine copies the k number of original documents using the ADF, and produces n number of copies for each original, and those copies are stapled.

Figure 38:
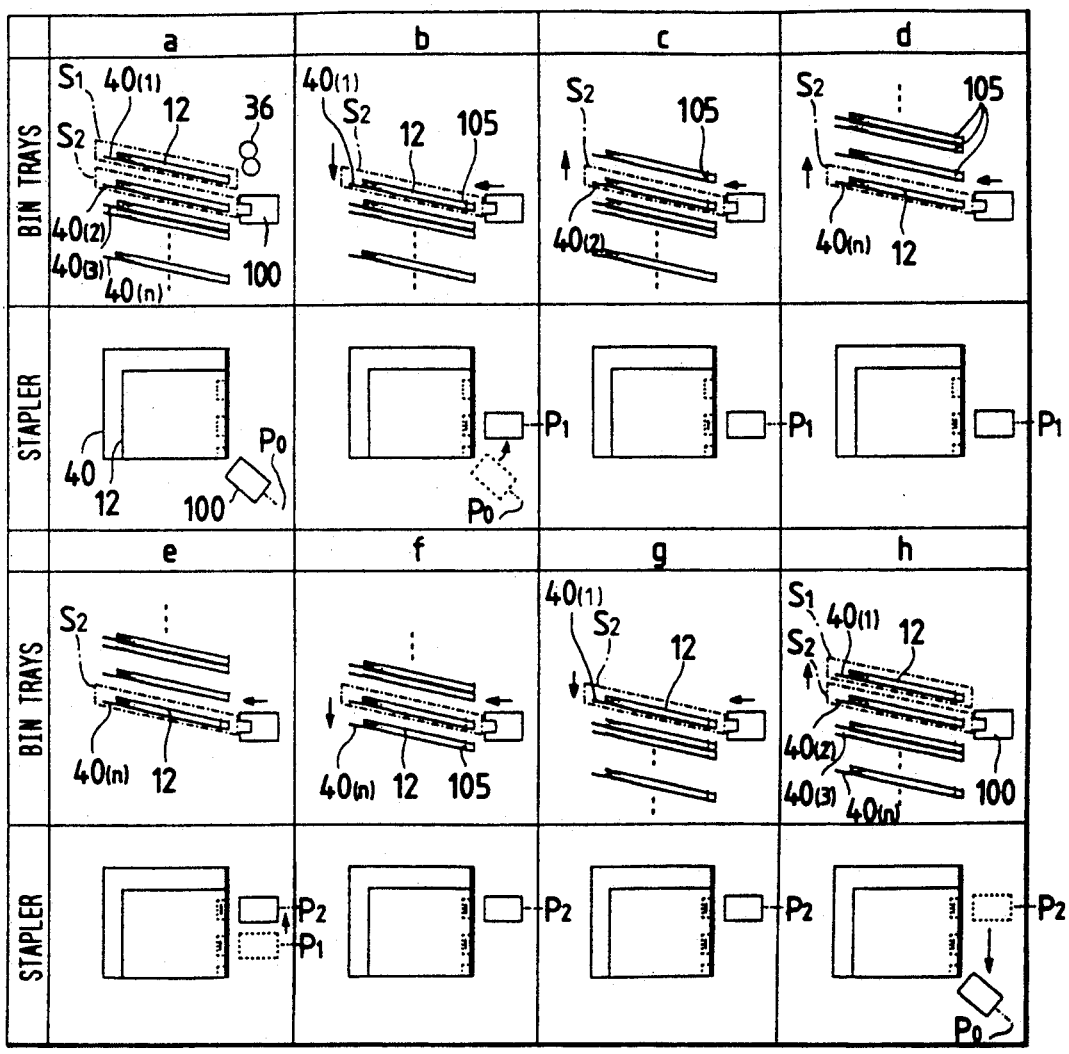
FIG. 38 shows a set of views useful in explaining the operation of the bin tray unit and the stapler of the sheet distributing system in a stapling mode.

If the k number of the original documents is an even number, the bin tray unit 40 is disposed at the sorting initial position where the top bin tray 40(1) is set at the sheet distribution stage S1, as shown in FIG. 38(*a*), at the end of the sorting process. The stapler 100 is set at the corner stapling position (initial position) P0.

Under this condition, as shown in FIGS. 38(*b*), the bin trays 40 descend by one pitch, so that the top bin tray 40(1) is set at the post-processing stage S2. Further, the dual mode is selected by the dual mode select switch 172, so that the stapler 100 is set at the dual stapling position P1 to drive staples 105 through one side marginal portion of the stack of the recorded sheets 12 stored in the top bin tray 40(1) at two different positions.

Subsequently, as shown in FIGS. 38(*c*) and 38(*d*), the respective bin trays 40 ascend by one pitch, and the second and the subsequent ones 40(2) to 40(*n*) are successively set at the post-processing stage S2. The stapler 100 set at the dual stapling position P1 successively drives staples 105 through the one side marginal portions of the stacked recorded sheets 12 stored in the bin trays 40(2) to 40(*n*).

When the stapling means staples a stack of recorded sheets stored in the last bin tray 40(*n*) at the dual stapling position P1, the stapler 100, as shown in FIG. 38(*e*), is moved to and set at the dual stapling position P2, and the stapler fastens one side marginal portion of the stacked recorded sheets 12 being contained in the last bin tray 40(*n*), with staples 105.

Subsequently, as shown in FIGS. 38(*f*) and 38(*g*), the respective bin trays 40 descend by one pitch, and the n−1th to the top trays 40(n−1) to 40(1) are successively set at the post-processing stage S2. The stapler 100 set at the dual stapling position P2 successively drives staples 105 through the one side marginal portions of the stacked recorded sheets 12 stored in the bin trays 40(n−1) to 40(1).

When the stapling means staples the stack of recorded sheets stored in the top bin tray 40(1), the execution of a series of stapling processes is completed. As shown in FIG. 38(*h*), each bin tray 40 returns to the sorting initial position, and the stapler 100 also returns to the corner stapling position (initial position) P0.

In a case where the k number of the original documents is an odd number, the n-th bin tray 40(*n*) is positioned at the sheet distribution stage S1 upon completion of the sorting process. In this case, the stapling process is performed in the following. The bin tray unit 40 is first made to descend by one pitch to set the n-th bin tray 40 at the post-processing stage S2. The stapler 100 is set at the dual stapling position P1. The respective bin trays 6 are made to descend by one pitch. Stacks of recorded sheets contained in the bin trays 40(*n*) to 40(1) are successively stapled. Then, the stapler 100 is set at the dual stapling position P1, and subsequently the respective bin trays 6 are made to ascend by pitch to successively staple the stacked recorded sheets 12 contained in the bin trays 40(*n*) to 40(1).

A modification of the sorter according to the present invention will be described.

Figure 39:
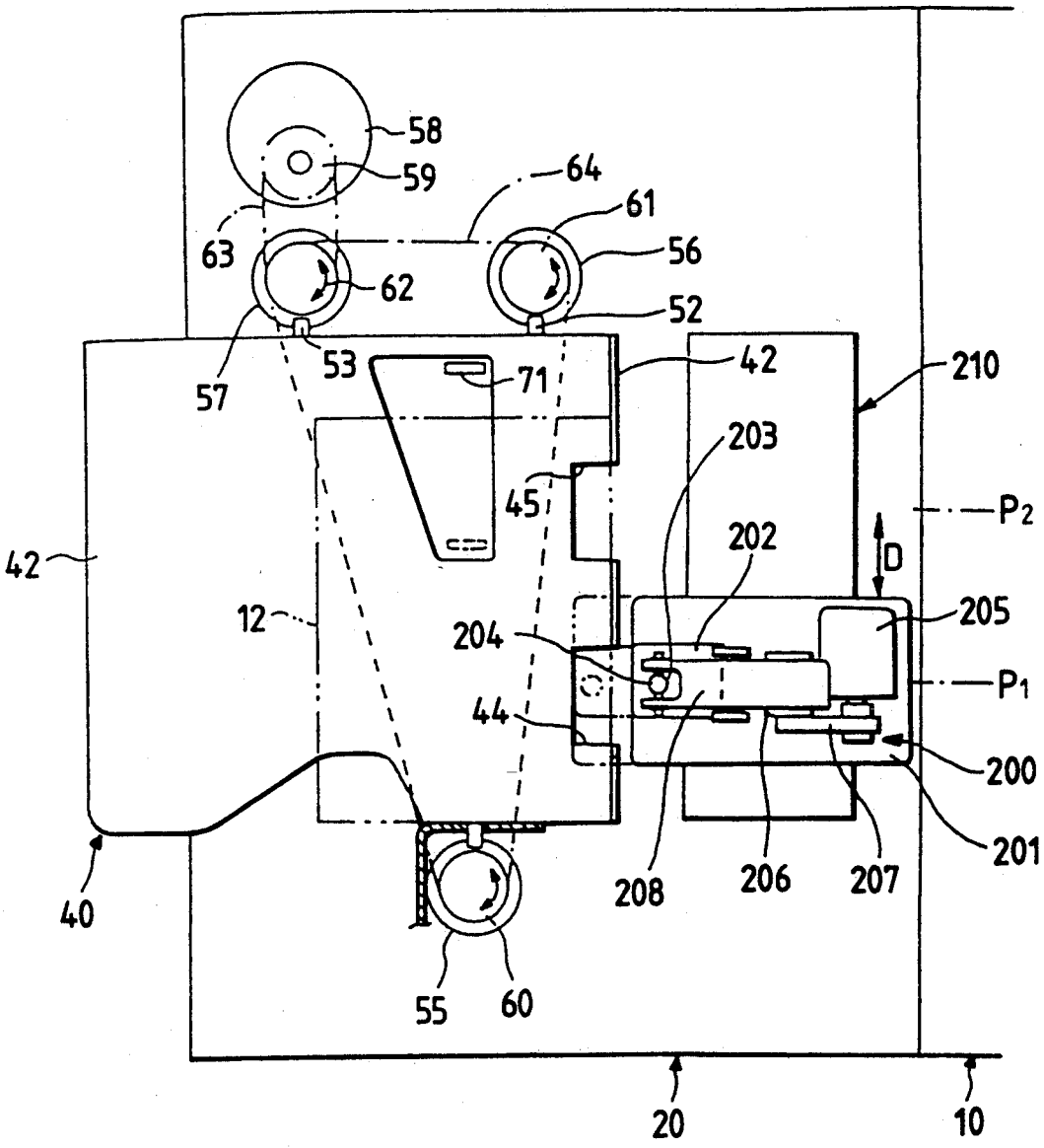
FIG. 39 is a view showing an essential portion of the sheet distributing system, in which a bin tray and a puncher as post-processing means are clearly illustrated.

FIG. 39 shows the structure of a puncher to punch an object, e.g., the stacked recorded sheets, at a single position. In the figure, a puncher 200 is mounted on a movable plate 201, which advances to and retracts from a support bracket, not shown. In a non-punching mode, the puncher is located at a waiting position as indicated by a solid line, and in a punching mode, it advances to a punching position as indicated by a two-dot chain line and punches one side marginal portion of the stacked recorded sheets 12.

The puncher 200 includes a sheet table 202, U shaped in cross section, having a through-hole 203 vertically passing therethrough. A punching rod 204 is vertically movably disposed in the through-hole 203.

A drive system of the punching rod 204 is assembled on the movable plate 201. The drive system is made up of a puncher drive motor 205, an eccentric cam 206, a drive force transmission mechanism 207 including a belt for transferring a drive force from the puncher drive motor 205 to the eccentric cam 206, pulleys, and the like, and a swing arm down the punching rod 204 according to an engaging state of the arm with the swing arm 208.

In this embodiment, the puncher 200, together with the support bracket (not shown), is mounted on the processing position moving system 210, and is movable in the direction (arrow direction D in the figure) along one side edge of the stacked recorded sheets 12 in each bin tray 40. The control system for the processing position movement in this modification, unlike that of the embodiment, determines a quantity of movement according to only the size of recorded sheets 12, and moves the puncher 200 by the movement quantity determined.

In the modification of the sorter, cut-outs 44 and 45 are formed in one side portion of the bin tray 40 at the location corresponding to the punching rod 204. The formation of the cut-outs 44 and 45 allows the puncher 200 to smoothly operate for punching.

Figure 40:
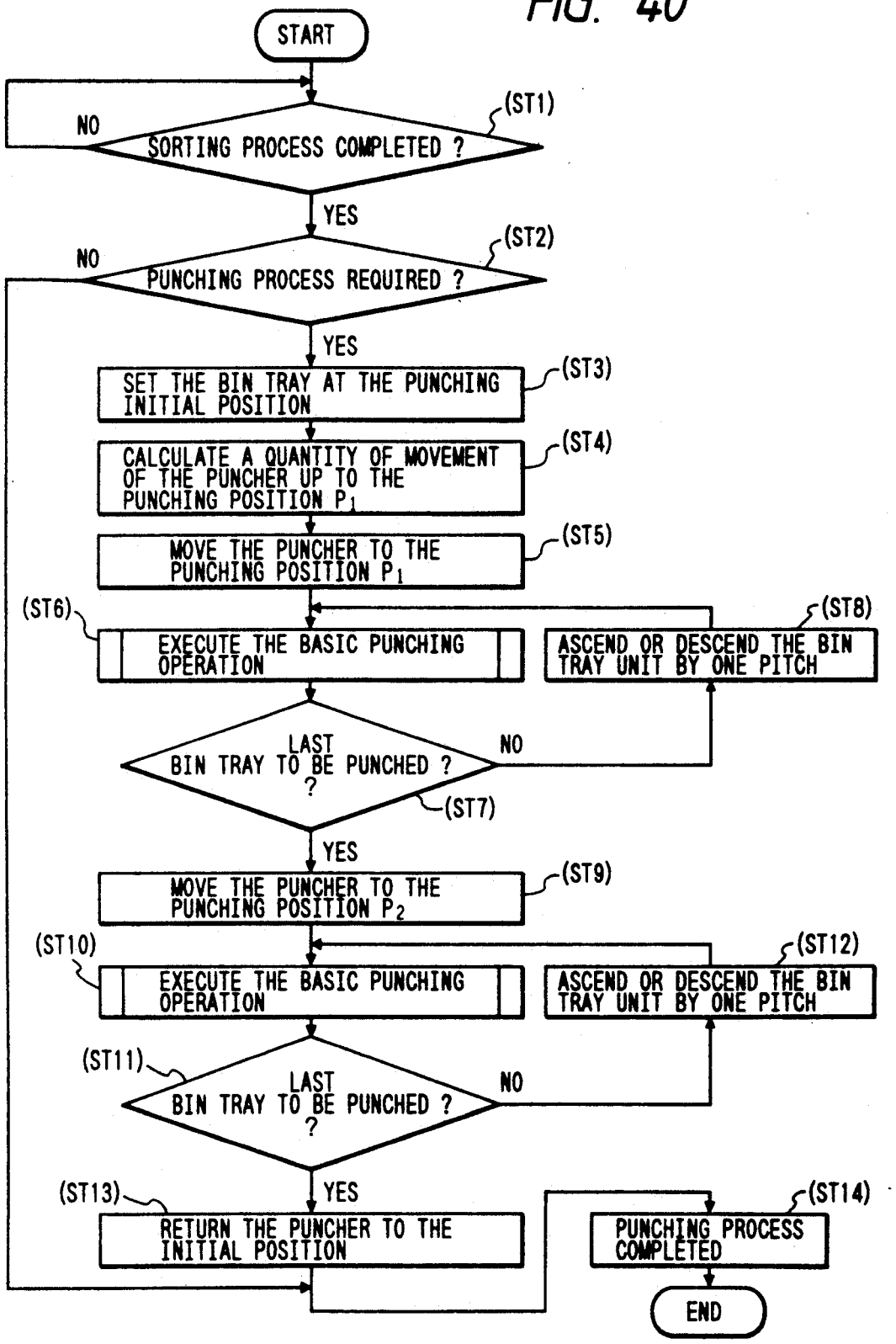
FIG. 40 is a flowchart showing a control flow for a punching process by the puncher.

An example of the punching process by the modification is shown in FIG. 40.

In the figure, the CPU 151 first judges that the sorting process has been completed (ST1), and then checks whether or not the punching process is required (ST2).

If it is required, the CPU sets the bin tray unit 40 at the punching initial position (ST3), computes or calculates quantities of puncher movements (movement quantities to two punching positions P1 and P2) according to the size of the recorded sheets 12 (ST4), and moves and sets the puncher 200 at the punching position P1.

Thereafter, the CPU executes a basic punching operation (ST6), and checks whether or not the punching processed object is the last bin tray (ST7). If it is not the last bin tray, the CPU makes the bin tray unit 40 to ascend or descend by one pitch, and to set the bin tray to be processed next at the post-processing stage S2 (ST8), and repeats the steps ST6 to ST8 till the last bin tray becomes the object to be punching-processed.

When the punching process at the punching position P1 is completed, the CPU sets the puncher 200 at the punching position P2 (ST9), executes the basic punching operation (ST10), and checks whether or not the punching-processed object is the last bin tray (ST11). If not, the CPU descends or ascends the bin tray unit 40 by one pitch to set the bin tray to be punching-processed next, at the post-processing stage S2 (ST12). Subsequently, the CPU repeats the steps ST10 to ST12 till the last bin tray becomes the object to be punching processed.

When the final punching process at the punching position P2 is completed, the CPU returns to the puncher 200 to the initial position (ST13), and decides that a series of punching processes are completed in execution (ST14).

While in the modification as mentioned above, the puncher is provided with one punching rod 204, a pair of punching rods spaced a predetermined distance from each other may be used. In this case, the puncher is moved and set at predetermined position according to the size of the recorded sheets 12 for centering the puncher. At the predetermined position, the basic punching operation is performed every bin tray 40.

5th Embodiment

A fifth embodiment of the sheet distributing system according the present invention will be described with reference to FIGS. 41(*a*) and 42 through 50.

Figure 41A:
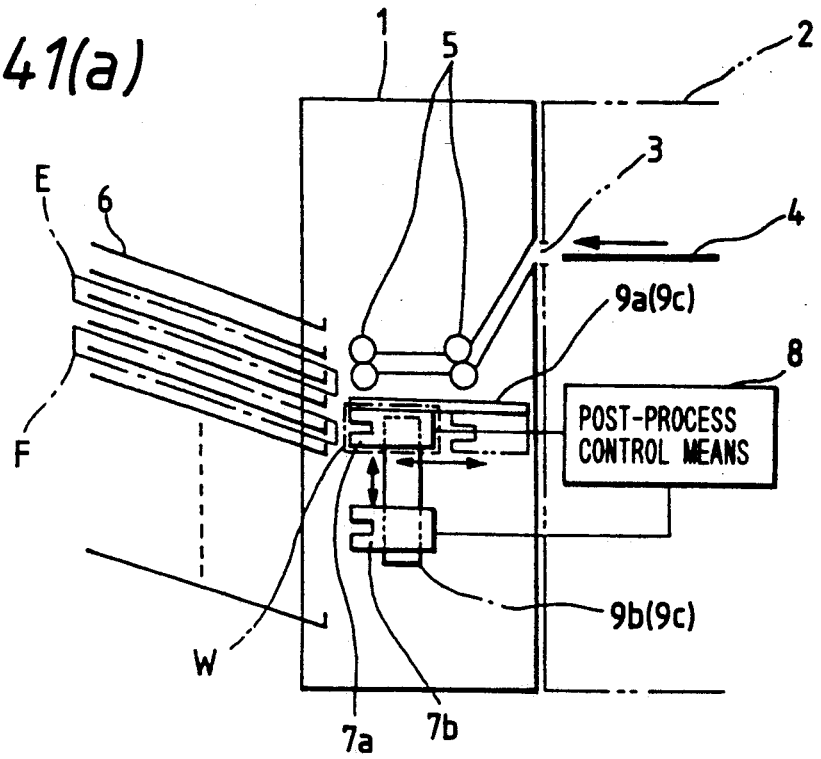
FIG. 41(*a*) is a side view showing the scheme of a fifth embodiment of the sheet distributing system according to the present invention.
Figure 41B:
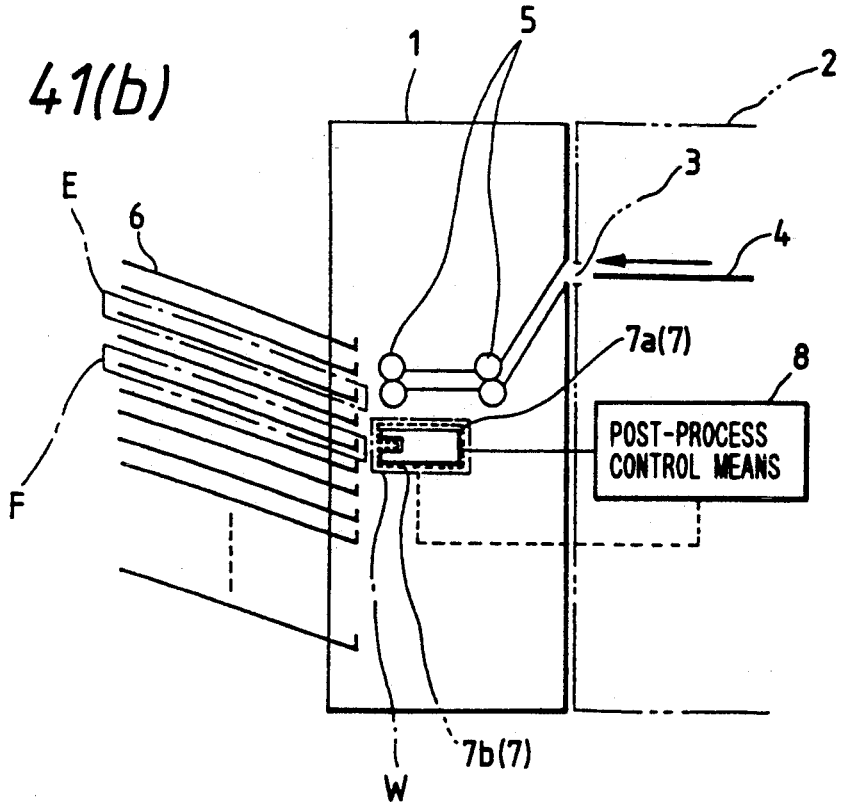
Figure 41C:
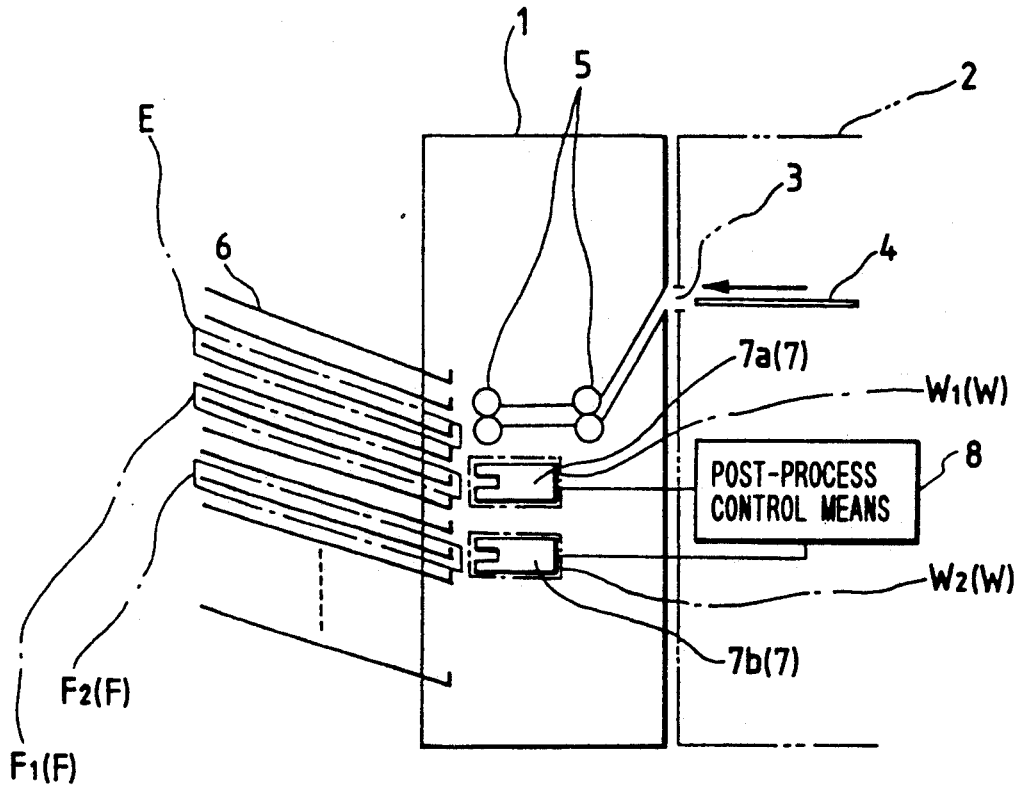

The fifth embodiment of the invention, as illustrated in FIG. 41(*a*), is based on a sheet distributing system having sheet transfer means 5, disposed within a sorter housing 1, for transferring a recorded sheet or sheets 4 discharged from a sheet exit 3 of an image recording unit 2 to a sheet distribution stage E, and a set of vertically arranged bin trays 6 on one side of the housing 1 and being moved toward the sheet distribution stage E at the distributing timings of the recorded sheets 4, whereby the recorded sheets 4 are distributed into the bin trays 6. The sheet distributing system of the embodiment comprises: a plurality of, e.g., two, interrelated post-processing units 7 (specifically 7*a* and 7*b*) located below or above the sheet transfer means 5 and selectively disposed at a post-processing set position W in a space, within the housing 1, which extends in the direction of the width of the sheet transfer means 5; unit moving means 9*c* (specifically 9*a* and 9*b*) for supporting the post-processing units 7 so as to be movable between the post-process set position W and a waiting position located out of the post-process set position W; and post-process control means 8 for setting one of the post-processing units 7 (specifically either of the post-processing units 7*a* and 7*b*) at the post-process set position W when the sheet distributing operation is completed, and causing the post-processing unit 7 (specifically post-processing units 7*a* or 7*b*) to successively apply predetermined post-processes to one side marginal portion of a stack of recorded sheets 4 being contained in the bin tray 6 at a post-processing stage F, which corresponds in position to the post-process set position W and different from the sheet distribution stage E.

The post-processing units 7 each having a single monofunction means are normally used. In the sorter of the type having a plurality of post-processed object positions, the post-processing units 7 each having a single monofunction means may be provided at the plurality of post-processed positions, respectively. To make the sorter compact or in the sorter in which the post-processed object position changes according to the size, for example, of the recorded sheets 12, it is preferable to successively move the post-processing units 7 each having a signal monofunction means to each post-processed object position. In the sorter of the type in which the plurality of post-processed object positions are fixed to one another, the post-processing units 7 may be provided with a plurality of post-processing functions corresponding to the plurality of post-processed object positions. The unit moving means 9c may be provided for each post-processing unit 7 in one-to-one correspondence manner or for the post-processing units 7 in one-to-all correspondence manner. In either case, it is essential that when the post-processing units 7 are set at the post-process set position W or the waiting position, those units do not interfere with each other.

The post-process control means 8 for causing the post-processing units 7 to execute predetermined post-processes, operates in a manner that it sets the post-processing units 7 in a post-process ready state and at the same time successively sets the bin tray 6 to be post-processed at the post-processing stage F, and then controls only the post-processing units 7 or the combination of the units and an additional mechanism (in the case of the bin tray movable type, bin tray pull-out means, for example). In this case, the post-process of a given post-processing unit 7 may be successively applied to all of the bin trays 6 or the post-processes of the post-processing units 7 may be applied to each bin tray 6.

The control functions of the post-process control means 8 may be properly selected according to the functions to be realized.

With regards to the position control of the post-process, for example, the post-process control means may stop the post-processing unit 7 at a predetermined position for post-process according to information from a position detect sensor. The post-process control means may calculate a quantity of movement of the post-processing unit 7 from the reference position according to the size of the recorded sheets 4 to be sorted, and moves the post-processing unit 7 by the calculated quantity of movement.

In the fifth embodiment, the stacked recorded sheets 4 leaving from the image recording unit 2 are successively transferred to the sheet distribution stage E by means of the sheet transfer means 5, and are distributed into the bin trays 6.

When the sorting process of the recorded sheets 4 is which extends in the direction of the width of the sheet transfer system 30. A location opposed to the stapler 100 is the post-processing stage F. Under the stapler 100 a binder 500 is retractably disposed with respect to the position W.

The stapler 100 dual-staples one side marginal portion of the stacked recorded sheets 12 contained in the bin tray 40, which is positioned at the post-processing stage F, or staples one corner of the stacked recorded sheets 12. The binder 500 tape-binds one side marginal portion of the stacked recorded sheets 12 contained in the bin tray 40, which is positioned at the post-processing stage F.

Figure 43:
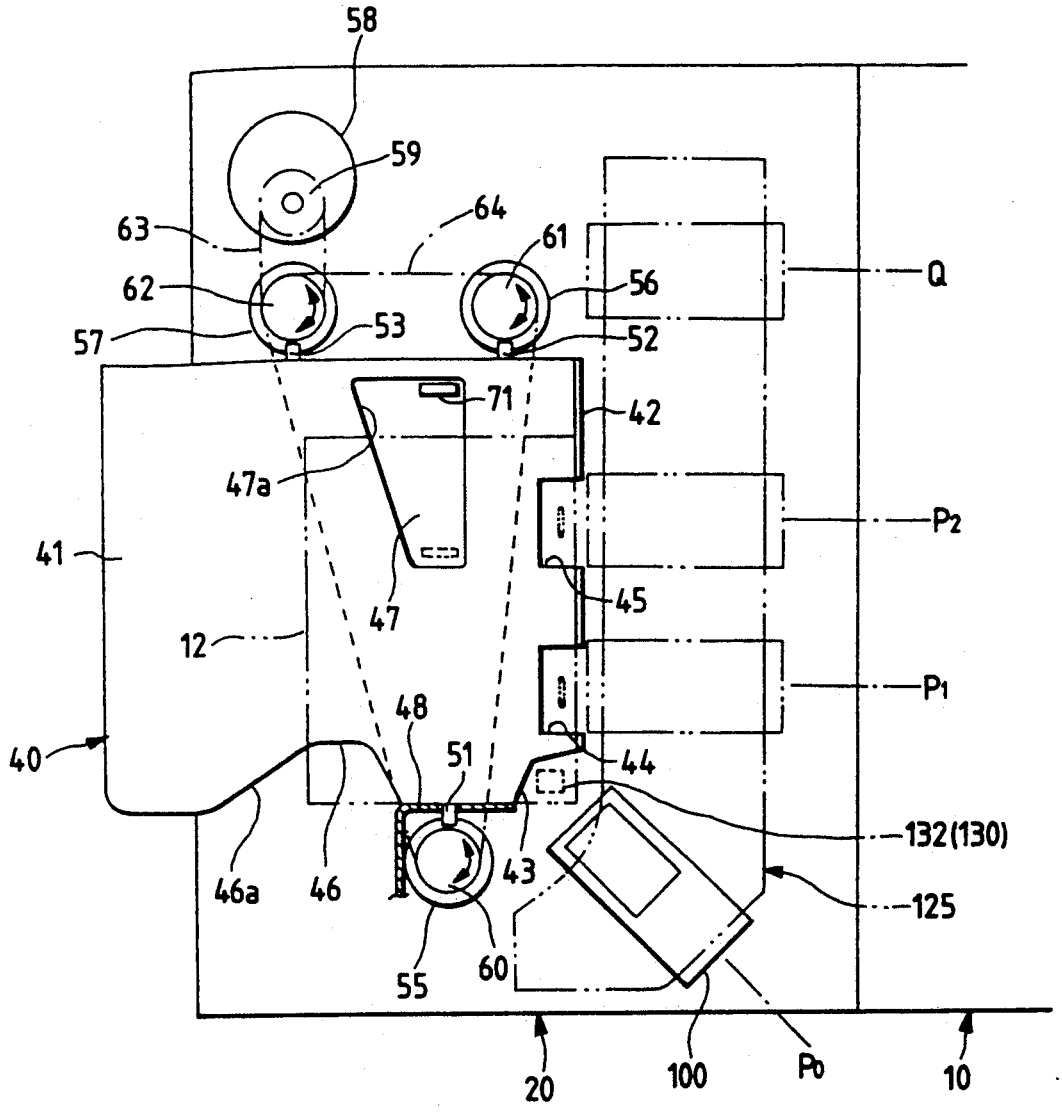
FIG. 43 is a view showing an essential portion of the sheet distributing system, in which a bin tray and a puncher movable along a guide rail are clearly illustrated.
Figure 44:
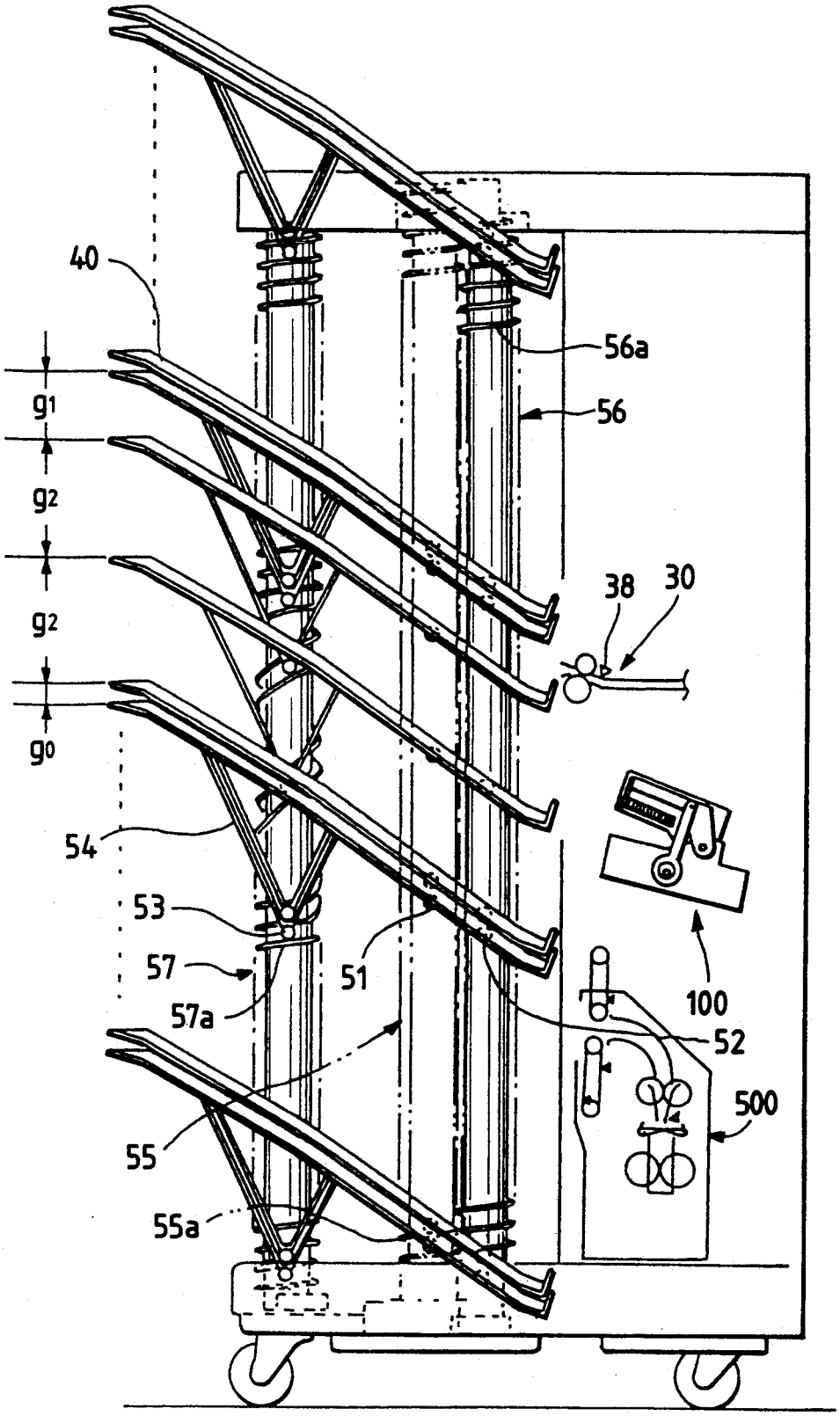
FIG. 44 is a side view showing the structure of a bin tray unit drive mechanism.

In the description to follow, reference is made to FIGS. 43 and 44. As shown, a pair of pins 51 and 52 are protruded outwardly from the opposite sides of the bin tray 40 (as viewed in its width direction) at the locations of the sides closer to the positioning flange 42. A V-shaped support arm 54 is mounted on one side of the bin tray in the location closer to the distal end of the tray 40. A pin 53 is protruded from the bottom end of the support arm 54.

Cam screws 55 to 57 are erected rotatably on the locations of the housing 21, which are respectively adjoining to the pins 51 to 53 and allocated on both sides of the bin tray as viewed in the width direction of the concavity 23. The pins 51 to 53 engage cam grooves 55a to 57a of the cam screws 55 to 57, respectively.

In this embodiment, the pitches of each of the cam completed, the post-process control means 8 sets either of the post-processing units 7, e.g., the units 7a, at the post-process set position W by means of the unit moving means 9a, successively sets the bin tray 6 to be post-processed at the post-processing stage F, and applies the post-process to the post-processed positions in one side marginal portion of the stacked recorded sheets 4 contained in the bin tray 6, by means of the post-processing unit 7a.

Then, the post-process control means 8 moves the post-processing unit 7a to the waiting position by means of the unit moving means 9a, sets another post-processing unit 7b at the post-process set position W by means of the unit moving means 9b, successively sets the bin tray 6 to be post-processed at the post-processing stage F, and applies the post-process to the post-processed positions in one side marginal portion of the stacked recorded sheets 4 contained in the bin tray 6, by means of the post-processing unit 7b.

Figure 42:
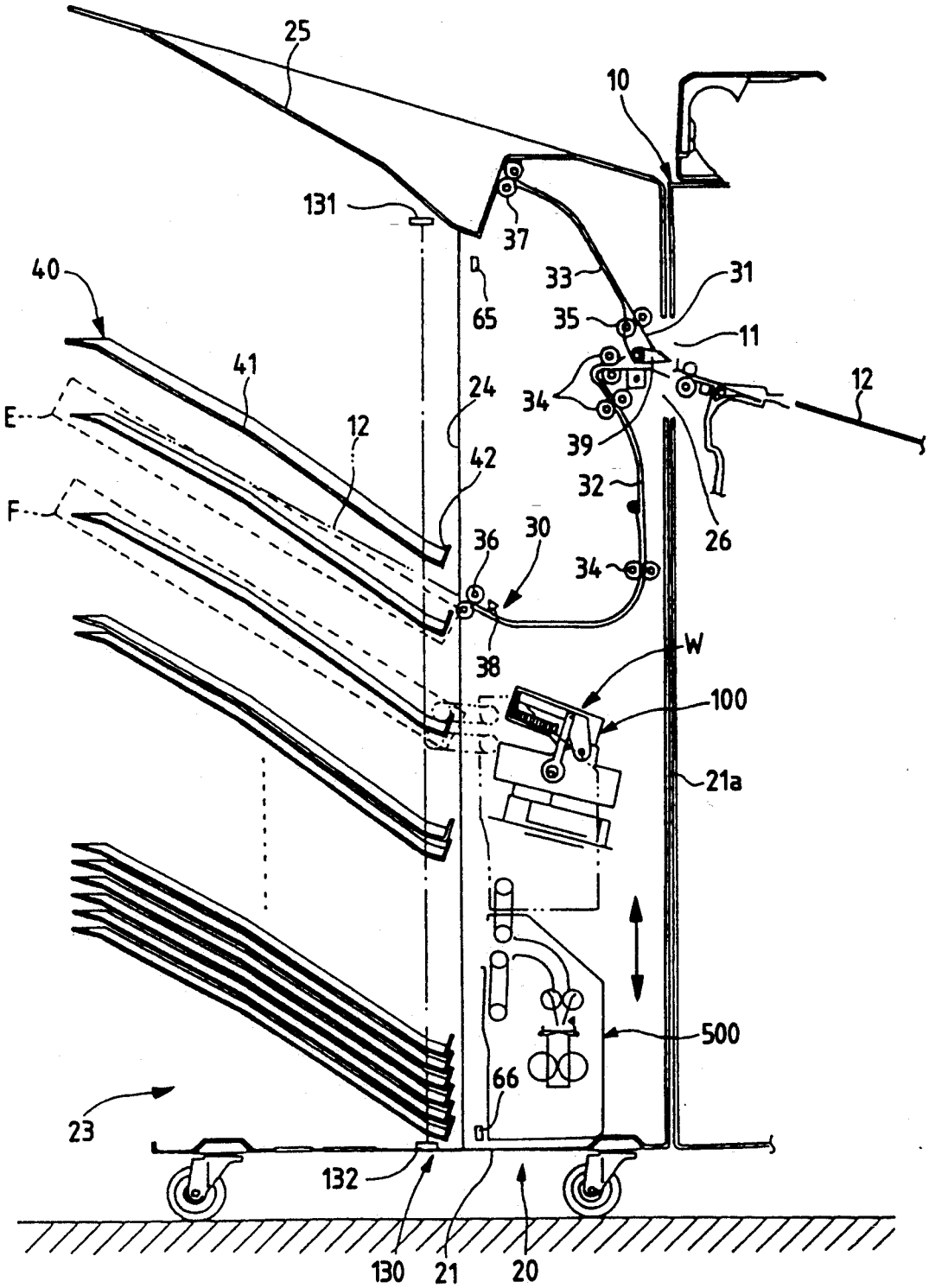
FIG. 42 is a sectional view showing the structure of the sheet distributing system of the fifth embodiment.

FIG. 42 shows a sheet distributing system (hereinafter referred to a sorter) 20 as the fifth embodiment of the invention, which is combined with a main body of a copying machine (base machine) 10 with an ADF (automatic document feeder), not shown.

Description will be given only of the portions not found in the fourth embodiment.

In FIG. 42, the stapler 100 is disposed at a post-process set position W in a space, within the housing 1, grooves 55a to 57a are not uniform, and the pitches formed in the came groove portions corresponding in position to the sheet distribution stage E and the post-processing stage F are sufficiently larger than those in the remaining portions.

To be more specific, the bin trays 40 positionally corresponding to the sheet distribution stage E and the post-processing stage F are contiguously disposed. A gap $g_1$ between the bin tray 40 positionally corresponding to the sheet distribution stage E and the bin tray 40 located above the former, and gaps $g_2$ between the bin tray 40 positionally corresponding to the post-processing stage F and the bin trays 40 above and below the former are sufficiently larger than a gap $g_0$ between the two adjacent bin trays 40 which are other than the above ones. The gaps $g_1$ and $g_2$ are selected to such values as not to obstruct the sorting process. The gap $g_0$ is selected to such a value that the bin trays 40 will not contact with each other.

Figure 45:
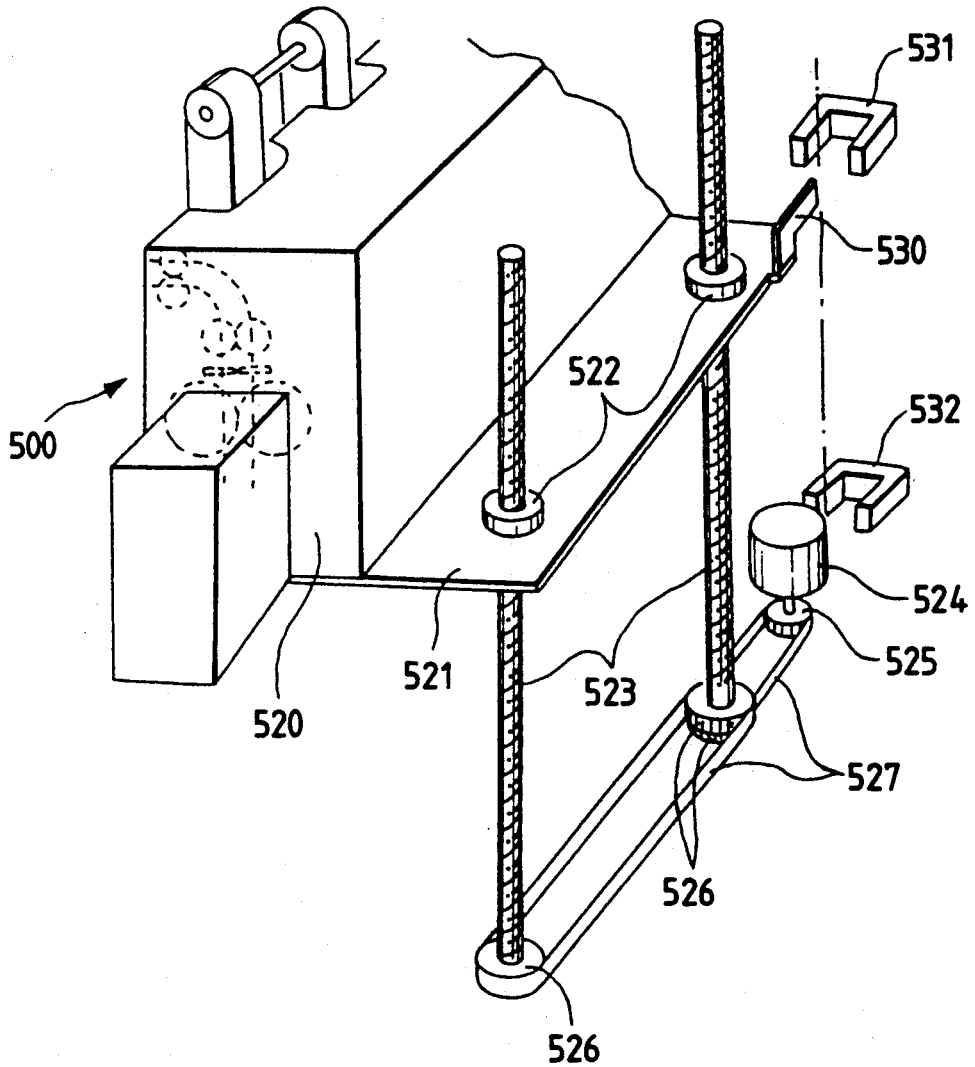
FIG. 45 is a perspective view showing a binder support mechanism.

A support mechanism of the binder 500 is as shown in FIG. 45, for example. As shown, a support flange 521 with a couple of through-holes is outwardly extended from the bottom of a case 520 of the binder 500. Nuts 522 are fitted into the through-holes, respectively. A pair of ball screw shafts 523 vertically extending are threaded into the nuts 522 and rotatably supported by bearings, not shown. A drive pulley 525 is fixed to the shaft of a reversibly rotatable lift motor 524. Pulleys 526 are fixed to the ends of the shafts 523, respectively. A timing belt 527 is wound around the pulleys 525 and 526. With the mechanism thus constructed, the binder 500 is lifted or moved up and down. The ball screws may be substituted by wires, for example, for the purpose of lifting the binder.

A binder lift regulator for the binder 500 follows. A position detect piece 530 is protruded from the flange 521. An upper stop sensor 531 and a lower stop sensor 532 are provided at the upper limit position and the lower limit position which define a range of the lift of the binder. In this embodiment, the sensors are both of the transmission type in which a light emitting element and a photodetecting element are oppositely disposed. When the position detect piece 530 reaches either the sensor 531 or 532, the drive motor 524 is stopped. The upper limit position is selected corresponding to the post-process set position W. The lower limit position is selected so that when the stapler 100 is set at the post-process set position W, it does not interfere with the stapler 100.

Figure 46:
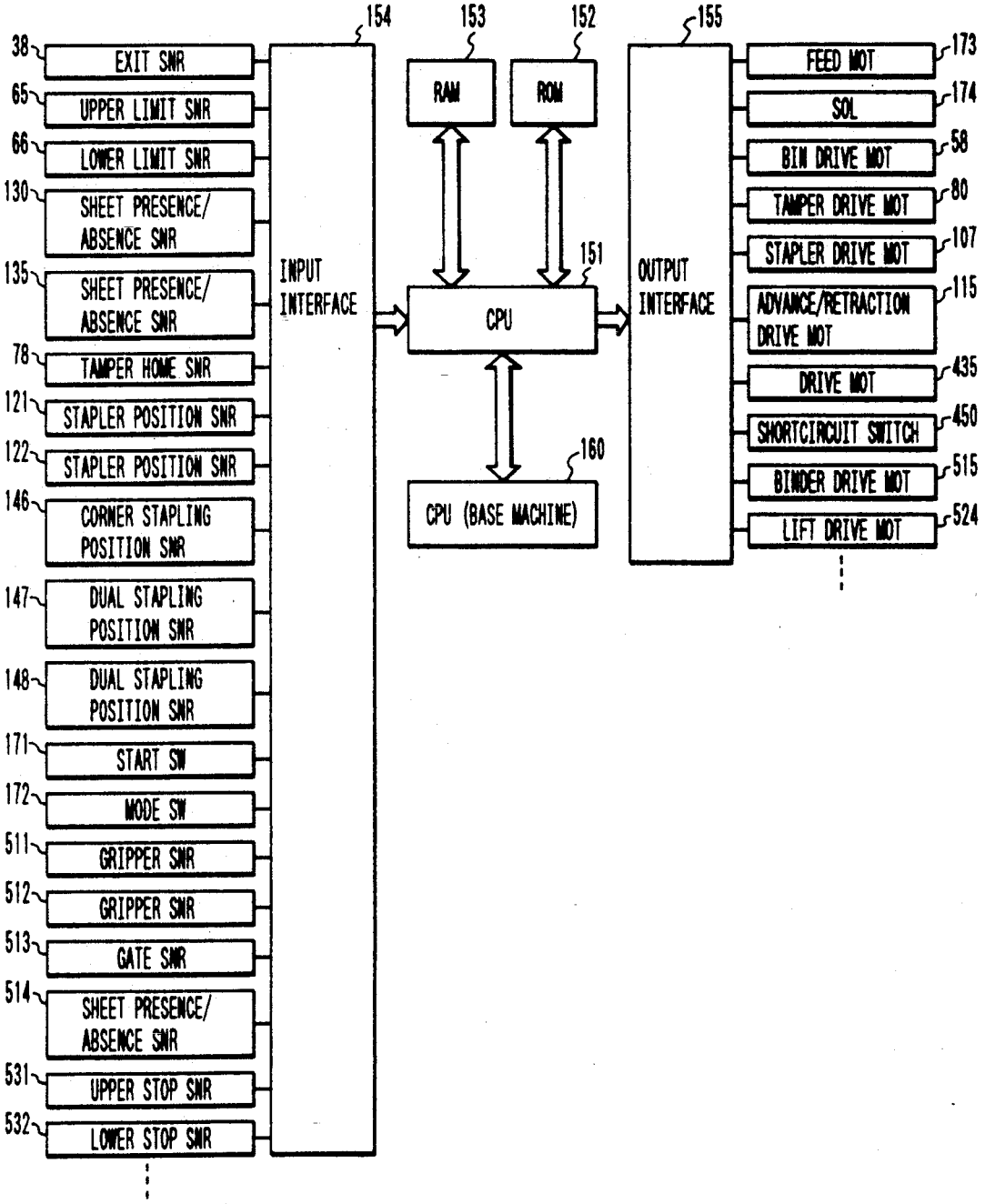
FIG. 46 is a block diagram showing a control system for the sheet distributing system.

A control system of this embodiment is constructed with a microcomputer system as shown in FIG. 46.

The control system is equivalent to the control system of the 4th embodiment shown in FIG. 35 coupled with following additional components; gripper sensors 511 and 512, a gate sensor 513, a sheet presence/absence detect sensor 514, the upper and lower stop sensors 531 and 532, which are coupled with the input interface 154, and a binder drive motor 515 for driving the respective portions of the binder 500 and the binder lift drive motor 524, which are coupled with the output interface 155.

In this embodiment, a desired processing mode is selected by a mode select switch 172, and a series of processing operations are performed according to the selected mode.

In the description to follow, it is assumed that a stapling/binding processing mode is selected, and a dual stapling mode is selected for the stapling process.

Figure 47:
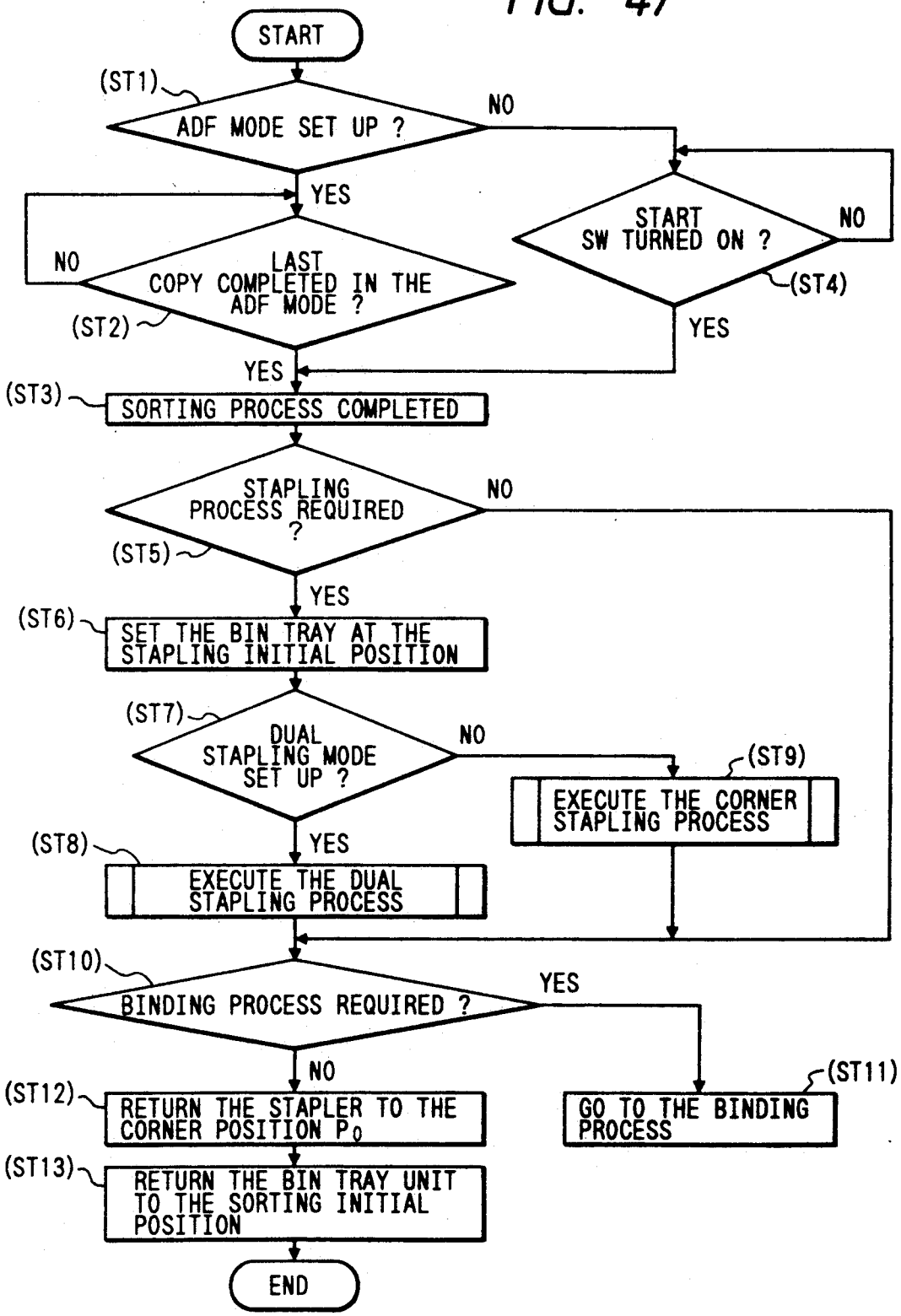
FIG. 47 is a flowchart showing a control flow for a stapling process.

A basic control flow for the bin trays 40 and the stapler 100 in the stapling mode is shown in FIG. 47.

In the control, the CPU 151 first checks whether or not the ADF mode is set up, on the basis of the data that is transferred from the CPU 160 of the base machine (ST1). If the ADF mode is set up in the base machine, the CPU checks if the last document copy by the ADF is completed (ST2). At the completion of the last document copy by the ADF, the CPU decides that the sorting process is perfectly completed (ST3). When the base machine 10 is not in the ADF mode, the CPU checks whether or not the manual start switch 171 has been turned on at the start of the stapling process (ST4). If the start switch 171 has been turned on, the CPU judges that the sorting process is perfectly completed (ST3).

Thereafter, the CPU checks whether or not the stapling process is required according to the output signal of the first sheet presence/absence detector 130 (ST5). If it is required, the bin tray unit 40 is made to descend by one pitch, thereby to set the bin tray unit 40 at the stapling initial position so that the top or first bin tray 40 or the bin tray 40 ordered corresponding to the number of sorting operations is positioned at the post-processing stage F (ST6).

Afterwards, the CPU checks if the stapling mode is the dual mode (ST7). If the dual mode is set up, the dual stapling process is executed (ST8). If the dual mode is not set up, the CPU judges that the corner mode is set up, and executes the corner stapling mode (ST9).

When a series of stapling process operations are completed or when the CPU decides in step ST5 that no stapling process is required (a logic state of the output signal of the photodetecting element 132 of the sensor 130 is high), the CPU checks if the binding process is required (ST10). If it is required, the CPU advances to the step of the binding process (ST11). If not required, the CPU reversely rotates the drive motor 435 in preparation for the next sorting process, thereby to move the carriage 431. In response to data from the position detect sensor 146, the CPU stops the drive motor 435, returns the stapler 100 to the corner stapling position (initial position in this embodiment) P0 (ST12). After it returns the respective bin trays 40 to the sorting initial position so that the top bin tray 40 is set at the sheet distributing stage E (ST13), a series of processing operations are completed.

Figure 48:
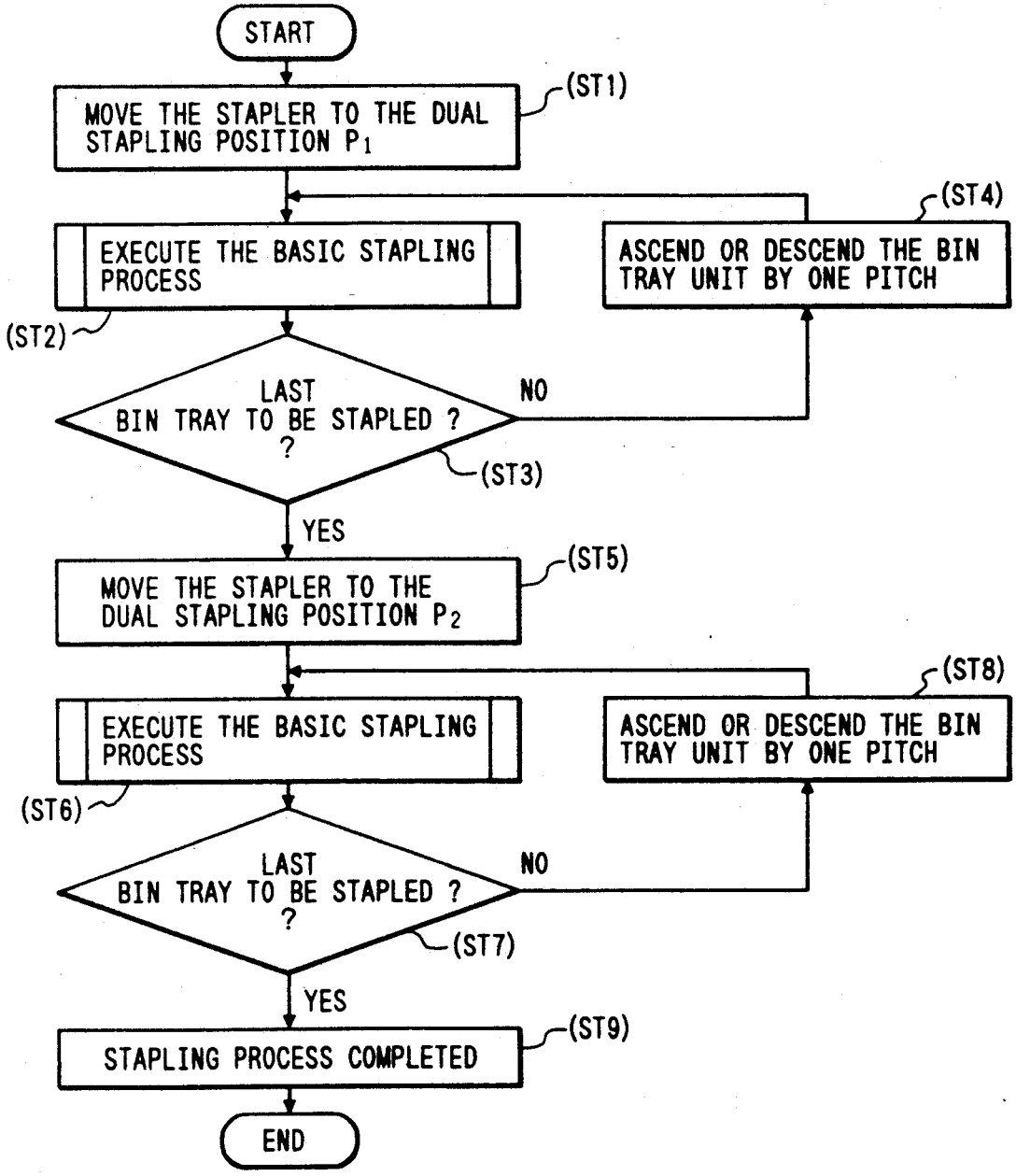
FIG. 48 is a flowchart showing a control flow for a dual stapling process.

An example of the process of step ST8 shown in FIG. 47 is shown in FIG. 48.

The CPU first drives the drive motor 435 to move the carriage 431. In response to data from the position detect sensor 147, the CPU stops the drive motor 435, returns the stapler 100 to the dual stapling position P1 (ST1).

At this stage, the CPU executes the basic stapling operation (ST2). The CPU checks if the stapling-processed object is the last bin tray (ST3). If not the last bin tray, the CPU ascends or descends the bin tray unit 40 by one pitch to set the bin tray to be processed next at the post-processing stage F (ST4), and repeats the processes from steps ST2 to ST4 until the stapling-processed object becomes the last bin tray.

When the stapling process for the last bin tray is completed, the CPU drives again the drive motor 435 to move the carriage 431, and stops the drive motor 435 on the basis of data from the position detector sensor 148, and sets the stapler 100 at the dual stapling position P2 (ST5).

At this stage, the CPU executes the basic stapling operation (ST6). The CPU checks if the stapling-processed object is the last bin tray (ST7). If not the last bin tray, the CPU descends or ascends the bin tray unit 40 by one pitch to set the bin tray to be processed next to the post-processing stage F (ST8), and repeats the processes from steps ST6 to ST8 until the stapling-processed becomes the last bin tray, the CPU judges that the stapling process has been completed (ST9).

Figure 49:
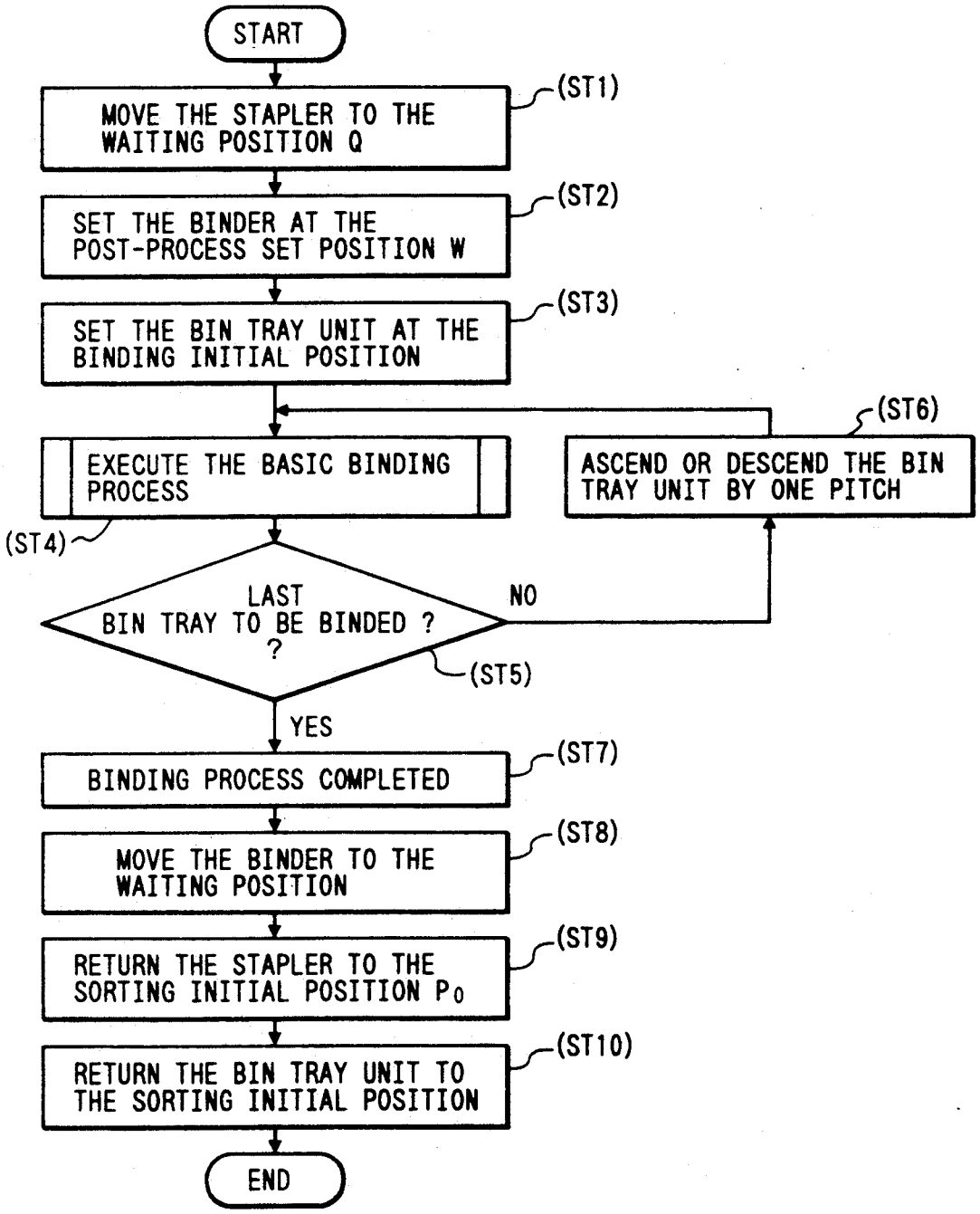
FIG. 49 is a flowchart showing a control flow for a binding process.

A basic control flow of the bin tray unit 40 and the binder 500 is shown in FIG. 49.

When the judging that the binding process is required, the CPU 151 forwardly rotates the drive motor 435 to return the stapler 100 that has been set at the dual stapling position, P2, to the waiting position Q (ST1). Then, the CPU forwardly rotates the lift drive motor 524 to lift the binder 500 up to the upper limit position and to set the binder 500 at the post-process set position W (ST2). During the course of the above process, the CPU sets the bin trays 40 at the binding initial position so that the bin tray 40 ordered corresponding to the number of the sorting operations is positioned at the post-processing state F (ST3).

At this stage, the CPU executes the basic binding operation (ST4). The CPU checks if the binding-processed object is the last bin tray (ST5). If not the last bin tray, the CPU descends the bin tray unit 40 by one pitch to set the bin tray to be processed next at the post-processing stage F (ST6), and repeats the processes from steps ST4 to ST6 until the binding-processed object becomes the last bin tray.

When the stapling process for the last bin tray is completed, the CPU judges that the stapling process has been completed (ST7) and executes the preparation work for the next sorting process.

For the preparation work, the CPU causes the binder 500 to retract to the waiting position (lower limit position) (ST8), the stapler 100 to the corner stapling position P0 (ST9), and the bin tray unit 40 to the sorting initial position (ST10).

A specific example of the binding process will be described.

Figure 50:
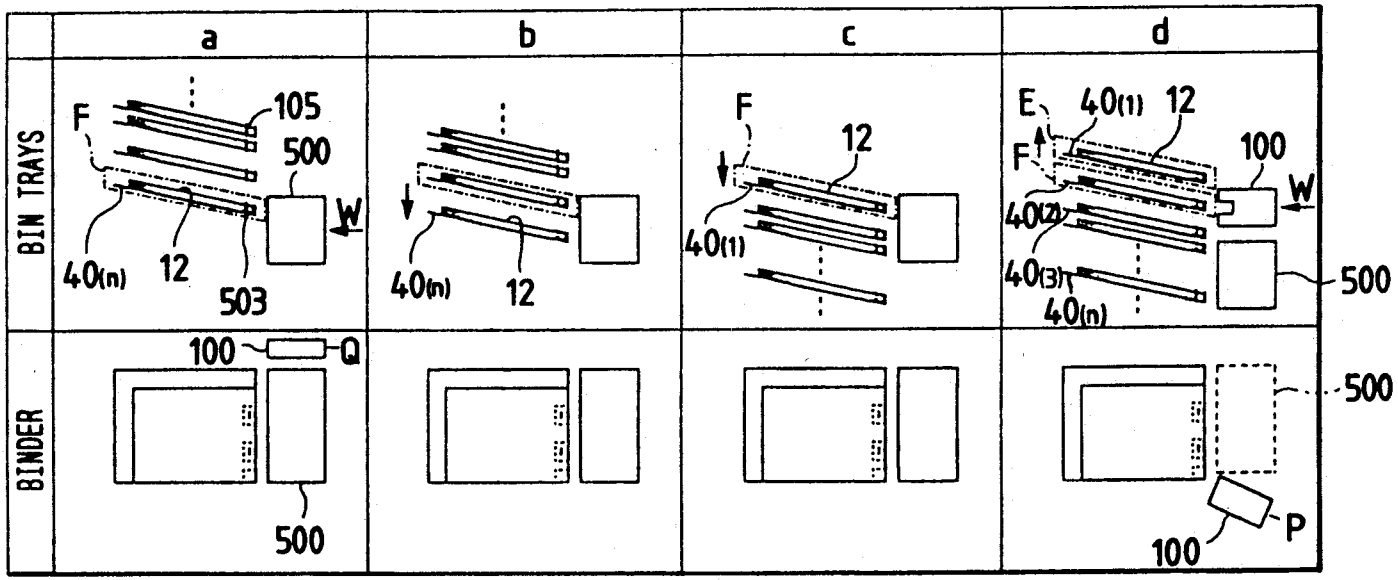
FIG. 50 shows a set of views useful in explaining the operation of the bin tray unit and the binder in a binding mode.

Upon the completion of the sorting process, the stapler 100, as shown in FIG. 50(*a*), is moved to the waiting position Q, and the binder 500 is set at the post-process set position W opposite to the post-processing stage F. Further, the bin tray unit 40 is set at the post-processing stage F where the bin tray 40(*n*) located at the stage corresponding to the "n" number of sorting operations.

Under this condition, as shown in FIGS. 50(*a*) through 50(*c*), the binder 500 successively applies the tape binding to the stacked recorded sheets stored in the bin trays 40(*n*), 40(n−1), . . . 40(1) descending on the pitch-by-pitch basis. When the tape binding applied to the last bin tray 40(1) is completed, a series of binding process operations are completed. After the binder 500 descends to the waiting position out of the post-process set position W, the stapler 100 returns to the corner stapling position P0, as shown in FIG. 50(*d*). Further, the bin tray unit 40 returns to the sorting initial position for the next sorting process.

6th Embodiment

A sixth embodiment of the sheet distributing system according the present invention will be described with reference to FIGS. 41(*b*), and 51 through 55.

The sixth embodiment of the invention is based on a sheet distributing system having sheet transfer means 5 and a set of vertically arranged bin trays 6, which is similar to those in the fifth embodiment as shown in FIG. 41(*b*). The sheet distributing system of the embodiment comprises: a plurality of, e.g., two, interrelated post-processing units 7 (specifically, 7*a* and 7*b*) located below or above the sheet transfer means 5 and disposed at a post-process set position W in a space, within the housing 1, which extends in the direction of the width of the sheet transfer means 5; and post-process control means 8 for causing the post-processing units 7 to successively apply predetermined post-processes to one side marginal portion of a stack of recorded sheets 4 being contained in the bin tray 6 at a post-processing stage F, which corresponds in position to the post-process set position W and different from the sheet distribution stage E, when the sheet distributing operation is completed .

In the sixth embodiment, after the sorting process similar to that of FIG. 41(*a*) is performed, the post-process control means 8 properly selects the post-processing unit 7*a* or 7*b* as set at the post-process set position W, successively sets the bin trays 6 to be processed at the post-processing stage F, and causes the post-processing unit 7*a* or 7*b* to apply the post-process to the positions in the one side marginal portion of the stacked recorded sheets 4 being contained in the bin tray 6 to be post-processed.

Figure 51:
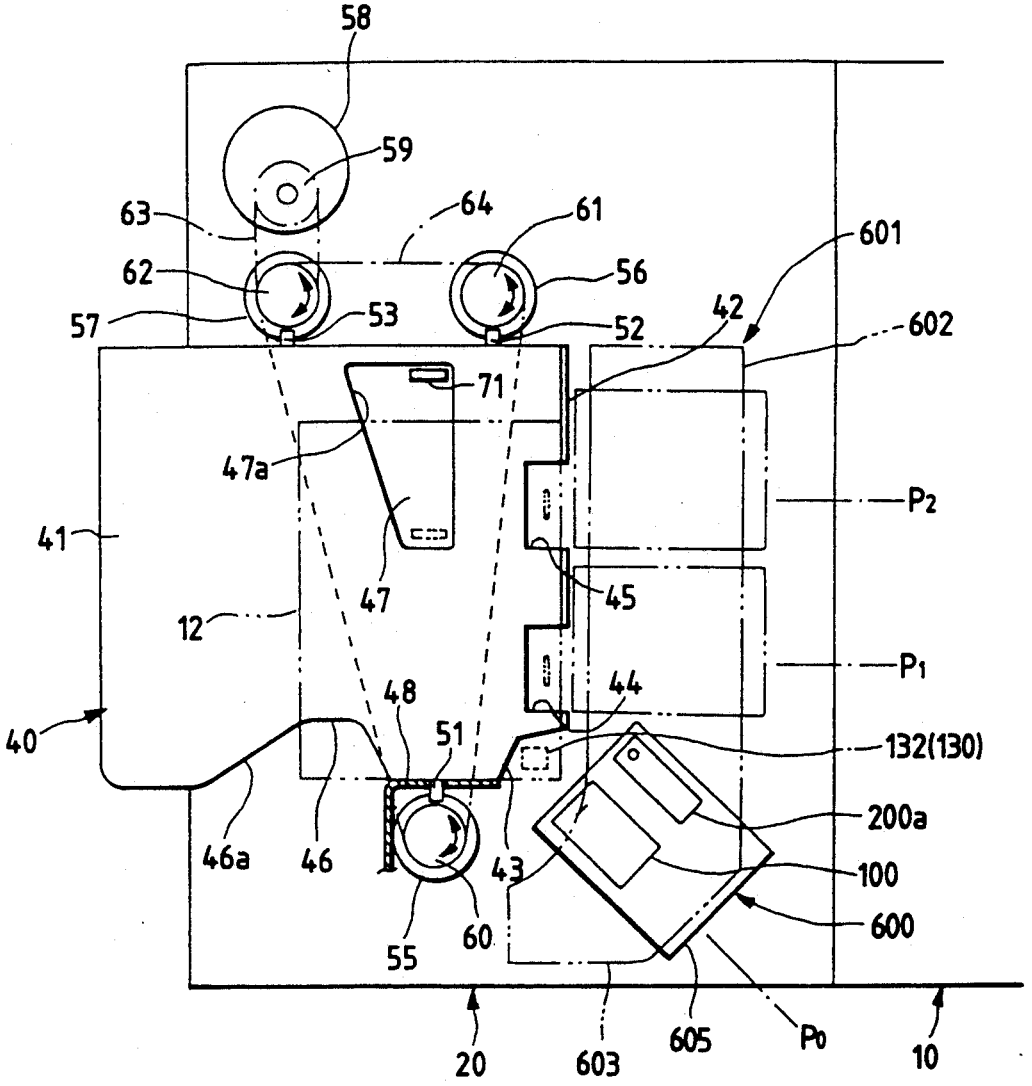
FIG. 51 is a view showing an essential portion of the sheet distributing system of the sixth embodiment, in which a bin tray and a puncher are both mounted on a single processing position moving system.

A basic construction of the 6th embodiment is same as that of the 5th embodiment except that the stapler 100 and the puncher 200*a* are both disposed at the post-process set position W opposed to the post-processing stage F, as shown in FIG. 51.

In this embodiment, the stapler 100 and the puncher 200*a*, as shown in FIG. 51, are both mounted on a single processing position moving system 600. The system 600 includes a guide rail 601 defining a moving path of the stapler 100 and the puncher 200*a*, and a carriage 605 for moving the stapler 100 and the puncher 200*a* along the guide rail 601. The CPU 151 computes quantities of movements of the stapler 100 and the puncher 200*a* according to the size of the recorded sheets 12, and properly stops the carriage 605 and selectively moves the stapler 100 and the puncher 200*a* at the processing position. The guide rail 601 includes a linear guide 602 extending along the upstanding positioning flange 42 of the bin tray unit 40 and having the width substantially equal to the width of the bin tray 40, and a curved guide 603 curved toward the corner of the cut-out 43 of the bin tray 40. The one side marginal portion of the stacked recorded sheets 12 are stapled or punched at the positions (denoted as P0, P1, and P2) corresponding in position to the cut-outs 43 to 45 of the bin tray 40 by the stapler 100 and the puncher 200*a*.

Figure 52A:
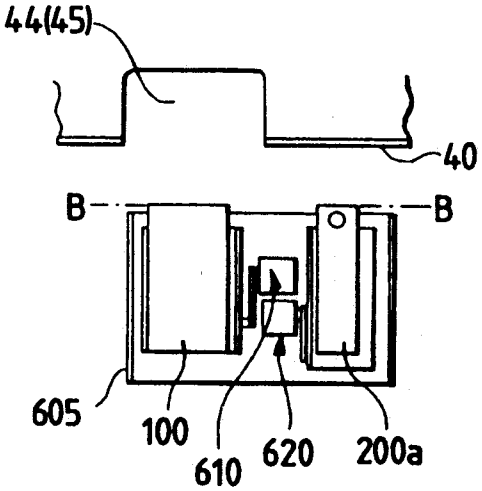
FIG. 52 shows a set of views showing a basic construction of the post-processing unit used in the sixth embodiment, and its operation.
Figure 52B:
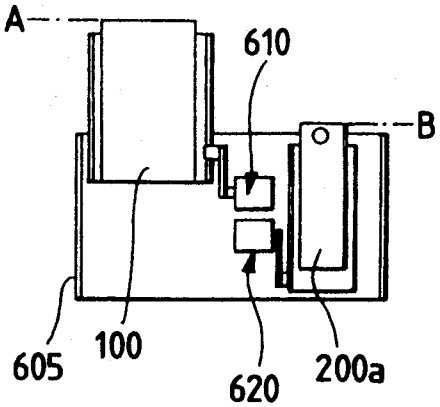
Figure 52C:
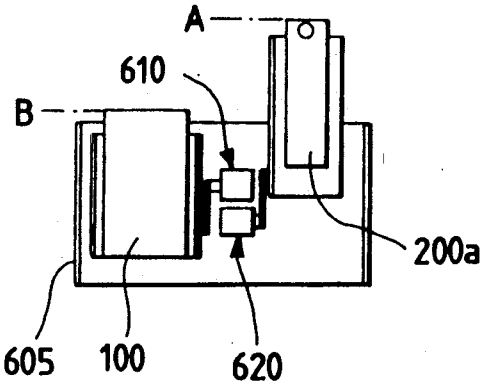

In this embodiment, the stapler 100 and the puncher 200*a*, as shown in FIG. 52(*a*), are mounted on the carriage 605, with processing position moving systems 610 and 620 intervening therebetween, and, as shown in FIGS. 52(*b*) and 52(*c*), are movable between a process executing position A and a waiting position B.

Figure 53A:
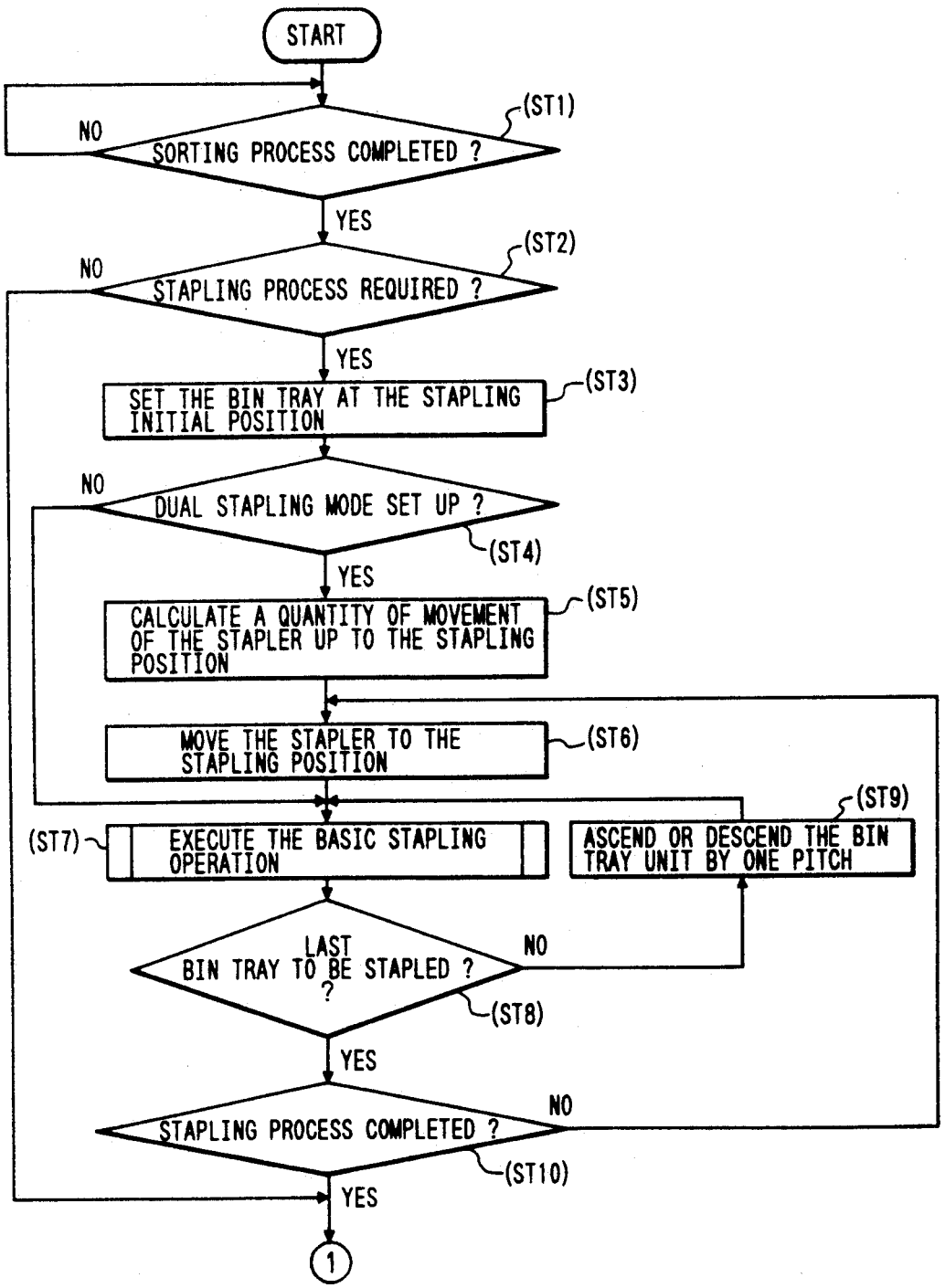
FIGS. 53(*a*) and 53(*b*) cooperate to show a post-process control flow by the sheet distributing system of the sixth embodiment.
Figure 53B:
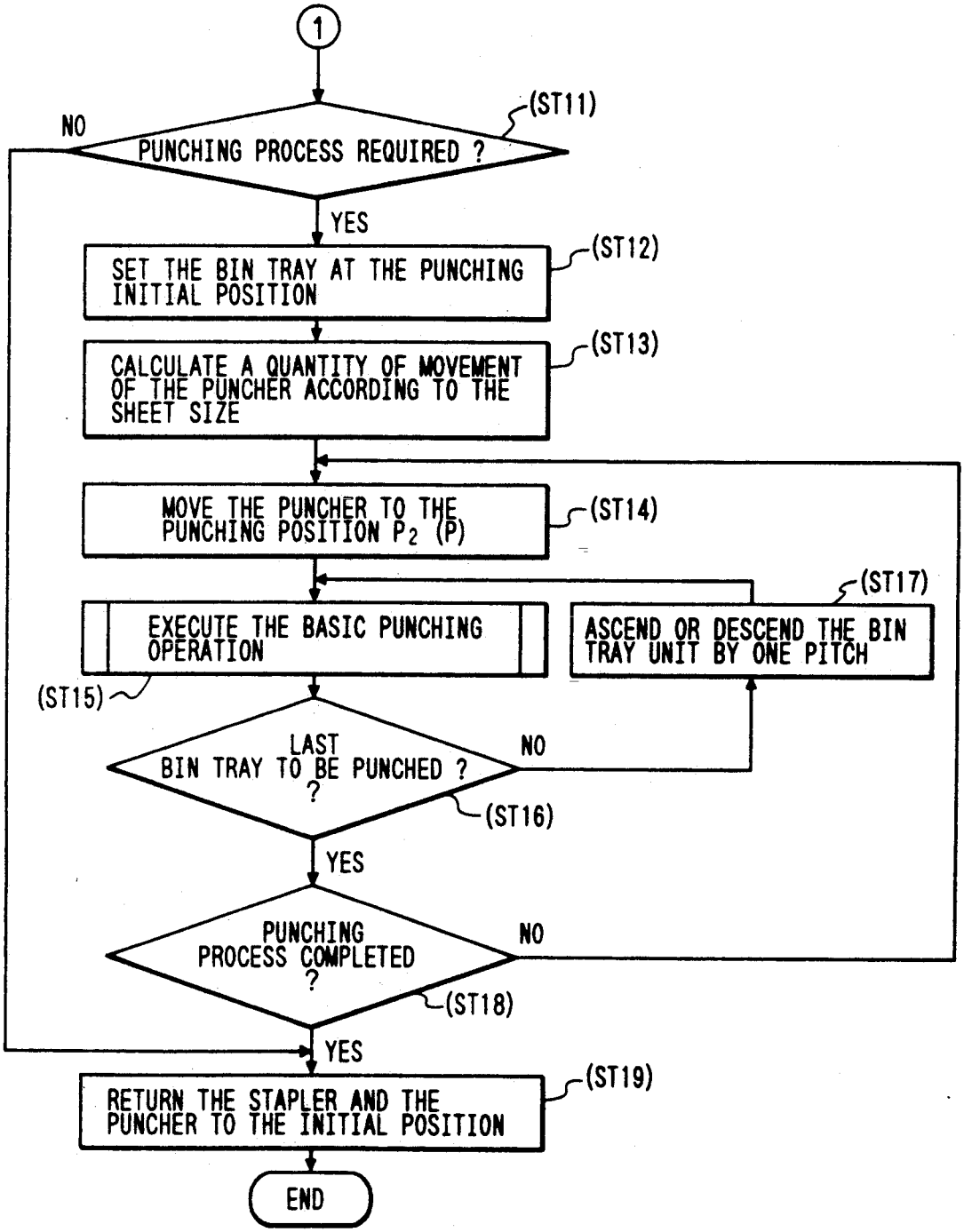

A post-process control flow of the sorter according to this embodiment, by way of example, is shown in FIGS. 53(*a*) and 53(*b*).

The CPU 151 judges that the sorting process has been completed (ST1), and checks if the stapling process is required (ST2).

If the stapling process is required, the CPU sets the bin tray unit 40 at the stapling initial position (ST3), and decides if the stapling mode is a dual mode or a corner mode (ST4).

If the stapling mode is the dual mode, the CPU computes or calculates a quantity of movement of the stapler 100 up to the stapling position P1(S) or P2(S) according to the size of the recorded sheet 12 (ST5), and moves the stapler 100 to the first stapling position P1(S) (ST6).

Thereafter, the CPU executes the basic stapling operation (ST7). The CPU checks if the stapling-processed object is the last bin tray (ST8). If not the last bin tray, the CPU ascends or descends the bin tray unit 40 by one pitch to set the bin tray 40 to be processed next at the post-processing stage F (ST9), and repeats the processes from steps ST7 to ST9 until the stapling-processed object becomes the last bin tray.

When the last stapling operation for the stapling position P1(S) is completed, the CPU checks if the stapling process has been completed (ST10). If not yet, the CPU sets the stapler 100 at the next stapling position P2(S), and repeats steps ST7 to ST9 till the stapling processes for all of the bin trays 40 have been completed.

When the stapling process is completed or when no stapling process is required in step ST2, the CPU checks if the punching process is required (ST11).

When it is required, the CPU sets the bin tray unit 40 at the punching initial position (indicates an initial position for the punching process, but is a position of the bin tray unit at the completion of the stapling process when the punching process follows the stapling process) (ST12) Then, the CPU computes or calculates a quantity of movement of the puncher (a puncher movement quantity up to two punching positions P1(P) and P2(P)) according to the size of the recorded sheets 12. The CPU first moves and sets the puncher 200*a* at the punching position P2(P) closer to the stapling position P2(S) (ST14).

Afterwards, the CPU executes the basic punching operation (ST15). The CPU checks if the punching-processed object is the last bin tray (ST16). If not the last bin tray, the CPU ascends or descends the bin tray unit 40 by one pitch to set the bin tray 40 to be processed next at the post-processing stage F (ST17), and repeats the processes from steps ST15 to ST17 until the punching-processed object becomes the last bin tray.

When the last punching operation for the punching position P2(P) is completed, the CPU checks if the punching process has been completed (ST18). If not yet, the CPU sets the puncher 200*a* to the next punching position P1(P), and repeats steps ST15 to ST17 till the punching processes for all of the bin trays 40 have been completed.

When completed, or when in step ST11, the punching process is not required, the CPU judges that all of the post-processes have been completed, and returns the stapler 100 and the puncher 200*a* to the initial position (corresponds to the corner stapling position P0 in this embodiment), and enters the preparatory work for the next sorting process (ST19).

A specific example of the post-process according to the control flow as mentioned above is shown in FIG. 54.

Figures 54A, 54B, 54C, 54D, 54E, 55A, 55B, 55C, 55D, 55E:
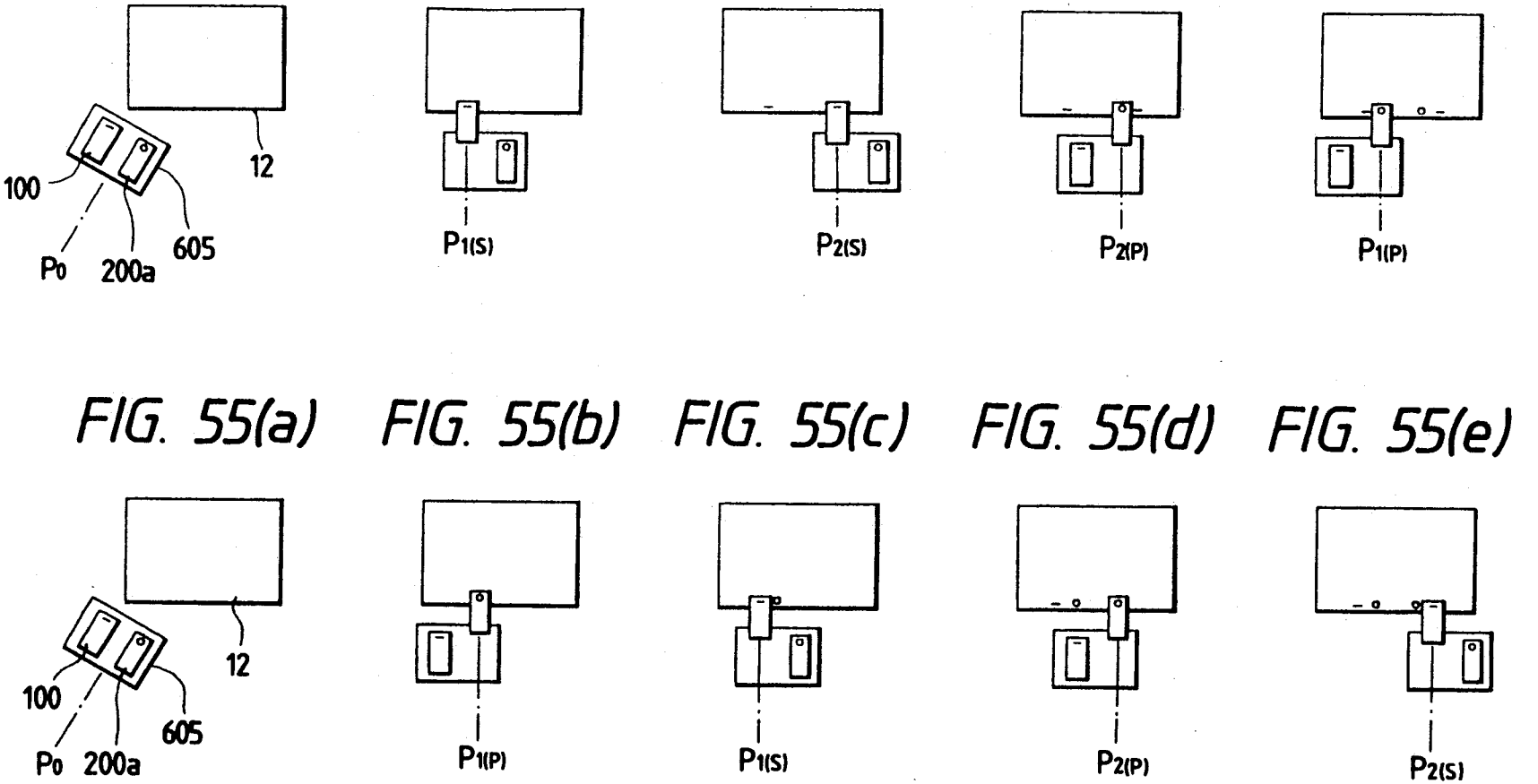
FIG. 54 shows a set of views useful in explaining a specific example of the post-processing operation according to the control flow shown in FIG. 53.
FIG. 55 shows a set of views useful in explaining a modification of the post-processing operation.

At the start of the post-process, as shown in FIG. 54(*a*), the stapler 100 and the puncher 200*a* are at the initial position P0.

Under this condition, the CPU first moves the stapler 100 to the first stapling position P1(S) and sets it thereat, and executes the stapling process for each bin tray 40 (FIG. 54(*b*)). Then, The CPU moves the stapler 100 to the second stapling position P2(S) and sets it thereat, and executes the stapling process for each bin tray 40 (FIG. 54(*c*)). Then, the CPU sets the puncher 200*a* at the second punching position P2(P), and executes the punching process for each bin tray 40 (FIG. 54(*d*)). Subsequently, the CPU sets the puncher 200*a* at the first punching position P1(P), executes the punching process for each bin tray 40 (FIG. 54(*e*)), and returns the stapler 100 and the puncher 200*a* to the initial position P0.

During such processes, the stapling process is first performed. Therefore, the stacked recorded sheets 12 will be stably held when the punching process progresses, and hence the stacked recorded sheets can be punched at exact positions.

One of the possible modifications of the sorter according to this embodiment is shown in FIG. 55.

At the start of the post-process, as shown in FIG. 55(*a*), the stapler 100 and the puncher 200*a* are at the initial position P0.

Under this condition, the CPU first moves the puncher 200*a* to the first punching position P1(P) and sets it thereat, and executes the punching process for each bin tray 40 (FIG. 55(*b*)). Then, it moves the stapler 100 to the first stapling position P1(S) and sets it thereat, and executes the stapling process for each bin tray 40 (FIG. 55(*c*)). Then, it sets the puncher 200*a* at the second punching position P2(P), and executes the punching process for each bin tray 40 (FIG. 55(*d*)). Subsequently, it sets the puncher 200*a* at the second punching position P2(P), executes the punching process for each bin tray 40 (FIG. 55(*e*)), and returns the stapler 100 and the puncher 200*a* to the initial position P0.

During such processes, the post-process is executed directed upstream of the moving path of the puncher 200*a* or the stapler 100. Therefore, the moving distance of the puncher 200*a* and the stapler 100 may be minimized, and consequently the time taken for the movement of the puncher and the stapler may be reduced.

7th Embodiment

A seventh embodiment of the sheet distributing system according the present invention will be described with reference to FIGS. 41(*c*) and 56.

The seventh embodiment of the invention is based on a sheet distributing system having sheet transfer means 5 and a set of vertically arranged bin trays 6, which are similar to those of the 5th embodiment as shown in FIG. 41(*c*) The sheet distributing system of the embodiment comprises: a plurality of, e.g., two, interrelated post-processing units 7 (specifically, 7*a* and 7*b*) located below or above the sheet transfer means 5 and disposed at a plurality of post-process set positions W (specifically, W1 and W2) in a space, within the housing 1, which extends in the direction of the width of the sheet transfer means 5; and post-process control means 8 for causing the post-processing units 7 to successively apply predetermined post-processes to one side marginal portion of a stack of recorded sheets 4 being contained in the bin tray 6 at a plurality of post-processing stages F (specifically, F1 and F2), which correspond in position to the plurality of post-process set positions W and differ from the sheet distribution stage E, when the sheet distributing operation is completed.

In the seventh embodiment, after the sorting process similar to that in FIG. 41(*a*) is performed, the post-process control means 8 selects the post-processing unit 7*a* as set at the post-process set position W1, successively sets the bin trays 6 to be processed at the post-processing stage F1, and causes the post-processing unit 7*a* to apply the post-process to the post-processed positions in the one side marginal portion of the stacked recorded sheets 4 being contained in the bin tray 6. Then, the post-process control means 8 selects the post-processing unit 7*b* as set at the post-process set position W2, successively sets the bin trays 6 to be processed at the post-processing stage F2, and causes the post-processing unit 7*b* to apply the post-process to the post-processed positions in the one side marginal portion of the stacked recorded sheets 4 being contained in the bin tray 6.

Figure 56:
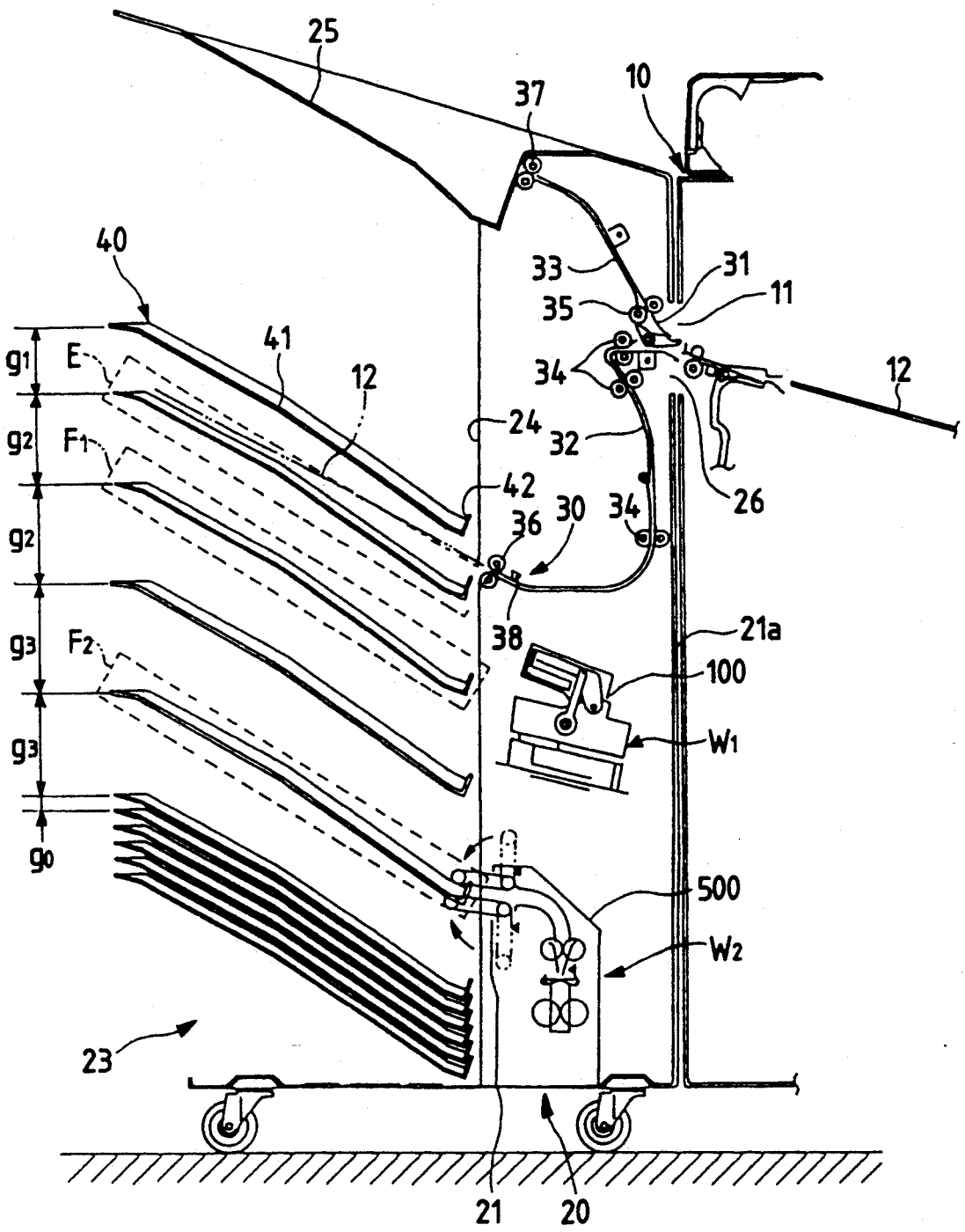
FIG. 56 is a side view showing the scheme of the seventh embodiment of the sheet distributing system according to the present invention.

A basic construction of the seventh embodiment is same as that of the 5th embodiment except the following points; The stapler 100 like that of the 5th embodiment is disposed at the first post-process set position W1 in a space, within the housing 1, which extends in the direction of the width of the sheet transfer means 5. The location opposed to the stapler 100 is the first post-processing stage F1, as shown in FIG. 56. The second post-process set position W2 is provided under the first post-process set position W1. The binder 500 like that of the 5th embodiment is disposed at the second post-process set position W2. The location opposed to the binder 500 is the second post-processing stage F2.

To be more specific, the bin trays 40 corresponding in position to the sheet distribution stage E and the post-processing stage F1 are contiguously disposed. The bin trays 40 corresponding in position to the post-processing stages F1 and F2 are alternately disposed. A gap $g_1$ between the bin tray 40 corresponding in position to the sheet distribution stage E and the bin tray 40 located above the former, gaps $g_2$ between the bin tray 40 corresponding in position to the post-processing stage F1 and the bin trays 40 above and below the former, and gaps $g_3$ between the bin tray 40 corresponding in position to the post-processing stage F2 and the bin trays 40 above and below the former are sufficiently larger than a gap $g_0$ between the two adjacent bin trays 40 which are other than the above ones. The gap $g_1$ is selected to such a value as not to obstruct the sorting process. The gap $g_2$ is selected to such a value as not to obstruct the stapling process. The gap $g_3$ is selected to such a value as not to obstruct the binding process. The gap $g_0$ is selected to such a value that the bin trays 40 will not contact with each other.

In the sorter thus constructed, if a stapling/binding processing mode, for example, is selected at the completion of a series of sorting processing operations, the stapler 100 applies the stapling processes to all of the bin trays 40 at the first post-processing stage F1. Then, the binder 500 applies the binding processes to all of the bin trays 40 at the second post-processing stage F2.

The foregoing description of preferred embodiments of the invention have been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A sheet distributing system comprising:

sheet transfer means, disposed within a housing, for transferring recorded sheets discharged from a sheet exit of an image recording unit to a sheet distribution stage;

a set of vertically arranged bin trays on one side of the housing and being moved toward the sheet distribution stage at the distributing timings of the recorded sheets, whereby the recorded sheets are distributed into the bin trays;

a plurality of interrelated post-processing units located below the sheet transfer means and selectively disposed at a post-process set position in a space, within the housing, which extends in the direction of the width of the sheet transfer means;

unit moving means for supporting the post-processing units so as to be movable between the post-process set position and a waiting position located out of the post-process set position; and post-process control means for setting one of the post-processing units at the post-process set position when the sheet distributing operation has been completed, and for causing the selected post-processing unit to successively apply a predetermined post-processes to one side marginal portion of a stack of the recorded sheets being contained in each of the bin trays at a post-processing stage, which corresponds in position to the post-process set position and differs from the sheet distribution stage.

2. A sheet distributing system according to claim 1, wherein a plurality of positions for post-processing are provided where the post-processing unit set at the post-process set position executes a given post-process, wherein the post-processing unit is supported so as to be movable at least in the width direction of the sheet transfer means by process position moving means, and wherein the post-process control means controls the post-processing unit in a manner that the post-process control means successively sets the post-processing unit at the plurality of positions for post-processing and causes the post-processing unit to successively execute the given post-process.

3. A sheet distributing system according to claim 1, wherein said post-processing units each includes sheet presence/absence detecting means for detecting whether a recorded sheet or sheets are present or absent in the bin tray to be post-processed at the post-processing stage, and wherein said post-process control means cancels the post-processing operation to the recorded sheets in the bin tray to be post-processed and immediately moves the bin tray to be post-processed next to the post-processing stage, when said sheet presence/absence detecting means detects that no recorded sheet is present in the bin tray to be post-processed.

4. A sheet distributing system comprising:

sheet transfer means, disposed within a housing, for transferring recorded sheets discharged from a sheet exit of an image recording unit to a sheet distribution stage;

a set of vertically arranged bin trays on one side of the housing and being moved toward the sheet distribution stage at the distributing timings of the recorded sheets, whereby the recorded sheets are distributed into the bin trays;

a plurality of interrelated post-processing units located below the sheet transfer means and disposed at a post-process set position in a space, within the housing, which extends in the direction of the width of the sheet transfer means; and post-process control means for causing the post-processing units to successively apply predetermined post-processes to one side marginal portion of a stack of the recorded sheets being contained in each of the bin trays at a post-processing stage, which corresponds in position to the post-process set position and differs from the sheet distribution stage, when the sheet distributing operation has been completed.

5. A sheet distributing system according to claim 4, wherein a plurality of positions for post-processing are provided where the post-processing unit set at the post-process set position executes a given post-process, wherein the post-processing unit is supported so as to be movable at least in the width direction of the sheet transfer means by process position moving means, and wherein the post-process control means controls the post-processing unit in a manner that the post-process control means successively sets the post-processing unit at the plurality of positions for post-processing and causes the post-processing unit to successively execute the given post-process.

6. A sheet distributing system according to claim 4, wherein said post-processing units each includes sheet presence/absence detecting means for detecting whether a recorded sheet or sheets are present or absent in the bin tray to be post-processed at the post-processing stage, and wherein said post-process control means cancels the post-processing operation to the recorded sheets in the bin tray to be post-processed and immediately moves the bin tray to be post-processed next to the post-processing stage, when said sheet presence/absence detecting means detects that no recorded sheet is present in the bin tray to be post-processed.

7. A sheet distributing system comprising:

sheet transfer means, disposed within a housing, for transferring recorded sheets discharged from a sheet exit of an image recording unit to a sheet distribution stage;

a set of vertically arranged bin trays on one side of the housing and being moved toward the sheet distribution stage at the distributing timings of the recorded sheets, whereby the recorded sheets are distributed into the bin trays;

a plurality of interrelated post-processing units located below or above the sheet transfer mean and disposed at a plurality of post-process set positions in a space, within the housing, which extends in the direction of the width of the sheet transfer means; and post-process control means for causing the post-processing units to successively apply predetermined post-processes to one side marginal portion of a stack of the recorded sheets being contained in each of the bin trays at a plurality of post-processing stages, which correspond in position to the plurality of post-process set positions and differ from the sheet distribution stage, when the sheet distributing operation has been completed.

8. A sheet distributing system according to claim 7, wherein a plurality of positions for post-processing are provided where the post-processing unit set at the post-process set position executes a given post-process, wherein the post-processing unit is supported so as to be movable at least in the width direction of the sheet transfer means by process position moving means, and wherein the post-process control means controls the post-processing unit in a manner that the post-process control means successively sets the post-processing unit at the plurality of positons for post-processing and causes the post-processing unit to successively execute the given post-process.

9. A sheet discharging system according to claim 7, wherein said post-processing units each includes sheet presence/absence detecting means for detecting whether a recorded sheet or sheets are present or absent in the bin tray to be post-processed at the post-processing stage, and wherein said post-process control means cancels the post-processing operation to the recorded sheets in the bin tray to be post-processed and immediately moves the bin tray to be post-processed next to the post-processing stage, when said sheet presence/absence detecting means detects that no recorded sheet is present in the bin tray to be post-processed.

10. A sheet distributing system comprising:

sheet transfer means, disposed within a housing, for transferring recorded sheets discharged from a sheet exit of an image recording unit to a sheet distribution stage;

a set of vertically arranged bin trays on one side of the housing and being moved toward the sheet distribution stage at the distributing timings of the recorded sheets, whereby the recorded sheets are distributed into the bin trays;

a stapler located below the sheet transfer means and disposed in a space, within the housing, which extends in the direction of the width of the sheet transfer means;

moving means for moving the stapler in a direction of the width of the sheet transfer means, including a linear guide portion extending along one side of the stacked recorded sheets contained in the bin trays, and a curved guide portion curving toward one corner of the stacked recorded sheets contained in the bin trays; and control means for moving the stapler to a predetermined position for stapling, and for causing the stapler to successively apply a staple to one side marginal portion of a stack of recorded sheets being contained in each of the bin trays at a post-processing stage different from the sheet distribution stage, when the sheet distributing operation has been completed.

11. A sheet distributing system comprising:

sheet transfer means, disposed within a housing, for transferring recorded sheets discharged from a sheet exit of an image recording unit to a sheet distribution stage;

a set of vertically arranged bin trays on one side of the housing and being moved toward the sheet distribution stage at the distributing timings of the recorded sheets, whereby the recorded sheets are distributed into the bin trays;

a post-processing unit located below the sheet transfer means and disposed in a space, within the housing, which extends in the direction of the width of the sheet transfer means;

moving means for moving the post-processing unit to a plurality of post-processing positions in a linear direction along the width of the sheet transfer means; and post-processing control means for moving the post-processing unit to a predetermined one of the post-processing positions, and for causing the post-processing unit to successively apply a predetermined post-process to one side margin portion of a stack of recorded sheets being contained in each of the bin trays at a post-processing stage different from the sheet distribution stage, when the sheet distributing operation has been completed.

12. A sheet distributing system according to claim 11, wherein said post-processing unit includes a dual stapler for stapling one side marginal portion of stacked recorded sheets at two positions distanced each other and a corner stapler for stapling one corner of stacked recorded sheets, and wherein said post-process control means controls one of said staplers that is selected by select means.

13. A sheet distributing system according to claim 11, wherein the post-processing stage is disposed close to the sheet distribution stage.

14. A sheet distributing system according to claim 11, further comprising a unit element for causing the post-processing unit to advance toward the bin trays in a post-processing mode, wherein moving means for the bin trays secures a first gap between the bin tray positioned at the sheet distribution stage and the bin tray located above the former, said first gap allowing the sheet distribution operation by the sheet transfer means, secures a second gap between the bin tray to be post-processed positioned at the post-processing stage and the bin trays located above and below the former, said second gap allowing an advancing motion of the unit element, and secures gaps between the adjacent bins trays in the remaining ones being set to be as narrow as possible.

15. A sheet distributing system according to claim 11, wherein said post-processing unit includes sheet presence/absence detecting means for detecting whether a recorded sheet or sheets are present or absent in the bin tray to be post-processed at the post-processing stage, and wherein said post-process control means cancels the post-processing operation to the recorded sheets in the bin tray to be post-processed and immediately moves the bin tray to be post-processed next to the post-processing stage, when said sheet presence/absence detecting means detects that no recorded sheet is present in the bin tray to be post-processed.

16. A sheet distributing system according to claim 11, wherein the post-processing unit is moved to and set at a plurality of positions for post-processing, and executes the post-process at each of the positions for post-processing, and wherein the post-process control means controls the post-processing unit in a manner that when the post-processing unit is moved to and set at one position for post-processing, the post-processing unit successively applies the post-process to the stacked recorded sheets contained in each of the bin trays, at said one position for post-processing.

17. A sheet distributing system comprising:

sheet transfer means, disposed within a housing, for transferring recorded sheets discharged from a sheet exit of an image recording unit to a sheet distribution stage;

a set of vertically arranged bin trays on one side of the housing and being moved toward the sheet distribution stage at the distributing timings of the recorded sheets, whereby the recorded sheets are distributed into the bin trays;

a plurality of post-processing units located below the sheet transfer means and disposed in a space, within a housing, which extends in the direction of the width of the sheet transfer means, said plurality of post-processing units linearly moveable along one side marginal portion of said sheets;

post-process control means for causing the post-processing units to successively apply predetermined post-processes to one side marginal portion of a stack of recorded sheets being contained in each of the bin trays at a post-processing stage different from the sheet distribution stage, when the sheet distributing operation has been completed; and a unit element for causing the post-processing units to advance toward the bin trays in a post-processing mode, wherein moving means for the bin trays secures a first gap between the bin tray positioned at the sheet distribution stage and the bin tray located above the former, said first gap allowing the sheet distribution operation by the sheet transfer means, secures a second gap between the bin tray to be post-processed positioned at the post-processing stage and the bin trays located above and below the former, said second gap allowing an advancing motion of the unit element, and secures gaps between the adjacent bin trays in the remaining ones being set to be as narrow as possible.

18. A sheet distributing system according to claim 17, wherein said plurality of post-processing units include sheet presence/absence detecting means for detecting whether a recorded sheet or sheets are present or absent in the bin tray to be post-processed at the post-processing stage, and wherein said post-process control means cancels the post-processing operation to the recorded sheets in the bin tray to be post-processed and immediately moves the bin tray to be post-processed next to the post-processing stage, when said sheet presence/absence detecting means detects that no recorded sheet is present in the bin tray to be post-processed.

* * * * *

UNITED STATES PATENT AND TRADEMARK OFFICE

CERTIFICATE OF CORRECTION

PATENT NO. : 5,236,185

DATED : August 17, 1993

INVENTOR(S) : Kengo Taneda et al.

It is certified that error appears in the above-indentified patent and that said Letters Patent is hereby corrected as shown below:

Claim 17, column 42, line 1, change "a" to --the--.

Signed and Sealed this

Twenty-first Day of June, 1994

Bruce Lehman

*Attest:*

BRUCE LEHMAN

*Attesting Officer*

*Commissioner of Patents and Trademarks*